US007163784B2

(12) United States Patent
Kondo

(10) Patent No.: US 7,163,784 B2
(45) Date of Patent: Jan. 16, 2007

(54) SILVER HALIDE EMULSION, AND SILVER HALIDE COLOR PHOTOGRAPHIC MATERIAL USING THE SAME

(75) Inventor: Toshiya Kondo, Hino (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 24 days.

(21) Appl. No.: 11/202,402

(22) Filed: Aug. 11, 2005

(65) Prior Publication Data

US 2006/0040220 A1 Feb. 23, 2006

(30) Foreign Application Priority Data

Aug. 23, 2004 (JP) ..... 2004-242089

(51) Int. Cl.

| | |
|---|---|
| ***G03C 1/06*** | (2006.01) |
| ***G03C 1/005*** | (2006.01) |
| ***G03C 1/494*** | (2006.01) |
| ***G03C 1/46*** | (2006.01) |

(52) U.S. Cl. ..... 430/567; 430/604; 430/605; 430/502; 430/503

(58) Field of Classification Search ..... 430/502, 430/503, 567, 604, 605
See application file for complete search history.

(56) References Cited

U.S. PATENT DOCUMENTS

| | | | | |
|---|---|---|---|---|
| 4,939,080 | A * | 7/1990 | Hioki et al. | 430/567 |
| 5,283,168 | A | 2/1994 | Nelson et al. | |
| 6,242,172 | B1 | 6/2001 | Budz et al. | |
| 2004/0101793 | A1 | 5/2004 | Naoto | |

FOREIGN PATENT DOCUMENTS

| | | |
|---|---|---|
| EP | 0 568 091 A1 | 11/1993 |
| EP | 0 613 044 A2 | 8/1994 |
| JP | 61-47941 | 8/1986 |
| JP | 05150395 | 6/1993 |
| JP | 11-202440 | 7/1999 |

* cited by examiner

*Primary Examiner*—Geraldine Letscher
(74) *Attorney, Agent, or Firm*—Lucas & Mercanti, LLP

(57) ABSTRACT

A silver halide emulsion including silver halide grains and a binder and satisfying Requirement (1) of $0<B/A<0.2$, wherein A (mol %) is an iridium content at a surface of the silver halide grains, and B (mol %) is an average iridium content at a subsurface of the silver halide grains.

9 Claims, No Drawings

SILVER HALIDE EMULSION, AND SILVER HALIDE COLOR PHOTOGRAPHIC MATERIAL USING THE SAME

This application is based on Japanese Patent Application No. 2004-242089, filed on Aug. 23, 2004, in Japanese Patent Office, the entire content of which is hereby incorporated by reference.

FIELD OF THE INVENTION

The present invention relates to a novel silver halide color photographic material which is exposed based on digital information and then processed to prepare a color print, and a silver halide emulsion employed in the above color photographic material.

BACKGROUND OF THE INVENTION

In recent years, the practice of treating images as digital data has rapidly increased, along with enhancement of operation capacity and progress in networking technology. Image information of digitized data using a scanner can via computer be readily edited or enhanced with texts or illustrations. Examples of hard copy materials used to prepare a hard copy based on such digitized images include a sublimation type thermal print, a melt type thermal print, an ink-jet print, an electrostatic transfer type print, a thermo-autochrome print and a silver halide color photographic material. Of these, silver halide color photographic material (hereinafter, also referred to as photographic material) has vastly superior characteristics such as high sensitivity, superior tone, superior image durability and lower cost compared to other print materials, and therefore is broadly employed for preparation of high quality hard copy prints.

Digitized image information can be readily manipulated on a computer, leading to increased practice of treating images comprised of a mixture of images based on photography of people, landscapes, still-life and the like (hereinafter, also denoted as scenic images) and text images (specifically, small thin black text). Accordingly, simultaneous distinct reproduction of natural scene with accompanying text reproduction is required of image output based on digital data.

Further, recently high definition output image input devices such as digital cameras or film scanners, has been dramatic, which provides high quality image data for image prints, high definition output devices (such as digital exposure apparatuses). Various types of digital exposure apparatuses performing exposure based on digitized image data are now widely available and many kinds of digital exposure apparatuses have also been developed, along with progress in exposure light sources and exposure control devices. Of these digital exposure apparatuses, these using a narrow wavelength distribution light source, such as lasers or LEDs, have become the mainstay.

However, the kinds of laser or LED installed in various types of digital exposure apparatuses are rather haphazard and the exposure wavelengths and exposure times often differ in most exposure devices. Further, exposure time of digital exposure devices is quite different from that of the former analog exposure through a negative film, resulting in exposure time of $10^{-7}$–$10^{-2}$ seconds, meaning that the difference between the digital and analog exposure ranges at a factor of 10,000–100,000. Therefore, color photographic materials are required to exhibit great latitude in exposure time. Further, due to the nature of the apparatus, such digital exposure devices are very vulnerable to the effects of heat, therefore, at least adequate resistance to heat and humidity during exposure of the color photographic material is essential, compared to the film material for analog exposure. Further, along with ubiquity of mini-labs, there are shops providing print service of less than 35 minutes from receipt of an order to delivery of prints, resulting in incentive for the market to further shorten the processing time, and simultaneously, to provide excellent images, specifically using digital devices. However, techniques to realize digital exposure adequacy of the photographic material exhibit drawbacks of production stability of the silver halide color photographic material, or the techniques adversely affect processing stability of the material during ever faster processing targets.

To overcome the above drawbacks, various proposals to define constitution or characteristic values of the silver halide color photographic material have been disclosed, for example, a color photographic material exhibiting excellent adequacy to exposure time, and a broader range of conditions at exposure is proposed (please refer, for example, to Patent Document 1). According to the method described in Patent Document 1, high quality images may also be stably obtained due to changes of exposure time and conditions of temperature and humidity at exposure, however, it has been proved after experimentation that there are still problems of reciprocity law failure, latent image stability, and processing stability variation.

There have been disclosed various methods to control by using a metal complex (hereinafter referred to as metal) to be doped in silver halide particles, for the aforementioned various characteristics. For example, there is proposed a method to improve sensitivity, gradient or a reciprocity law failure characteristic by doping metals each having a different electron-emitting speed (e.g., see Patent Document 2). There is further proposed a method to conduct sensitization processing by using a silver halide emulsion containing highly silver chloride that contains metal aquocomplex (e.g., see Patent Document 3). Further, there is disclosed a method to improve sensitivity, gradient or a reciprocity law failure characteristic by using an aquocomplex iridium having Br ligand or an organic ligand complex (e.g., see Patent Document 4).

Further, in recent years, in addition to the various performances mentioned above, an increase of photographic fogging and deterioration of a white background resulting therefrom which are caused by an influence of natural radiation existing in the natural world when a silver halide color photographic photosensitive material is preserved for a long period of time have become problems, and measures for them are required.

There has been proposed a silver halide color photographic photosensitive material whose fitness for rapid processing has been improved by using plural types of silver halide emulsions with high content of silver chloride and by stipulating a sensitivity difference of each silver halide emulsion and content of metal complex compound (e.g., see Patent Document 5). Further proposed has been a silver halide color photographic photosensitive material whose tendency for rapid processing and digital processing have been improved by using plural types of silver halide emulsions with high content of silver chloride, and by stipulating contents of silver chloride, silver bromide and silver iodide in the silver halide emulsions employed in each image forming layer. (e.g., see Patent Document 6). However, any of the disclosed methods above cannot provide high sensitivity, sufficient gradation, resistance to radioactive rays, and latent image stability. Further, to correspond to a rapid processing in recent years, enhancement of increasing processing stability is required, however, no technical suggestion to achieve the above characteristics is found at all in these Patent Documents.

A technology for higher sensitivity employing a silver halide emulsion containing iridium complex and having a localized layer of iridium (e.g., see Patent Document 7), or a technology for higher sensitivity and for reducing fog by using a silver halide emulsion wherein an amount of metal complex in the surface area is less than that in the inside of the particle (e.g., see Patent Document 8). However, a method to control precisely iridium content in the inside of a particle is not mentioned in any method, and there is no technical suggestion at all, concerning a method having high sensitivity and sufficient gradient and improving resistance to radioactive rays, processing stability and latent image stability.

(Patent Document 1) Unexamined Japanese Patent Application No. (hereinafter, referred to as JP-A) 2003-207874

(Patent Document 2) JP-A 2002-214733

(Patent Document 3) JP-A 2001-356441

(Patent Document 4) JP-A 2002-357879

(Patent Document 5) JP-A 2004-37549

(Patent Document 6) JP-A 2003-295371

(Patent Document 7) JP-A 11-202440

(Patent Document 8) JP-A 2004-45463

SUMMARY OF THE INVENTION

This invention has been achieved in view of the problems stated above, and its object is to provide a silver halide color photographic photosensitive material wherein digital exposure fitness and analog exposure fitness is provided, resistance to radioactive rays and latent image stability are improved and fitness of rapid processing is given, and to provide a silver halide emulsion used for the silver halide color photographic photosensitive material.

PREFERRED EMBODIMENT OF THE INVENTION

It should be understood that no single element of any of the embodiments described herein is essential, and that it is within the contemplation of the invention that one or more elements of one or more embodiments of the invention as described herein may be omitted or their functionality may be combined with that of other elements as a general matter of design choice.

The object of the invention mentioned above is attained by the following items.

(Item 1) A silver halide emulsion comprising silver halide grains and a binder and satisfying Requirement (1):

$$0<B/A<0.2 \qquad \text{Requirement (1)}$$

wherein A (mol %) is an iridium content at a surface of the silver halide grains, and B (mol %) is an average iridium content at a surface of the silver halide grains.

(Item 2) The silver halide emulsion of Item 1, further satisfying Requirement (1b):

$$0<B/A<0.1 \qquad \text{Requirement (1b)}$$

(Item 3) The silver halide emulsion of Item 1, further satisfying Requirement (1c):

$$0<B/A<0.05 \qquad \text{Requirement (1c)}$$

(Item 4) A silver halide emulsion comprising silver halide grains and a binder and satisfying Requirement (2):

$$0<B/C<0.7 \qquad \text{Requirement (2)}$$

wherein C (mol %) is an iridium content at a maximum point of the iridium content in an interior of the silver halide grains, and B (mol %) is the average iridium content at the subsurface silver halide grains.

(Item 5) The silver halide emulsion of Item 4, further satisfying Requirement (2b):

$$0<B/C<0.5 \qquad \text{Requirement (2b)}$$

(Item 6) The silver halide emulsion of Item 4, further satisfying Requirement (2c):

$$0<B/C<0.3 \qquad \text{Requirement (2c)}$$

(Item 7) A silver halide emulsion comprising silver halide grains and a binder and satisfying Requirement (3):

$$0<C/A<0.5 \qquad \text{Requirement (3)}$$

wherein C (mol %) is the iridium content at the maximum point of the iridium content in the interior of the silver halide grains, and A (mol %) is the iridium content at the surface of the silver halide grains.

(Item 8) The silver halide emulsion of Item 7, further satisfying Requirement (1).

(Item 9) The silver halide emulsion of Item 7, further satisfying Requirement (2).

(Item 10) A silver halide color photographic material comprising a support having thereon a yellow image forming layer, a magenta image forming layer, and a cyan image forming layer, each of the image forming layers comprising photosensitive silver halide grains and a binder, wherein at least one of the yellow image forming layer, the magenta image forming layer, and the cyan image forming layer contains the silver halide emulsion of any one of Items 1–9.

(Effect of the Invention)

This invention makes it possible to provide a silver halide color photographic photosensitive material wherein digital exposure fitness and analog exposure fitness is provided, resistance to radioactive rays and latent image stability are improved and fitness of rapid processing is given, and to provide a silver halide emulsion used for the silver halide color photographic photosensitive material.

(Preferred Embodiment to Practice the Invention)

The preferred embodiment for practicing the invention will be explained in detail, as follows.

A silver halide emulsion of this invention is one wherein a condition specified by the following requirement (1) is satisfied when A (mol %) represents iridium content on the surface of a silver halide particle, and B (mol %) represents iridium average content in the subsurface of the particle, or one wherein a condition specified by the following requirement (2) is satisfied when C (mol %) represents iridium content at the maximum point of iridium content inside the silver halide particle, or one that satisfies a condition specified by the following requirement (3). It was cleared that a silver halide color photographic photosensitive material wherein digital exposure fitness and analog exposure fitness are provided, resistance to radioactive rays and latent image stability are improved and fitness of rapid processing is given, can be realized by a silver halide color photographic photosensitive material wherein the silver halide emulsion of the invention specified as in the foregoing is contained in at least one of a yellow color image forming layer, a magenta color image forming layer and a cyan color image forming layer. Namely, by controlling the state of existence of iridium complex specified as in the foregoing in the inside of the silver halide particle minutely and most suitably, reciprocity law failure characteristic can be improved, and characteristics in the case of digital exposure and analog exposure can be stabilized, whereby, by providing a localized area for iridium complex in the inside of the particle, damage by natural radiation existing in the natural world is reduced, a latent image to be formed further is reinforced, thus, stability of the latent image and stability under the condition of rapid processing are improved.

In this invention, a surface of the silver halide particle prescribed in Items 1 and 7 is defined to be the silver halide area where crystal lattice which constitute the silver halide particle surface are contained and the content of iridium complex of silver halide particles employing TOF-SIMS which will be explained later can be measured without conducting etching of silver halide particles in measurement thereof. Further, subsurface of the silver halide particle prescribed in Items 1 and 4 is defined to be an area where a depth in the direction perpendicular to the silver halide particle surface is 30–70 Å. Further, an inside of the silver halide particle prescribed in Items 4 and 7 is defined to be an area where a depth in the direction perpendicular to the silver halide particle surface is greater than 70 Å and a particle thickness in the direction perpendicular to the main surface is up to ½.

The iridium content in the invention is a percentage (%) of the iridium content per one mol of silver halide.

In the invention related to Requirement 1, when A (mol %) represents iridium content on the particle surface, it is characterized that the relationship between A (mol %) and average content B (mol %) of iridium on subsurfaces of the particle (average value of iridium complex contents measured at five points at regular intervals on the subsurface area: mol %) satisfies $0<B/A<0.2$, and $0<B/A<1/0.1$ is preferable, and $0<B/A<0.05$ is more preferable. In the invention related to Requirement 2, it is characterized that the maximum point where the iridium content becomes maximum is present in the inside of the particle, and the maximum point where the iridium content becomes maximum mentioned in the invention is a point of change where the iridium content in the direction of a depth perpendicular to the silver halide particle surface changes from an increase to a decrease, and when C (mol %) represents the iridium content at this point of change, it is characterized that the relationship with average content B of iridium complex on the subsurface satisfies $0<B/C<0.7$, and $0<B/C<0.5$ is preferable, and $0<B/C<0.3$ is more preferable. Further, in the invention related to Requirement 3, it is characterized that the relationship between C (mol %) representing the iridium content at the maximum point of iridium content in the silver halide particle and A (mol %) representing the iridium content on the particle surface satisfies $0<C/A<0.5$, in which $0<C/A<0.3$ is preferable, and it is preferable that the relationship between A (mol %) representing iridium content on the particle surface and average content B (mol %) for iridium on the particle subsurface satisfies $0<B/A<0.2$, or the relationship between C (mol %) representing iridium content at the maximum point of iridium content inside the silver halide particle and B (mol %) representing average content of iridium on the particle subsurface $0<B/C<0.7$.

For measurement of iridium complex content in the surface and subsurface of a silver halide particle related to the invention, and for measurement of the maximum point where the iridium complex content inside the particle, a secondary ion mass spectroscopy method (hereinafter referred to as SIMS for abbreviation) can be used. When using SIMS, it is necessary that there is provided a multichannel detecting system capable of measuring simultaneously plural types of ion among various secondary ions emitted from spots destructed by primary ions, such as that disclosed by T. J. Maternaghan et al. "Elemental Mapping of Silver Halide Emulsion Microcrystals by High Resolution Imaging SIMS" J. of Imag. Sci. 34, 58, (1990), and it is not preferable to use a single-channel detecting system such as that shown in Levi Setti et al., Proceedings of East & West Symposium ICPS'90. From the viewpoint stated above, the most preferable SIMS in the present invention is a secondary ion mass spectroscopy method of a time-of-flight type (hereinafter referred to as TOF-SIMS for abbreviation), and it is possible, referring to the description in "Surface analyzing technology—Secondary ion mass spectroscopy method" compiled by Institute of Japan Surface Science and published by Maruzen Co., Ltd., to coat silver halide particles taken out of the silver halide emulsion after gelatin decomposition by proteolytic enzyme and washing, on a wafer of low-resistance silicone single crystal so that the silver halide particles may be dispersed evenly on the base board without cohering or aggregating densely, and to select properly the irradiation conditions such as a type of primary ion, a type of secondary ion, irradiating time and beam current, after drying, thereby, to measure by using TFS-2000 type made by PHI Co. or 2100TRIFT2 made by Physical Electronics Co. After measuring iridium complex content of silver halide particles without etching, it is possible to measure successively iridium complex content on the silver halide particle surface, a subsurface thereof and in the inside of a particle by measuring silver halide particles while etching in the direction of a depth. Further, a depth of etching can be confirmed by an atomic force microscope (being an AFM).

In this invention, For making iridium complex to be contained at the prescribed position of the silver halide particle of this invention, a method to add iridium compound in the silver halide emulsion can be used freely, in this business world, and for controlling the iridium complex content in the silver halide particle, a change in an amount of addition of iridium complex in a localized portion in an optional point of time for growth of silver halide particles, a control of a speed of growth of silver halide particles before and after addition of iridium complex and a use of a compound of general expression (S) are preferable, and a combined use of the methods is more preferable.

In the invention, an appropriate content of iridium complex in the silver halide particle is in a range of $1\times10^{-8}$ mol–$1\times10^{-2}$ mol per one mol of silver halide, a preferable content is in a range of $5\times10^{-7}$ mol–$1\times10^{-3}$ mol, and especially preferable is in a range of $1\times10^{-6}$ mol–$1\times10^{-4}$ mol.

In the invention, it is preferable to use Iridium six-coordination complex, although any iridium compound can be used. AS a ligand that constitutes iridium complex relating to the invention, any of those including a carbony ligand, a fulminate ligand, a thiocyanate ligand, a nitrosyl ligand, a thionitrosyl ligand, a cyano ligand, an aqueous ligand, a halogen ligand or ammonia, a hydroxide, nitrous acid, sulfurous acid, a ligand of peroxide and an organic ligand, can be used, but it is preferable to contain one or more ligands selected from an aqueous ligand, a halogen ligand and an organic ligand.

An organic ligand in the invention is a compound that contains one or more H—C, C—C or C—N—H bonds and is capable of being coordinated with a metal ion. It is preferable that organic ligands used in the invention are a compound selected from those including pyridine, pyrazine, pyrimidine, pyran, pyridazine, imidazole, thiazole, isothiazole, triazole, pyrazole, furan, furazane, oxazole, isoxazole, thiophene, phenanthroline, bipyridine and ethylenediamine, ion or a compound wherein a sustituent is introduced in the aforesaid compounds.

Further, any of potassium ion, calcium ion, sodium ion and ammonium ion can be used as a counter cation of iridium complex related to the invention.

Next, a silver halide emulsion and a silver halide color photographic photosensitive material of the invention will be explained in detail.

For silver halide particles constituting a silver halide emulsion of the invention, optional ones used for ordinary silver halide such as silver chloride, silver bromide, silver iodide, silver iodobromide, silver iodochlorobromide, silver iodochloride and silver chlorobromide can be used, and silver chloride content of 90 mol % or more is preferable, silver chloride content of 93 mol % or more is more preferable, and silver chloride content of 95 mol % or more is further preferable. Further, silver iodide content of 0–2.0 mol % is preferable, silver iodide content of 0.05–2 mol % is more preferable, and silver iodide content of 0.05–1 mol % is further preferable. Besides, silver bromide content of 0.1–10 mol % is preferable, and silver bromide content of 2.0–10 mol % is more preferable.

A silver halide emulsion of the invention with further be explained.

From the viewpoint of reducing the contrast reduction of a characteristic curve at a high density area in the course of high-intensity short time exposure, it is preferable that at least one silver iodide localized phase is provided in the inside of the particle for the silver halide particle related to the invention. The inside of the particle in the invention means a silver halide phase wherein a surface of the particle is removed in the silver halide particle. The silver iodide localized phase in the invention means a silver halide phase containing silver iodide having a silver iodide content that is two times an average silver iodide content or more of silver halide particles relating the invention, and it is preferable to include silver iodide having silver iodide content that is three times an average silver iodide content or more of silver halide particles, and it is preferable to include silver iodide having silver iodide content that is five times an average silver iodide content or more of silver halide particles.

With respect to a position of the aforementioned silver iodide localized phase in the invention, it is preferable that the silver iodide localized phase is positioned at a location from the particle center that is equivalent to 60% or more in terms of a volume of silver halide, and 70% or more is further preferable and 80% or more is most preferable.

One of the preferred embodiment for the aforementioned silver iodide localized phase is that the silver iodide localized phase exists in a layer form in the silver halide particle (hereinafter referred to also as silver iodide localized layer), and it is also preferable that two or more silver iodide localized layers are introduced, and in that case, it is preferable that a main layer is introduced under the aforesaid condition, and at least one layer having the iodide density that is lower than the maximum iodide density (hereinafter referred to as a sub-layer) is introduced to be closer to the particle surface than the main layer is. Iodide density for each of the main layer and the sub-layer can be selected voluntarily. From the viewpoint of latent image stability, it is preferable that the iodide density of the main layer is as high as possible and the iodide density of the sub-layer is lower than that of the main layer.

In the invention, another preferred embodiment for the silver iodide localized phase is that the silver iodide localized phase exists in the vicinity of an apex or of a ridge of the silver halide particle, and combined use with the silver iodide localized layer is also preferable.

A silver halide emulsion comprising silver halide grains having high bromide portions within the grain, is also preferred in this invention. The high bromide portions may be formed by an epitaxial junction or by forming a so-called core/shell structure. Alternatively, there may exist regions partially differing in bromide composition without forming a complete layer. The bromide composition may be continuously varied or discontinuously varied, and silver halide grains having a bromide-localized phase in the vicinity of corners of the grain are preferred.

The expression "bromide-localized phase" herein means a silver halide phase having a relatively high bromide content. Thus, the bromide-localized phase has a bromide content of at least two times the average bromide content of the grains, preferably at least three times and more preferably at least 5 times the average bromide content.

The bromide content and iodide content of silver halide grains can be determined in the EPMA method (Electron Probe Micro Analyzer method). Specifically, silver halide grains are dispersed to not be in contact with each other to prepare a sample. The sample is irradiated with an electron beam, while cooled at a temperature of at most −100° C. using liquid nitrogen, and the characteristic X-ray intensities of silver, bromine and iodine, radiated from single silver halide grains are measured to determine the iodide and bromide content of the grain.

The bromide-localized phase preferably contains a Group 8 metal compound, to be described later, which is preferably an iridium complex compound.

In the silver halide emulsion of this invention, the coefficient of variation of silver iodide content among the silver halide grains is preferably at most 40%, more preferably at most 30%, and still more preferably at most 20%.

In the silver halide emulsion of this invention, the coefficient of variation of silver bromide content among the silver halide grains is preferably at most 30%, and more preferably at most 20%.

The silver bromide content of more than 300 random grains is determined via the above method, and the resulting average value is designated as the mean silver bromide content. The coefficient of variation of silver bromide content among the silver halide grains of this invention is determined by the following mathematical formula.

Coefficient of variation of silver bromide content among the grains=(standard deviation of silver bromide content among silver halide grains)/(average silver bromide content)×100 (%)

The silver iodide content of more than 300 random grains is determined via the above method, and the resulting average value is designated as the mean silver iodide content. The coefficient of variation of silver iodide content among the silver halide grains of this invention is determined by the following mathematical formula.

Coefficient of variation of silver iodide content among the grains=(standard deviation of silver iodide content among silver halide grains)/(average silver iodide content)×100 (%)

In this invention, there can be used various iodine compounds to allow silver iodide to be contained in silver halide grains. Examples thereof include the use of an aqueous iodide salt solution, such as an aqueous potassium iodide solution, the use of a polyiodide compound, as described in S. Nakahara "Mukikagobutsu•Sakutai Jiten" (Dictionary of Inorganic Compounds and Complexes, page 944, published by Kodansha Ltd.) and the use of microscopic iodide-containing silver halide grains or iodide ion-releasing agents, as disclosed in JP-A 2-68538. The use of an aqueous iodide salt solution, microscopic iodide-containing silver halide grains or iodide ion-releasing agents is preferable. The silver iodide content of the silver halide grains and the silver iodide content of an iodide-localized phase can appropriately be controlled by adjusting the concentration or the quantity of an iodide containing solution.

In this invention, there can be used various iodine compounds to allow silver bromide to be contained in silver halide grains. Examples thereof include the use of an aqueous bromide salt solution, such as an aqueous potassium bromide solution, and the use of microscopic bromide-containing silver halide grains or bromide ion-releasing agents, as disclosed in JP-A 2-68538. The use of an aqueous bromide salt solution, microscopic bromide-containing silver halide grains or bromide ion-releasing agents is preferable. The silver bromide content of the silver halide grains and the silver bromide content of an bromide-localized phase can appropriately be controlled by adjusting the concentration or the quantity of an bromide containing solution.

When allowing silver iodide and/or silver bromide to be contained in a silver halide phase by supplying silver halide fine-grains, the silver halide fine-grains preferably have an average grain size of not more than 0.05 μm, more preferably from 0.001 to 0.03 μm, but still more preferably from 0.001 to 0.02 μm. The silver halide fine-grains are preferably prepared employing a low molecular weight gelatin having an average molecular weight of 40,000 or less, more preferably 5,000–25,000, but still more preferably 5,000–15,000. The silver halide fine-grains are prepared preferably at a temperature of not more than 40° C., more preferably not more than 30° C., but still more preferably 5–20° C. The silver halide fine-grains can be prepared by commonly known methods and manufacturing apparatuses, and the use of a continuous nucleation apparatus described in JP-A 2000-112049 is specifically preferred.

In the silver halide emulsion of this invention, it is preferable to contain the following compound represented by Formula (S) in the interior the grains, from the viewpoint of exhibiting the effects of this invention.

Formula (S)

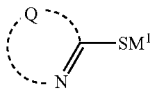

wherein Q is an atomic group necessary to form a 5- or 6-membered nitrogen-containing ring, $M^1$ is a hydrogen atom, alkali metal or a group forming a monovalent cation (or a monovalent cation group).

Further, the compound represented by above Formula (S) is preferably a compound represented by Formula (S-2).

Formula (S-2)

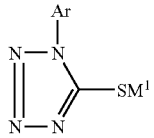

In above Formula (S-2), Ar is a group represented by:

Formula 3

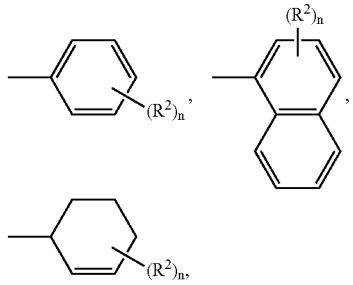

In the Formulas, $R^2$ is an alkyl group, an alkoxy group, a carboxy group or its salt, a sulfo group or its salt, a hydroxy group, an amino group, an acylamino group, a carbamoyl group or a sulfonamido group; n is an integer of 0–2; $M^1$ is the same as defined in the foregoing formula (S).

In this invention, "the interior of the silver halide grains" means the phase of the silver halide removing the grain surface of the silver halide grains.

In the formula (S), examples of the 5-membered ring represented by Q include, for example, an imidazole ring, tetrazole ring, thiazole ring, oxazole ring, selenazole ring, benzimiazole ring, naphthoimidazole ring, benzothiazole ring, naphthothiazole ring, benzoselenazole ring, naphthoselenazole ring, and benzoxazole ring. Examples of the 6-membered ring represented by Q include a pyridine ring, pyrimidine ring and quinoline ring. The 5-membered or 6-membered ring may be substituted.

In Formula (S), alkali metals represented by $M^1$ include, for example, a sodium atom and potassium atom.

The mercapto compounds represented by Formula (S) or (S-2) are preferably represented by Formulas (S-1), (S-3) and (S-4).

Specifically, the compounds represented by foregoing Formula (S) is preferably the compounds represented by following Formula (S-1) or foregoing Formula (S-2).

Formula (S-1)

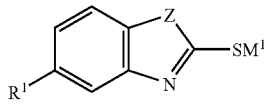

In the formula, $R^1$ is a hydrogen atom, an alkyl group, an alkoxy group, an aryl group, a halogen atom, a carboxyl group or the salt thereof, a sulfo group or the salt thereof, or an amino group; Z is —NH—, —O— or —S—; and $M^1$ is the same as defined in foregoing Formula (S).

In foregoing Formulas (S-1) and (S-2), the alkyl group represented by $R^1$ and $R^2$ includes, for example, a methyl group, an ethyl group and a butyl group; the alkoxy group includes a methoxy group and an ethoxy group, salts of the a carboxy group or a sulfo group includes sodium and ammonium salts.

In formula (S-1), the aryl group represented by $R^1$ includes, for example, a phenyl and a naphthyl group, and the halogen atom includes, for example, a chlorine atom and a bromine atom.

In formula (S-2), the acylamino group represented by $R^2$ includes, for example, a methylcarbonylamino and a benzoylamino group; the carbamoyl group includes, for example, an ethylcarbamoyl and a phenylcarbamoyl group; and the sulfonamido group includes, for example, a methylsulfonamido and a phenylsulfonamido group.

The above alkyl, alkoxy, aryl, amino, acylamino, carbamoyl and sulfonamido groups may be substituted with substituents.

Formula (S-3)

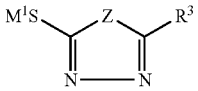

In Formula, Z is —$NR^3$—, an oxygen atom or a sulfur atom; $R^3$ is a hydrogen atom, alkyl group, aryl group, alkenyl group, cycloalkyl group, —$SR^{31}$, —$NR^{32}(R^{33})$—, —$NHCOR^{34}$, —$NHSO_2R^{35}$ or a heterocyclic group; $R^{31}$ is a hydrogen atom, alkyl group, alkenyl group, cycloalkyl group, aryl group, —$COR^{34}$, or —$SO_2R^{35}$; $R^{32}$ and $R^{33}$ are each a hydrogen atom, alkyl group or aryl group; $R^{34}$ and $R^{35}$ are each an alkyl group or aryl group; $M^1$ is the same as defined in Formula (S).

In Formula (S-3), the alkyl group represented by $R^3$, $R^{31}$, $R^{32}$, $R^{33}$, $R^{34}$ and $R^{35}$ includes, for example, a methyl, benzyl, ethyl and propyl group; and the aryl group includes, for example, a phenyl and a naphthyl group.

The alkenyl group represented by $R^3$ and $R^{31}$ includes, for example, a propenyl group; the cycloalkyl group includes, for example, a cyclohexyl group. The heterocyclic group represented by $R^3$ includes, for example, a furyl and a pyridinyl group.

The foregoing alkyl or aryl group represented by $R^3$, $R^{31}$, $R^{32}$, $R^{33}$, $R^{34}$ and $R^{35}$, the alkenyl or cycloalkyl group represented by $R^3$ and $R^{31}$ and the heterocyclic group represented by $R^3$ may each be substituted with substituents.

Formula (S-4)

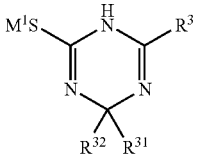

In Formula, $R^3$ and $M^1$ are each the same as defined in Formula (S-3), $R^{31}$ and $R^{32}$ are each the same as defined in Formula (S-3).

Specific examples of the compounds represented by Formula (S) are shown below but this invention is by no means limited to these.

S-1-1

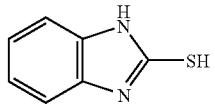

S-1-2

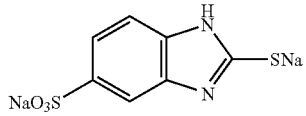

S-1-3

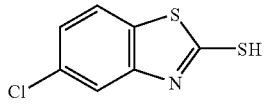

S-1-4

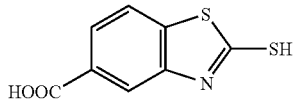

S-1-5

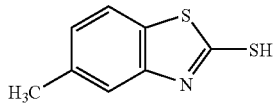

S-1-6

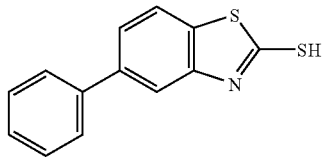

S-1-7

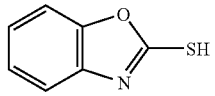

S-1-8

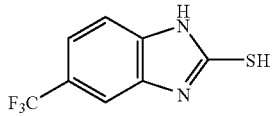

S-2-1

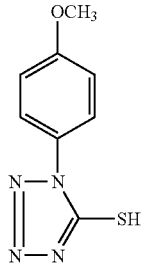

S-2-2

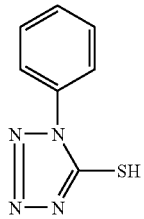

-continued
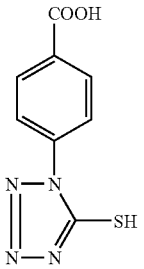
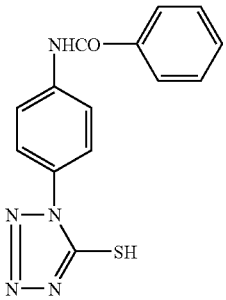
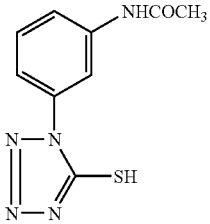
-continued
S-2-3
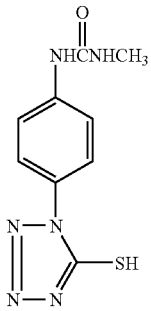
S-2-4
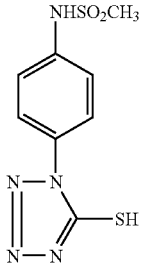
S-2-5
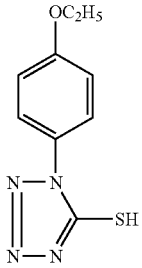
S-2-6
S-2-7
S-2-8
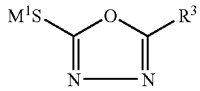
| Compound | $R^3$ | $M^1$ |
|---|---|---|
| S-3-1 | $—C_2H_5$ | —H |
| S-3-2 | $—CH_2—CH=CH_2$ | —H |
| S-3-3 | $—CH=CH—CH_2—CH_3$ | —H |
| S-3-4 | $—C_7H_{15}$ | —H |
| S-3-5 | $—C_9H_{19}$ | —Na |
| S-3-6 | 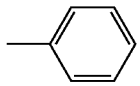 | —H |
| S-3-7 | $—C_4H_9(t)$ | —H |
| S-3-8 | 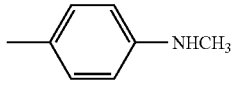  | —H |
| S-3-9 | 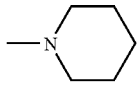  | —H |

-continued
| | | |
|---|---|---|
| S-3-10 | 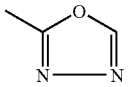 | —H |
| S-3-11 | 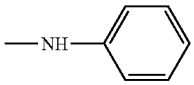 | —H |
| S-3-12 | 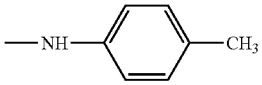 | —H |
| S-3-13 | —NHCOCH$_3$ | —H |
| S-3-14 | 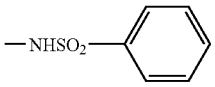 | —H |
| S-3-15 | —N(CH$_3$)$_2$ | —H |
| S-3-16 | 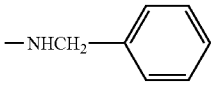 | —H |
| S-3-17 | 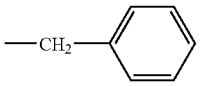 | —H |
| S-3-18 | —S—CH$_3$ | —H |
| S-3-19 | 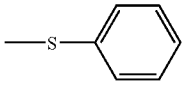 | —H |
| S-3-20 | —SH | —H |
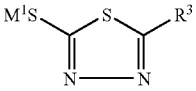
| Compound | R$^3$ | M$^1$ |
|---|---|---|
| S-3-21 | —H | —H |
| S-3-22 | —C$_2$H$_5$ | —H |
| S-3-23 | —C$_4$H$_9$(t) | —H |
| S-3-24 | —C$_6$H$_{13}$ | —H |
| S-3-25 | 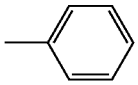 | —H |
| S-3-26 | 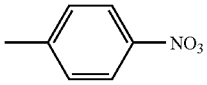 | —H |
| S-3-27 | 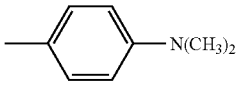 | —H |
| S-3-28 | 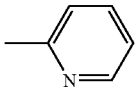 | —H |
| S-3-29 | 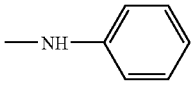 | —H |

-continued
| | | |
|---|---|---|
| S-3-30 | —NH—N($CH_3$)$_2$ | —H |
| S-3-31 | —$CH_2CH$=$CH_2$ | —H |
| S-3-32 | —SH | —H |
| S-3-33 | —$NHCOC_2H_5$ | —H |
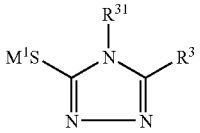
| Compound | $R^3$ | $R^{31}$ | $M^1$ |
|---|---|---|---|
| S-3-34 | —$C_2H_5$ | —H | —H |
| S-3-35 | —$CH_3$ | —$CH_3$ | —H |
| S-3-36 | —$CH_3$ | 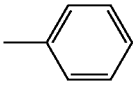 | —H |
| S-3-37 | —$NHCOCH_3$ | —$CH_3$ | —H |
| S-3-38 | 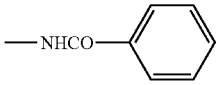 | 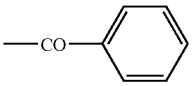 | —H |
| S-3-39 | —$NHCOCH_3$ | —$COCH_3$ | —H |
| S-3-40 | —$NHCOCH_3$ | 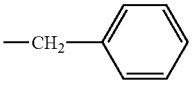 | —H |
| S-3-41 | —$NHCOC_2H_5$ | 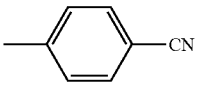 | Na |
| S-3-42 | 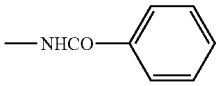 | 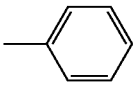 | H |
| S-3-43 | —$NHSO_2CH_3$ | —H | H |
| S-3-44 | 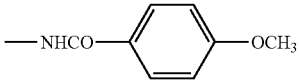 | —$CH_3$ | Na |
| S-3-45 | 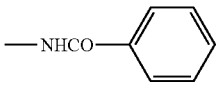 | —$CH_2CH$=$CH_2$ | H |
| S-3-46 | 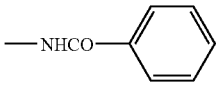 | 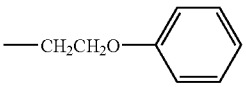 | —H |
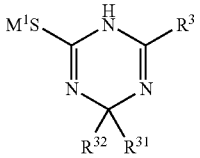
| Compound | $R^3$ | $R^{31}$ | $R^{32}$ | $M^1$ |
|---|---|---|---|---|
| S-4-1 | —$C_2H_5$ | —$CH_3$ | —$CH_3$ | —H |
| S-4-2 | 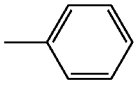 | —$CH_3$ | —$CH_3$ | —H |

-continued

| | | | | |
|---|---|---|---|---|
| S-4-3 | —$NH_2$ | —H | 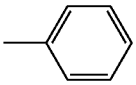 | —H |
| S-4-4 | 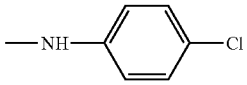 | —H | —$C_4H_9$ | —H |
| S-4-5 | —$NHCOCH_3$ | —$CH_3$ | —$CH_3$ | —H |
| S-4-6 | 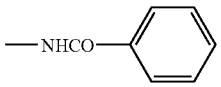 | —$CH_3$ | —$CH_3$ | —H |
| S-4-7 | 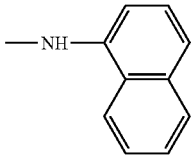 | —$CH_3$ | —$C_3H_7$(i) | —H |
| S-4-8 | 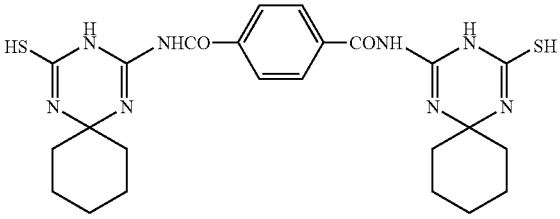 | | | |

The compounds represented by Formula (S) include ones described, for example, in Examined Japanese Patent Application Publication No. (hereinafter, referred to as JP-B) 40-28496, JP-A 50-89034; J. Chem. Soc. 49, 1748 (1927), ibid 4237 (1952); J. Org. Chem. 39, 2469 (1965); U.S. Pat. No. 2,824,001; J. Chem. Soc. 1723 (1951); JP-A 56-111846; and U.S. Pat. Nos. 1,275,701, 3,266,897, and 2,403,927; and can be synthesized based on the synthesis described in the foregoing literature.

The compound of formula (S) is added preferably in an amount of $1\times10^{-8}$–$1\times10^{-1}$ mol/mol AgX, and more preferably $1\times10^{-7}$ to $1\times10^{-2}$ mol/mol AgX.

In the interior of the silver halide grains of this invention, regions exhibiting differing concentration of foregoing compound represented by Formula (S) may be at any location within the grains. Further, the concentration is not limited as long as the desired grains are formed, but in the interior of the silver halide grains, it is preferable that more than two silver halide phases exhibiting differing concentrations of foregoing Formula (S) compound exist. Further, it is more preferable that in the interior of the silver halide grains, a silver halide phase exhibiting a lower concentration of foregoing Formula (S) compound exist, than the silver halide phase exhibiting the maximum concentration of Formula (S) compound existing at the outside of the silver halide phase having the maximum concentration of Formula (S) compound. For example, preferably employed are silver halide grains, the conformation in which the concentration of Formula (S) compound at the outermost surface region (being a shell portion) is lower that that of the interior regions (being a core portion). Herein, "a shell portion" means the final stage of grain formation in grain growth, and means also the outermost region of the grain including the surface of the grain.

The average concentration of foregoing Formula (S) compound contained in the shell portion of the silver halide emulsion of this invention is preferably at most $1.5\times10^{-4}$ mol per mol of silver halide. The concentration of forgoing Formula (S) compound in the shell portion may be zero, and preferably $0.1$–$1\times10^{-4}$ mol, but more preferably $0.1$–$0.5\times10^{-4}$ mol per mol of silver halide.

The concentration of Formula (S) compound contained in the core portion is preferably higher than that contained in the shell portion, and it is preferably $0.5$–$3\times10^{-4}$ mol per mol of silver halide.

Further, plural Formula (S) compounds may be added in combination, and the kinds and the compositions of the combination of the compounds may be different during plural silver halide phases, the core portion or in the shell portion. These compounds may be added at any grain forming stage with any method, but are preferably added by being incorporated in a halide solution in advance.

In the silver halide grains of this invention, the volume of the shell portion is preferably at most 50% of the total volume of the silver halide grain, but more preferably the volume of the shell portion is at most 30% of the total volume of the silver halide grain. Further, in a configuration in which the extremely restricted subsurface region serves as a shell region, the present invention applies.

Further, in this invention, foregoing Formula (S) compound may be added into the interior of the grain during grain formation, as well as onto the surface of the grain during any appropriate stage, such as between the end of grain formation and the start of chemical sensitization, at the start of chemical sensitization, during chemical sensitization, at the end of chemical sensitization, and between the end of chemical sensitization and coating.

In this invention, it is preferable that the silver halide grains are normal crystals exhibiting dislocation lines in the peripheral region of the grains. In this invention, "silver halide grains exhibiting dislocation lines in the peripheral region of the grain" means that at most 50% by number of the total silver halide grains are grains exhibit dislocation lines in the peripheral region. It is preferably at least 70% of the grains, and more preferably at least 80%.

In this invention, "the peripheral region" of the silver halide grain means the region from the edges of a projected image of the cubic silver halide grain of this invention from the vertical direction to (100) faces of the grain, to a distance of 20% of the diameter of the grain in the direction vertical to the edges.

In the silver halide emulsion of this invention, it is preferable that the silver halide grains exhibiting more than five dislocation lines in the peripheral region of the grain account for more than 50% (by number) of the total silver halide grains, is more preferable that that the silver halide grains exhibit more than ten dislocation lines in the peripheral region of the grain account for more than 50% of the total silver halide grains, and is still more preferable that the silver halide grains exhibit more than twenty dislocation lines in the peripheral region of the grain account for more than 50% of the total silver halide grains.

In the silver halide grains of this invention, the dislocation lines may exist in other than above peripheral region.

The dislocation line of the silver halide grain of this invention may be directly observed by means of a transmission electron microscope at a low temperature, for example, in accordance with methods described in J. F. Hamilton, Phot. Sci. Eng. 11 (1967) pg. 57; and T. Shiozawa, Journal of the Society of Photographic Science and Technology of Japan, 35 (1972) pg. 213. Silver halide grains are taken out from an emulsion while making sure not to exert any pressure that might cause dislocation in the grains, and they are then placed on a mesh for an electron microscope. The sample is then observed by a transmission electron microscope, while cooled to prevent the grain from being damaged by the electron beams. Since electron beam penetration is hampered as the grain thickness increases, sharper observations are obtained when using an electron microscope of higher voltage (e.g., at a voltage 200 kV or more for a 0.25 μm thick grain). It is preferred to employ an electron microscope having a still higher acceleration voltage for further thicker grains.

When transmission observation by electron beams is difficult due to grain thickness, a silver halide grain may be sliced parallel to a (100) face at not more than 0.25 μm thick, while paying close attention so as not to apply pressure to the extent of causing dislocation and the presence/absence of dislocation line can be confirmed by observation of the slice.

In the silver halide grains of this invention, the coefficient of variation of the number of dislocation lines per grain among the grains preferably is not more than 30%, and more preferably not more than 20%.

The coefficient of variation of the number of dislocation lines may be determined by observation of dislocation lines of at least random 300 silver halide grains, based on the following equation, where K (%) is the coefficient of variation among the grains, σ is the standard deviation of dislocation lines and α is the average value of dislocation lines per grain:

$$K(\%)=(\sigma/\alpha)\times 100$$

In this invention, dislocation lines may be introduced into the silver halide grains by employing an operation of local formation of an iodide-containing phase and/or a bromide-containing phase by the use of the various iodine compounds and/or bromides described above. Examples thereof include the use of an aqueous iodide salt solution, such as an aqueous potassium iodide solution, the use of a polyiodide compound, as described in S. Nakahara "Mukikagobutsu•Sakutai Jiten" (Dictionary of Inorganic Compounds and Complexes, pg. 944, published by Kodansha Ltd.) and the use of iodide-containing silver halide fine-grains or iodide ion-releasing agents, as disclosed in JP-A 2-68538. The use of iodide ion-releasing agents and/or bromide ion-releasing agents is preferred, the use of iodide ion-releasing agents is more preferred, and the use of iodide ion-releasing compounds and/or bromide ion-releasing compounds described in JP-A Nos. 11-271912 and 2000-250164 is specifically preferred.

The number of dislocation lines and the region exhibiting dislocation lines in the silver halide grains of this invention may appropriately be controlled by optimum selection of the addition amount of the foregoing iodide ion-releasing compounds and/or bromide ion-releasing compounds, the pH value causing iodide ion and/or bromide ion release, the inter-grain distance of silver halide grains, the growth temperature of silver halide grains and the rate of releasing iodide ions and/or bromide ions.

In the process of formation of silver halide grains of this invention, the iodide ion-releasing agent and/or bromide ion-releasing agent are added preferably 50%–98% of the final silver halide grain volume, and more preferably 70%–95%. The iodide ion-releasing agent and/or bromide ion-releasing agent are added preferably in an amount of 0.02–8 mol % based on silver halide, and more preferably 0.04–5 mol %.

The pH causing the iodide ion-releasing agent and/or bromide ion-releasing agent to release iodide ion and/or bromide ion is preferably 5.0–12.0, and more preferably 6.0–11.0. The temperature causing the iodide ion-releasing agent and/or bromide ion-releasing agent to release iodide ion and/or bromide ion is preferably 10–80° C., and more preferably 20–70° C. Concentration using ultrafiltration is preferably employed to appropriately control the inter-grain distance, causing the iodide ion-releasing agent and/or bromide ion-releasing agent to release iodide ion and/or bromide ion. At least two kinds of the iodide ion-releasing agent and/or bromide ion-releasing agent may be employed in combination.

The shape of the silver halide grains of this invention may be any appropriate shape, and one of the preferable examples is a cubic exhibiting a (100) surface as the crystal surface. Further, it is possible to employ grains, such as octahedral grains, tetradecahedral grains, tetracosahedral grains and dodecahedral grains, which may be prepared with methods described in U.S. Pat. Nos. 4,183,756 and 4,225,666, JP-A 55-26589, JP-B 55-42737 (hereinafter, the term, JP-B means Examined Japanese Patent Application Publication No.), and the J. Photogr. Sci., vol. 21, pg. 39, 1973. Further, grains other than a normal crystal, such as having twin faces or tabular grains, may be employed.

In the silver halide grains of this invention, grains comprised of a single shape are preferably employed, but more than two kinds of monodispersed silver halide grains may be added to the same layer.

The grain diameter of the silver halide grains of this invention is not specifically limited, but from the view of rapid processing and photographic characteristics such as sensitivity, it is preferably 0.1–5.0 μm, but more preferably 0.2–3.0 μm. Specifically, in cases when cubic grains are employed, it is preferably 0.1–1.2 μm, but more preferably 0.15–1.0 μm.

In the distribution of grain diameter of the silver halide grains of this invention, preferred are monodispersed silver halide grains exhibiting a coefficient of variation of at most 0.22, more preferably at most 0.15, still more preferably at most 0.10. Herein, the coefficient of variation is one exhibiting breadth of distribution of the grain diameters, and is defined by the following equation.

$$\text{Coefficient of variation}=S/R$$

wherein S is a standard deviation of distribution of the grain diameters, and R is the average grain diameter. Herein, "the grain diameter" means the diameter when the grain is a spherical silver halide grain, however when the grain is other than spherical or cubic, it means the diameter of a circular image converted to the equivalent area of the projected image.

In the silver halide emulsion of this invention, it is preferable that at least one kind of complexes selected from Group 8 metal complexes, exhibiting water ligands or organic ligands, is incorporated in the interior of the silver halide grains.

Group 8 metal complexes containing aqua ligands and organic ligands of this invention are described below.

The Group 8 metal complexes employable in this invention are preferably metal complexes of iron, iridium, rhodium, osmium, ruthenium, cobalt and platinum. Of these metal complexes, hexadentage, heptadentage, tetradentage and bidentage may be employed, of which hexadentage and tetradentage are preferred. At least one kind of complex selected from the group of the above Group 8 complexes containing more than one aqua ligand or organic ligand, is preferably an iridium complex of this invention.

In this invention, any appropriate ligand is employable and examples of a ligand include carbonyl ligand, fulminate ligand, thiocyanate ligand, nitrosyl ligand, thionitrosyl ligand, cyano ligand, aqua ligand, halogen ligand, ligands of ammonia, a hydroxide, nitrous acid, sulfurous acid and a peroxide and organic ligands. Of these, it is preferred to contain more than one ligands selected from nitrocyl ligand, thionitrocyl ligand, cyano ligand, aqua ligand, halogen ligand and an organic ligand.

In this invention, the organic ligand refers to a compound containing more than one of H—C, C—C and C—N—H bonds and capable of being coordinated with a metal ion. Preferred organic ligands employable in this invention include a compound selected from pyridine, pyrazine, pyrimidine, pyrane, pyridazine, imidazole, thiazole, isothiazole, triazole, pyrazole, furan, furazane, oxazole, isooxazole, thiophene, phenthroline, bipyridine and ethylenediamine, their ions and compounds substituted with the foregoing compounds.

Preferred examples of iridium complexes and ions thereof containing at least one aqua ligand and/or organic ligand which are more preferably employed in this invention are listed below, but are by no means limited to these. Any counter cation is employable, including potassium ion, calcium ion, sodium ion ammonium ion. When the metal complex is an anionic ion, the counter ions include well known ions in the art, such as a nitrate ion, a halide ion and a perchlorate ion.

(A-1) $K[IrBr_5(H_2O)]$
(A-2) $K_2[IrBr_5(H_2O)]$
(A-3) $K_3[IrBr_5(H_2O)]$
(A-4) $K_4[IrBr_5(H_2O)]$
(A-5) $K[IrBr_4(H_2O)_2]$
(A-6) $[IrBr_4(H_2O)_2]$
(A-7) $[IrBr_3(H_2O)_3]$
(A-8) $[IrBr_3(H_2O)_3]Br$
(A-9) $K[IrCl_5(H_2O)]$
(A-10) $K_2[IrCl_5(H_2O)]$
(A-11) $K_3[IrCl_5(H_2O)]$
(A-12) $K_4\ [IrCl_5(H_2O)]$
(A-13) $K[IrCl_4(H_2O)_2]$
(A-14) $[IrCl_4(H_2O)_2]$
(A-15) $[IrCl_3(H_2O)_3]$
(A-16) $[IrBr_3(H_2O)_3]Cl$
(A-17) $[Ir(bipy)CL_4]^-$
(A-18) $[Ir(bipy)Br_4]^-$
(A-19) $[Ir(bipy)_3]^{2+}$
(A-20) $[Ir(py)_6]^{2+}$
(A-21) $[Ir(phen)_3]^{2+}$
(A-22) $[IrCl_2(bipy)_2]$
(A-23) $[Ir(thia)_6]^{2+}$
(A-24) $[IrCl_5(thia)]^{2-}$
(A-25) $[IrCl_4(thia)_2]^-$
(A-26) $[IrCl_5(5\text{-methylthia})]^{2-}$
(A-27) $[IrCl_4(5\text{-methylthia})_2]^-$
(A-28) $[IrBr_5(thia)]^{2-}$
(A-29) $[IrBr_4(thia)_2]^-$
(A-30) $[IrBr_5(5\text{-methylthia})]^{2-}$
(A-31) $[IrBr_4(5\text{-methylthia})_2]^-$
(A-32) $[Ir(phen)(bipy)_3]^{2+}$
(A-33) $[Ir(im)_6]^{2+}$
(A-34) $[IrCl_5(im)]^{2-}$
(A-35) $[IrCl_4(im)_2]^-$
(A-36) $[IrBr_5(im)]^{2-}$
(A-37) $[IrBr_4(im)_2]^-$
(A-38) $[Ir(NCS)_2(bipy)_2]$
(A-39) $[Ir(CN)_2(bipy)_2]$
(A-40) $[IrCl_2(bipy)_3]$
(A-41) $[IrCl_2(bipy)_2]$
(A-42) $[Ir(phen)(bipy)_2]^{2+}$
(A-43) $[Ir(NCS)_2(bipy)_2]$
(A-44) $[Ir(NCS)_2(bipy)_2]$
(A-45) $[Ir(bipy)_2(H_2O)(bipy')]^{2+}$
(A-46) $[Ir(bipy)_2(OH)(bipy')]^+$
(A-47) $[Ir(bipy)Cl_4]^{2-}$
(A-48) $[Ir(bipy)_3]^{3+}$
(A-49) $[Ir(py)_6]^{3+}$
(A-50) $[Ir(phen)_3]^{3+}$
(A-51) $[IrCl_2(bipy)_2]^+$
(A-52) $[Ir(thia)_6]^{3+}$
(A-53) $[Ir(phen)(bipy)_3]^{3+}$
(A-54) $[Ir(im)_6]^{3+}$
(A-55) $[Ir(NCS)_2(bipy)_2]^+$
(A-56) $[Ir(CN)_2(bipy)_2]^+$
(A-57) $[IrCl_2(bipy)_3]^+$
(A-58) $[IrCl_2(bipy)_2]^+$
(A-59) $[Ir(phen)(bipy)_2]^{3+}$
(A-60) $[Ir(NCS)_2(bipy)_2]^+$
(A-61) $[Ir(NCS)_2(bipy)_2]^+$
(A-62) $[Ir(bipy)_2(H_2O)(bipy')]^{3+}$
(A-63) $[Ir(bipy)_2(OH)(bipy')]^{2+}$ In the above Group 8 metal compounds and Group 8 metal complexes, abbreviation terms are as follows:

bipy: bipyridine bidendate ligand bipy': bipyridine monodendate ligand im: imidazole py: pyridine phen: phenthroline thia: thiazole 5-methylthia: 5-methylthiazole In formation of the silver halide emulsion of this invention, further to addition of at least one Group 8 metal complex containing an aqua ligand and/or organic ligand, it is preferred to add more than one Group 8 metal complexes represented by following Formula (A):

$$R_n[MX_mY_{6-m}] \qquad \text{Formula (A)}$$

wherein M is a metal selected from Group 8 elements of the Periodical Table, preferably iron, cobalt, ruthenium, iridium, rhodium, osmium and platinum, and more preferably iron, ruthenium, iridium, rhodium, osmium; R is an alkali metal, preferably cesium, sodium and potassium; m is an integer of 0–6, and n is an integer of 0–4; X and Y are each a ligand, including carbonyl ligand, fulminate ligand, thiocyanate ligand, nitrosyl ligand, thionitrosyl ligand, cyano ligand, aqua ligand, halogen ligand, ligands of ammonia, a hydroxide, nitrous acid, sulfurous acid and a peroxide ligands.

Specific examples of Group 8 metal compounds and Group 8 metal complexes are listed below, but this invention is by no means limited to these. Further, any counter cation is employable, including potassium ion, calcium ion, sodium ion and ammonium ion. Counter anions for the metal complexes include ones known in the art, such as a nitrate ion, a halide ion and a perchlorate ion.

(E-1) $K_2[IrCl_6]$
(E-2) $K_3[IrCl_6]$
(E-3) $K_2[Ir(CN)_6]$
(E-4) $K_3[Ir(CN)_6]$
(E-5) $K_2[Ir(NO)\ ((CN)_5)$
(E-6) $K_2[IrBr_6]$
(E-7) $K_3[IrBr_6]$
(E-8) $K_2[IrBr_4Cl_2]$
(E-9) $K_3[IrBr_4Cl_2]$
(E-10) $K_2[IrBr_3Cl_3]$
(E-11) $K_3[IrBr_3Cl_3]$
(E-12) $K_2[IrBr_5Cl]$
(E-13) $K_3[IrBr_5Cl]$
(E-14) $K_2[IrBr_5I]$
(E-15) $K_3[IrBr_5I]$
(E-16) $K_3[IrBr(CN)_5]$
(E-17) $K_3[IrBr_2(CN)_4]$
(E-18) $K_2[Ir(CN)_5(H_2O)]$
(E-19) $K_3[Ir(CN)_5(H_2O)]$
(E-20) $K[Ir(NO)Cl_5]$
(E-21) $K[Ir(NS)Cl_5]$
(F-1) $K_2[RuCl_6]$
(F-2) $K_2[FeCl_6]$
(F-3) $K_2[PtCl_6]$
(F-4) $K_3[RhCl_6]$
(F-5) $K_2[OsCl_6]$
(F-6) $K_2[RuBr_6]$
(F-7) $K_2[FeBr_6]$
(F-8) $K_2[PtBr_6]$
(F-9) $K_3[RhBr_6]$
(F-10) $K_2[OsBr_6]$
(F-11) $K_2[Pt(SCN)_4]$
(F-12) $K_4[Ru(CNO)_6]$
(F-13) $K_4[Fe(CNO)_6]$
(F-14) $K_2[Pt(CNO)_4]$
(F-15) $K_3[Co(NH_3)_6]$
(F-16) $K_3[Co(CNO)_6]$
(F-17) $K_4[Os(CNO)_6]$
(F-18) $Cs_2[Os(NO)Cl_5]$
(F-19) $K_2[Ru(NO)Cl_5]$
(F-20) $K_2[Ru(CO)Cl_5]$
(F-21) $Cs_2[Os(CO)Cl_5]$
(F-22) $K_2[Fe(NO)Cl_5]$
(F-23) $K_2[Ru(NO)Br_5]$
(F-24) $K_2[Ru(NO)I_5]$
(F-25) $K_2[Ru(NS)Cl_5]$
(F-26) $K_2[Os(NS)Cl_5]$
(F-27) $K_2[Ru(NS)Br_5]$
(F-28) $K_2[Ru(NS)(SCN)_5]$
(F-29) $K_2[RuBr_6]$
(F-30) $K_2[FeBr_6]$
(F-31) $K_4[Fe(CN)_6]$
(F-32) $K_3[Fe(CN)_6]$
(F-33) $K_4[Ru(CN)_6]$
(F-34) $K_4[Os(CN)_6]$
(F-35) $K_3[Rh(CN)_6]$
(F-36) $K_4[RuCl(CN)_5]$
(F-37) $K_4[OsBr(CN)_5]$
(F-38) $K_4[OsCl(CN)_5]$
(F-39) $K_3[RhF(CN)_5]$
(F-40) $K_3[Fe(CO)(CN)_5]$
(F-41) $K_4[RuF_2(CN)_4]$
(F-42) $K_4[OsCl_2(CN)_4]$
(F-43) $K_4[RhI_2(CN)_4]$
(F-44) $K_4[Ru(CN)_5(OCN)]$
(F-45) $K_4[Ru(CN)_5(N_3)_4]$
(F-46) $K_4[Os(CN)_5(SCN)]$
(F-47) $K_4[Rh(CN)_5(SeCN)]$
(F-48) $K_4[RuF_2(CN)_4]$
(F-49) $K_3[Fe(CN)_3Cl_3]$
(F-50) $K_4[Os(CN)Cl_5]$
(F-51) $K_3[Co(CN)_6]$
(F-52) $K_2[RuBr(CN)_5]$
(F-53) $K_2[Os(NS)(CN)_5]$
(F-54) $K[Ru(NO)_2Cl_4]$
(F-55) $K_4[Ru(CN)_5(N_3)_4]$
(F-56) $K_2[Os(NS)Cl(SCN)_4]$
(F-57) $K_2[Ru(NS)(I)_5]$
(F-58) $K_2[Os(NS)Cl_4(TeCN)_4]$
(F-59) $K_2[Rh(NS)Cl_5]$
(F-60) $K_2[Ru(NO)(CN)_5]$
(F-61) $K[Rh(NO)_2Cl_4]$
(F-62) $K_2[Rh(NO)Cl_5]$

In this invention, to allow the foregoing Group 8 metal compounds to be incorporated, doping may be conducted during physical ripening of silver halide grains or in the course of forming silver halide grains (in general, during addition of water-soluble silver salt and alkali halide), as same manner as the iridium compounds of this invention are incorporated. Alternatively, forming silver halide grains is interrupted and doping is carried out, and then, the grain formation is continued. Doping may also be conducted by performing nucleation, physical ripening or grain formation in the presence of Group 8 metal compound.

The Group 8 metal compound is employed in an amount of $1\times10^{-9}$–$1\times10^{-2}$ mol, preferably $5\times10^{-9}$–$1\times10^{-3}$ mol, and more preferably $1\times10^{-8}$–$1\times10^{-4}$ mol per mol of silver halide.

In this invention, commonly known methods of adding additives to a silver halide emulsion are applicable to allow the Group 8 metal compound to be incorporated in silver halide grains, for example, the compound may be directly dispersed in an emulsion or incorporated through solution in solvents such as water, methanol or ethanol, singly or in combination. Further, Group 8 metal compound may be added to the silver halide emulsion together with the silver halide micro-grains, and further added may be silver halide micro-grains containing a Group 8 metal compound during silver halide grain formation.

A method of preparing a silver halide emulsion, in which silver halide micro-grains, including a Group 8 metal compound are added during grain formation, are described in JP-A Nos. 11-212201 and 2000-89403.

The silver halide emulsion of this invention is preferably prepared employing at least one compound represented by following Formulas (1)–(3).

$$R—SO_2S\text{-}M \qquad \text{Formula (1)}$$

$$R_1—SO_2S—R_2 \qquad \text{Formula (2)}$$

$$R_3—SO_2S—L_m\text{-}SSO_2—R_4 \qquad \text{Formula (3)}$$

In above Formulas (1)–(3), R, $R_1$, $R_2$, $R_3$ and $R_4$ are each an aliphatic group, an aromatic group or a heterocyclic group, which may be the same or different. M is a divalent linkage group, and m is 0 or 1.

In above Formulas (1)–(3), aliphatic groups represented by R, $R_1$–$R_4$ are straight chain, branched chain or cyclic aliphatic hydrocarbon groups which are substituted or unsubstituted, and are preferably alkyl groups of 1–22 carbon atoms, or alkenyl or alkynyl groups of 2–22 carbon atoms.

Further, as alkyl groups, listed examples are a methyl group, ethyl group, propyl group, pentyl group, hexyl group, octyl group, 2-ethylhexyl group, decyl group, dodecyl group, hexadecyl group, octadecyl group, cyclohexyl group, isopropyl group, and a t-butyl group. As alkenyl groups, listed examples are an aryl group, and a butenyl group, while a listed example of an alkynyl group is a propargyl group.

Aromatic groups represented by R, $R_1$–$R_4$ include monocyclic and condensed ring aromatic groups, of which preferable are ones exhibiting 6–20 carbon atoms, such as a phenyl group and a naphthyl group.

Heterocyclic groups represented by R, $R_1$–$R_4$ include heterocyclic groups of a monocyclic or condensed ring, such as groups derived from a 3- or 10-membered hetero ring which contains at least one atom selected from: nitrogen, oxygen, sulfur, selenium, and tellurium, and also contains at least one carbon atom. Preferable heterocyclic groups include 3- to 6-membered heterocyclic groups, such as ring groups of: pyrrolidine, piperidine, pyridine, tetrahydrofuran, thiophene, oxazole, thiazole, imidazole, benzothiazole, benzoxazole, benzimidazole, selenazole, benzoselenazole, tetrazole, triazole, benzotriazole, oxadiazole, and thiazole.

Aliphatic groups, aromatic groups and heterocyclic groups represented by R, $R_1$–$R_4$ may further have a substituent, and examples of these substituents include an alkyl group (such as a methyl group, an ethyl group, and a hexyl group); an alkoxy group (such as a methoxy group, an ethoxy group and an octyloxy group); an aryl group (such as a phenyl group, a naphthyl group, and a tolyl group); a hydroxy group; a halogen atom (such as a fluorine atom, a chlorine atom, a bromine atom, and an iodine atom); an aryloxy group (such as a phenoxy group); an alkylthio group (such as a phenylthio group); an acyl group (such as an acetyl group, a propionyl group, a butyryl group, and a valeryl group); a sulfonyl group (such as a methylsulfonyl group, and a phenylsulfonyl group); an acylamino group (such as an acetylamino group, and a benzoylamino group); a sulfonylamino group (such as a methanesulfonylamino group, and a benzenesulfonylamino group); an acyloxy group (such as an acetoxy group, and a benzoxy group); a carboxy group; a cyano group; a sulfo group; an amino group; a —SO2SM; and an aliphatic group, an aromatic group and a heterocyclic group represented by above R, $R_1$–$R_4$.

A divalent linkage group, represented by L, is an atom or an atomic group, which includes at least one atom such as a carbon atom, a nitrogen atom, a sulfur atom, and an oxygen atom. Specifically, the divalent linkage group is an alkylene group, an alkenylene group, an alkynylene group, an arylene group, an —O—, an —S—, an —NH—, a —CO—, an —$SO_2$—, either singly or in combination.

As a divalent linkage group represented by L, preferred is a divalent aliphatic group or a divalent aromatic group, listed examples of which are —$(CH_2)_n$-<n=1–12>, —$CH_2$—CH═CH—$CH_2$—, —$CH_2$—C≡C—$CH_2$—, a xylylene group, a phenylene group, a naphthylene group, and

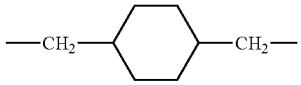

A divalent linkage group represented by L may further be substituted with the above-mentioned substituent.

M is preferably a metal ion, an ammonium ion or an organic cationic ion. Examples of the metal ion include a lithium ion, a sodium ion, and a potassium ion. Examples of the organic cationic ion include an alkyl ammonium ion (such as a tetramethyl ammonium ion, and a tetrabutyl ammonium ion), a phosphonium ion (such as a tetraphenyl phosphonium ion), and a guanidyl ion.

Further, the compounds represented by Formulas (1)–(3) may be incorporated in a polymer as a constituent element of the polymer. When the compounds represented by Formulas (1)–(3) are incorporated in a polymer, the following are listed as a repeating unit.

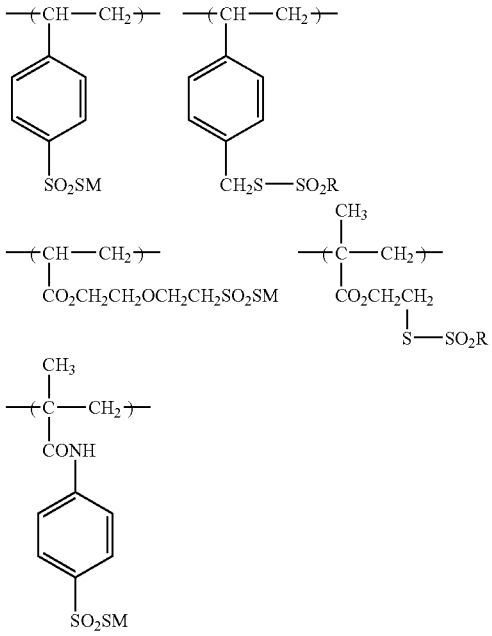

A polymer including these repeating units may be a homopolymer or a copolymer with other copolymerizable monomers.

Specific examples of the compounds represented by Formulas (1)–(3) and specific examples of the polymers including the compounds represented by Formulas (1)–(3) as a constituent element of the polymer are listed below, but this invention is not limited thereto.

(1-1) $CH_3SO_2SNa$ (1-2) $C_2H_5SO_2SNa$ (1-3) $C_2H_5SO_2SK$ (1-4) $C_4H_9SO_2SLi$ (1-5) $C_6H_{13}SO_2SNa$ (1-6) $C_8H_{17}SO_2SNa$ (1-7) $CH_3(CH_2)_3-CH(C_2H_5)CH_2SO_2S\cdot NH_4$ (1-8) $C_{10}H_{21}SO_2SNa$ (1-9) $C_{12}H_{25}SO_2SNa$ (1-10) $C_{16}H_{33}SO_2SNa$ (1-11) $(CH_3)_2CH-SO_2SK$ (1-12) $(t)C_4H_9SO_2SNa$ (1-13) $CH_3OCH_2CH_2SO_2S\cdot Na$ (1-14)

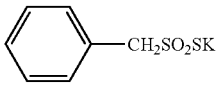

(1-15) $CH_2{=}CHCH_2SO_2SNa$ (1-16)

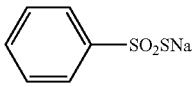

(1-17)

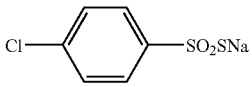

(1-18)

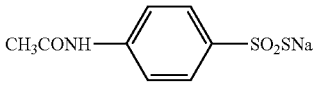

(1-19)

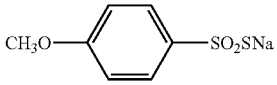

(1-20)

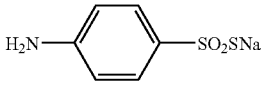

(1-21)

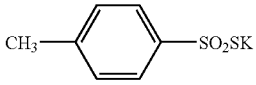

-continued (1-22)

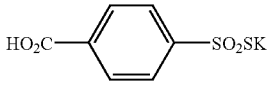

(1-23)

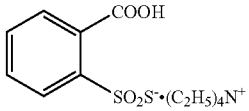

(1-24)

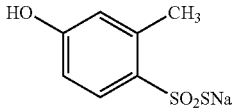

(1-25)

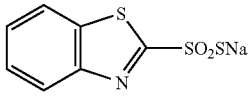

(1-26)

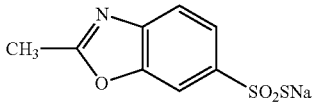

(1-27)

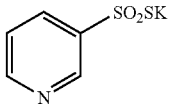

(1-28)

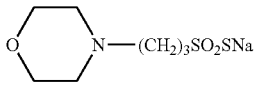

(1-29) $KSSO_2(CH_2)_3SO_2SK$ (1-30) $NaSSO_2(CH_2)_4SO_2SNa$ (1-31) $NaSSO_2(CH_2)_4S(CH_2)_4SO_2SNa$ (1-32)

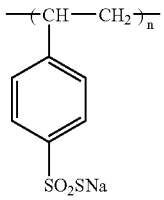

(1-33)

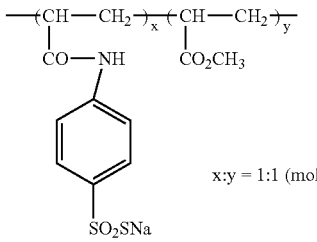

x:y = 1:1 (mol ratio)

(1-34)

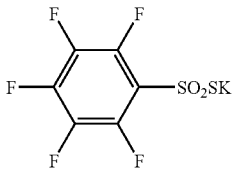

-continued
(1-35)
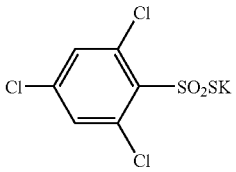
(2-1)
$C_2H_5SO_2S—CH_3$
(2-2)
$C_8H_{17}SO_2SCH_2CH_3$
(2-3)
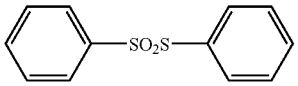
(2-4)
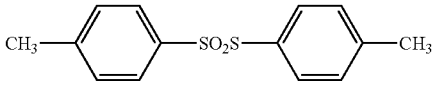
(2-5)
$C_2H_5SO_2SCH_2CH_2CN$
(2-6)
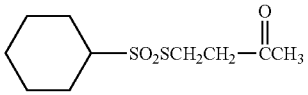
(2-7)
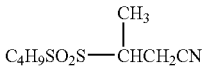
(2-8)
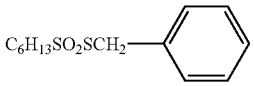
(2-9)
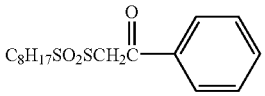
(2-10)
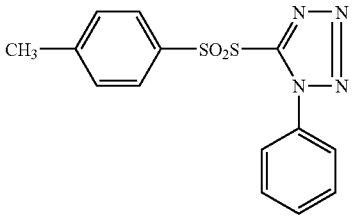
(2-11)
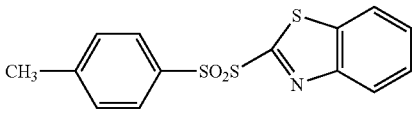
(2-12)
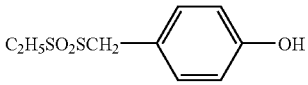
(2-13)
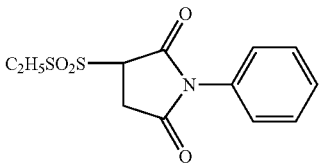
-continued
(2-14)
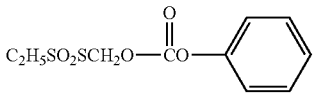
(2-15)
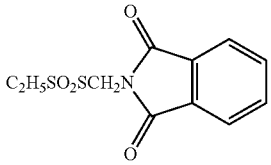
(2-16)
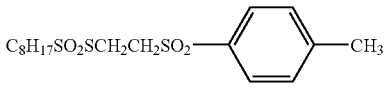
(2-17)
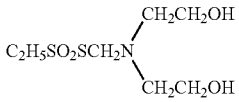
(2-18)
$C_2H_5SO_2SCH_2CH_2CH_2CH_2OH$
(2-19)
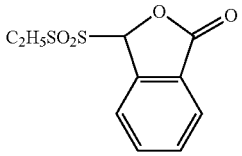
(2-20)
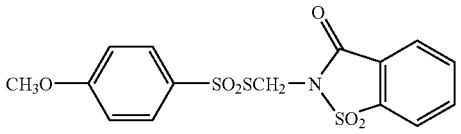
(2-21)
$CH_3SSO_2(CH_2)_4SO_2SCH_3$
(2-22)
$CH_3SSO_2(CH_2)_8SO_2SCH_3$
(2-23)
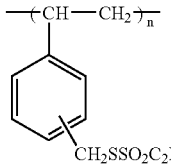
(2-24)
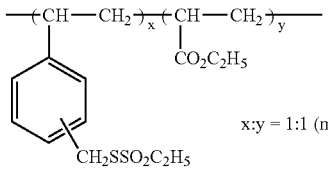
x:y = 1:1 (mol ratio)
(2-25)
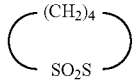
(3-1)
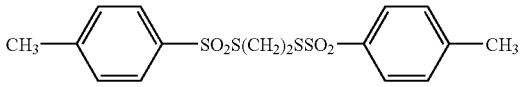
(3-2)
$C_2H_5SO_2SCH_2CH_2SO_2CH_2CH_2SSO_2C_2H_5$ -continued (3-3)

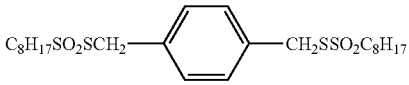

(3-4)

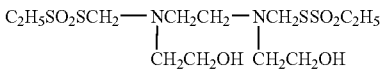

(3-5)

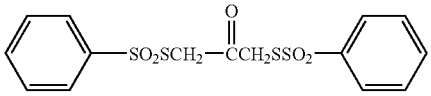

(3-6)

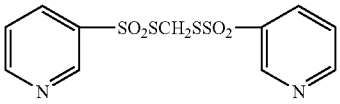

(3-7)

$C_2H_5SO_2SSSO_2C_2H_5$ (3-8)

$(n)C_3H_7SO_2SSSO_2C_3H_7(n)$ (3-9)

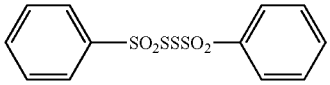

In the silver halide emulsion of this invention, it is preferred that the silver halide emulsion includes a gelatin which contains substantially no calcium ion. The gelatin which contains substantially no calcium ion is one having a calcium content of 100 ppm or less, preferably 50 ppm or less, and more preferably 30 ppm or less. The gelatin which contains substantially no calcium ion may be obtained by a cationic deionization process employing ion-exchange resins.

In the silver halide emulsion of this invention, the gelatin which contains substantially no calcium ion is preferably employed in at least one of the processes of silver halide grain formation, desalting, dispersion, and chemical sensitization and/or spectral sensitization, and more preferably prior to chemical sensitization and/or spectral sensitization. The gelatin which contains substantially no calcium ion preferably accounts for at least 10% by weight of the entire dispersing medium of a prepared silver halide emulsion, more preferably at least 30%, and still more preferably at least 50%.

In the silver halide emulsion of this invention, a chemically modified gelatin of which amino group is substituted is preferably employed in the preparation of a silver halide emulsion to perform the formation and/or desalting of silver halide grains. Examples of such a chemically modified gelatin include modified gelatins described in JP-A Nos. 5-72658, 9-197595 and 9-251193 in which an amino group of gelatin has been substituted. The use of a chemically modified gelatin in the process of grain formation and/or desalting is preferably in an amount of at least 10% by weight of the entire dispersing medium, more preferably at least 30%, and still more preferably at least 50%. The substitution ratio of an amino group is preferably at least 30%, more preferably at least 50%, and still more preferably at least 80%.

In the manufacturing process of the silver halide emulsion of this invention, desalting of the emulsion is preferably conducted after completion of grain formation. Desalting is conducted in such a manner, for example, as described in RD 17643, sect. II.

Specifically, to remove unwanted soluble salts from a precipitation product or a physically ripened emulsion, a noodle washing method may be employed, or inorganic salts, anionic surfactants or anionic polymers [e.g., poly (styrene sulfonic acid)] are also usable, but a flocculation method using gelatin derivatives or chemically modified gelatin (e.g., acylated gelatin and carbamoylated gelatin) and a ultrafiltration method employing membrane separation are preferred.

The ultrafiltration method employing membrane separation is referred to "Kagaku Kogaku Binran (Handbook of Chemical Engineering)" 5th ed., pp. 924–954; RD vol. 102, 10208 and vol. 131, 13122; JP-B Nos. 59-43727 and 62-27008; JP-A Nos. 62-113137, 57-209823, 59-43727, 61-219948, 62-23035, 63-40137, 63-40039, 3-140946, 2-172816, 2-172817 and 4-22942. Ultrafiltration is conducted preferably employing an apparatus or a method described in JP-A Nos. 11-339923 and 11-231448.

Dispersing medium employed in the preparation of the silver halide emulsion of this invention is a compound exhibiting a protective colloid property for silver halide grains. Preferably, the dispersing medium is allowed to exist in the nucleation and growth stages of silver halide grain formation. Preferred dispersing mediums usable in this invention include gelatin and hydrophilic colloids. Preferred examples of gelatin usable in this invention include an alkali process or acid process gelatin having a molecular weight of ca. 100,000, an oxidized gelatin, and enzymatic process gelatin described in Bull. Soc. Sci. Photo. Japan No. 16, pg. 30 (1966). Gelatin having an average molecular weight of 10,000–70,000 is preferably employed in the nucleation stage of silver halide grains, and more preferably employed is gelatin having the average molecular weight of 10,000–50,000. To reduce the average molecular weight, gelatin is degraded by using a gelatin degradation enzyme or hydrogen peroxide. The use of gelatin having a relatively low methionine content in the nucleation stage is preferred specifically in the preparation of tabular silver halide grains. The methionine content is preferably not more than 50 μmol per unit weight (g) of dispersing medium, and more preferably not more than 20 μmol. The methionine content can be reduced by subjecting gelatin to an oxidation treatment by using hydrogen peroxide.

Examples of a hydrophilic colloid include gelatin derivatives, a graft polymer of gelatin with other polymers, proteins such as albumin or casein; cellulose derivatives such as hydroxyethyl cellulose, carboxymethyl cellulose, cellulose sulfuric acid esters; saccharide derivatives such as sodium alginate and starch derivatives and synthetic hydrophilic polymeric materials of homopolymers such as polyvinyl alcohol and its partial acetal, poly-N-vinylpyrrolidone, polyacrylic acid, polymethacrylic acid, polyacrylamide, polyvinylimidazole, and polyvinylpyrazole and their copolymers. Examples of usable gelatin usable include an alkali process gelatin, acid process gelatin, an oxidized gelatin, and enzymatic process gelatin described in Bull. Soc. Sci. Photo. Japan No. 16, page 30 (1966). There are also usable hydrolytic products and enzymatic degradation products of gelatin.

There can be employed a variety of apparatuses and methods for preparing silver halide emulsions, which are generally known in the art.

The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Further, normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521.

There can be employed a apparatus for supplying a silver salt aqueous solution and a halide aqueous solution through an adding apparatus provided in a reaction mother liquor, as described in JP-A Nos. 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains, as described in JP-B 56-501776.

Further, solvents for silver halide such as thioethers are optionally employed. A compound containing a mercapto group, nitrogen containing heterocyclic compound or a compound such as a sensitizing dye can also be added at the time of forming silver halide grains or after completion thereof.

Next, other constituent elements of the silver halide color photographic material of this invention will be described.

The silver halide emulsion of this invention is preferably provided with selenium sensitization.

As a selenium sensitizer employable in this invention, labile selenium compounds capable of forming silver selenide upon reaction with aqueous silver nitrate are employed. Examples thereof are described in U.S. Pat. Nos. 1,574,944, 1,602,592 and 1,623,499; and JP-A Nos. 60-150046, 4-25832, 4-109240 and 4-147250.

Examples of useful selenium sensitizers include colloidal selenium, isoselenocyanates (e.g., allyl isoselenocyanate), selenoureas (e.g., N,N-dimethylselenourea, N,N,N'-triethylselenourea, N,N,N',N'-tetramethylselenourea, N,N,N'-trimethyl-N'-heptafluoropropylselenourea, N,N'-dimethyl-N,N'-bis(carboxymethyl)selenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid, methyl-3-selenobutylate), selenophosphates (e.g., tri-p-triselenophosphate, pentafluorophenyl-diphenylselenophosphate), and selenides (e.g., dimethylselenide, tributylphosphine selenide, triphenylphosphine selenide, tri-p-tolylphosphine selenide, pentafluorophenyl-diphenylphosphine selenide, trifurylphosphine selenide, tripyridylphosphine selenide). Of these, specifically preferable selenium sensitizers are selenoureas, selenoamides and selenides.

Specific examples of techniques for using selenium sensitizers are disclosed in the following patents: U.S. Pat. Nos. 1,574,944, 1,602,592, 1,623,499, 3,297,466, 3,297,447, 3,320,069, 3,408,196, 3,408197, 3,442,653, 3,420,670, and 3,591,385; French Patent Nos. 2,693,038 and 2,093,209; JP-B Nos. 52-34491, 52-34492, 53-295 and 57-22090; and JP-A Nos. 59-180536, 59-185330, 59-181337, 59-187338, 59-192241, 60-150046, 60-151637, 61-246738, 3-4221, 3-24537, 3-111838, 3-116132, 3-148648, 3-237450, 4-16838, 4-25832, 4-32831, 4-33043, 4-96059, 4-109240, 4-140738, 4-140739, 4-147250, 4-184331, 4-190225, 4-191729, 4-195035, 5-11385, 5-40324, 5-24332, 5-24333, 5-303157, 5-306268, 6-306269, 6-27573, 6-75328, 6-175259, 6-208184, 6-208186, 6-317867, 7-92599, 7-98483, 7-104415, 7-140579, 7-301879, 7-301880, 8-114882, 9-19760, 9-138475, 9-166941, 9-138375, 9-189979, 10-10666 and 2001-343721; and British Patent Nos. 255,846 and 861,984; and H. E. Spencer, Journal of Photographic Science, 31, 158–169 (1983).

A selenium sensitizer is added preferably in an amount of $1\times10^{-9}$ to $1\times10^{-5}$ mol per mol of silver halide, and more preferably $1\times10^{-8}$ to $1\times10^{-5}$ mol.

Selenium sensitizers are added to a silver halide emulsion in such a manner that additives are usually incorporated to photographic emulsions. For example, a water-soluble compound is dissolved in water and a water-insoluble or hardly water-soluble compound is dissolved in a water-miscible solvent exhibiting no adverse effect on photographic characteristics, such as alcohols, glycols, ketones, esters, and amides, and they are added in the form of solution.

The silver halide emulsion of this invention may be sensitized with the above selenium sensitizing method and in combination with the sensitizing method using a gold compound or a chalcogen sensitizer.

A chalcogen sensitizer to be applied to the silver halide emulsion includes a sulfur sensitizer and a tellurium sensitizer, but a sulfur sensitizer is preferred.

Specific examples of preferred sulfur sensitizers include thiourea derivatives such as 1,3-diphenylthiourea, triethylthiourea and 1-ethyl-3-(2-thiazolyl)thiourea; rhodanine derivatives, dithiocarbamic acids, polysulfide organic compounds, thiosulfates, and simple substance of sulfur. Of simple substances of sulfur, rhombic α-sulfur is preferred. There are also usable sulfur sensitizers described in U.S. Pat. Nos. 1,574,944, 2,410,689, 2,278,947, 2,728,668, 3,501,313, and 3,656,955; West German Open Patent No. (OLS) 1,422,869; and JP-A Nos. 56-24937 and 55-45016.

Further, in this invention, it is preferable to simultaneously employ noble metal salts such as gold, platinum, palladium and iridium described in Research Disclosure (hereinafter, also denoted simply as RD). Of these, the in-combination use of a gold sensitizer is specifically preferred. Examples of useful gold sensitizers include chloroauric acid, gold thiosulfate, gold thiocyanic acid and organic gold compounds described in U.S. Pat. Nos. 2,597,856 and 5,049,485; JP-B No. 44-15748 and JP-A Nos. 1-147537 and 4-70650. Further, when performing sensitization by using a gold complex, ligands for gold, such as a thiosulfate, thiocyanate, and thioether are preferably used as an auxiliary agent and the use of a thiocyanate is specifically preferred.

Regarding above various kinds of sensitizers, inhibitors and oxidants, preferably employed compounds and techniques for using those are described in: JP-A Nos. 2001-318443, 2003-29472, 2004-37554, 2004-4144, 2004-4446, 2004-4452, 2004-4456, 2004-4458, 2004-4656, 2004-4672, 2003-307803, 2003-287841, 2003-287842, 2003-233146, 2003-172990, 2003-172991, 2003-113193, 2003-113194, 2003-114489, 2002-372765, 2002-296721, 2002-278011, 2002-268169, 2002-244241, 2002-250982, 2002-258427, 2002-268168, 2002-268170, 2000-193942, 2001-75214, 2001-75215, 2001-75216, 2001-75217, 2001-75218, 2001-100352, 2004-70363, 2004-67695, 2002-131858, 2001-166412; European Patent Nos. 1094360 and 1388752; and U.S. Pat. Nos. 6,686,143 and 6,322,961.

The added amount of a chalcogen sensitizer or a gold sensitizer, depending on the kind of a silver halide emulsion, the kind of a used compound and ripening conditions, is preferably $1\times10^{-9}$–$1\times10^{-5}$ mol per mol of silver halide, and more preferably $1\times10^{-8}$–$1\times10^{-4}$ mol. Various sensitizers described above may be added in accordance with properties of a sensitizer, for example, by solution in water or organic solvents such as methanol, by a mixture with a gelatin solution or by a method described in JP-A 4-140739, that is, addition in the form of emulsified dispersion of a solution mixed with a polymer soluble in an organic solvent.

In this invention, reduction sensitizers may further be employed and reducing compounds described in RD vol. 307, 307105 and JP-A No. 7-78685 are usable.

In the silver halide color photographic material of this invention, as spectral sensitizing dyes employed for each color sensitive region of blue, green and red, are described in, by F. M. Harman, Heterocyclic Compounds—Cyanine Dyes and related Compounds, John Wiley & Sons, New York & London, 1964.

In the silver halide emulsions can be employed a variety of spectral sensitizing dyes known in the art. Compounds BS-1–BS-8 described in JP-A 3-251840 on pg. 28 are preferably employed as a blue-sensitive sensitizing dye. Compounds GS-1–GS-5 described in the same JP-A on pg. 28 are preferably employed as a green-sensitive sensitizing dye. Compounds RS-1–RS-8 described in the same JP-A on pg. 29 are preferably employed as a red-sensitive sensitizing dye. Further, in cases when image exposure is conducted by infrared rays employing a semiconductor laser, infrared-sensitive sensitizing dyes are employed. Compounds IRS-1–IRS-11 described in JP-A 4-285950 on pp. 6–8 are preferably employed as an infrared-sensitive sensitizing dye. Further, Supersensitizers SS-1–SS-9 described in JP-A 4-285950 on pp. 8–9 and Compounds S-1–S-17 described in JP-A 5-66515 on pp. 5–17 are preferably incorporated, in combination with these infrared-sensitive, blue-sensitive, green-sensitive and red-sensitive sensitizing dyes.

The added amount of these spectral sensitizing dyes is in the wide range in individual cases, and is preferably $0.5\times10^{-6}$–$1.0\times10^{-2}$ mol per mol of silver halide, but more preferably in the range of $1.0\times10^{-6}$–$5.0\times10^{-3}$ mol.

As the addition method of the spectral sensitizing dyes to the silver halide emulsion, any method well known in the art is employable. For example, these spectral sensitizing dyes may directly be dispersed in the emulsion, or may be added to the emulsion in the form of solution in which these dyes are dissolved into; a water soluble solvent such as pytidine, methyl alcohol, ethyl alcohol, methyl cellosolve, acetone, fluorinated alcohol, dimethylformamide, or the mixture thereof; after diluted with water; or dissolved in water. Ultrasonic vibration may be employed during the dissolving process.

Further, dyes may be added to the emulsion with the methods in which; dyes are dissolved in the volatile organic solvent and dispersed into a hydrophilic colloid and this dispersion is added to emulsion, as described in U.S. Pat. No. 3,469,987; or water-insoluble dyes are dispersed into the water-soluble solvent without being dissolved and this dispersion liquid is added to the emulsion, as described in JP-B 46-24185.

Further, the dyes may be added to the emulsion in the form of dispersion with an acid dissolution dispersion method. Other than those methods to add to the emulsion, employable methods are described in U.S. Pat. Nos. 2,912,345, 3,342,605, 2,996,287, and 3,425,835.

The time of addition of the sensitizing dye to the emulsion is at any appropriate time during the course of silver halide grain formation to just before the application of the emulsion onto a support.

Specifically, it may be any time such as; before silver halide grain formation, during silver halide grain formation, between completion of silver halide grain formation and the start of chemical sensitization, at the start of chemical sensitization, during chemical sensitization, at completion of chemical sensitization, and between completion of chemical sensitization and start of coating. Further, the dyes may be added in several times.

To the silver halide emulsion of this invention, to prevent fogging generated during manufacturing processes of the silver halide photographic material, to reduce characteristic changes in storage, and to prevent fogging generated during development, an antifoggant, an oxidizing agent, an inhibitor or a stabilizer, known in the art, may be employed. Examples of preferred compounds for the purpose include compounds represented by Formula (II) described in JP-A 2-146036 on pg. 7, in lower column. Specifically more preferable compounds include Compounds (IIa-1)–(IIa-8), and (IIB-1)-(IIb-7), described in the same JP-A, on pg. 8; compounds of 1-(3-methoxyphenyl)-5-mercaptotetrazole and 1-(4-ethoxyphenyl)-5-mercaptotetrazole; Formula (S) compounds described in JP-A 8-6201; thiosulfonic acid compounds; disulfide compounds; polysulfide compounds; and also preferably employed compounds are described in JP-A 2003-29472, 2003-10482 and 2002-312557.

These compounds are added in the step of preparing the silver halide emulsion, the chemical sensitization step or during the course of from completion of chemical sensitization to preparation of a coating solution. The preferable added amount of these compounds is $1\times10^{-8}$–$1\times10^{-1}$ mole per mole of silver halide, more preferably $1\times10^{-7}$–$1\times10^{-2}$ mole. To add these compounds, employable are the well known methods in the art, such as to add the additives to the photographic emulsions, the coating compositions or the preparation. For example, these compounds are added in the form of solution, in cases when the compound is water soluble, it is dissolved to an aqueous solution of appropriate concentration, and when it is water-insoluble or hardly water-soluble, it is dissolved in a water-miscible solvent exhibiting no adverse effect on photographic characteristics, such as alcohols, glycols, ketones, esters, and amides, and the solution may be added in the form of solution.

In the photographic material, employed are dyes having absorption at various wavelengths for anti-irradiation and anti-halation. A variety of dyes known in the art may be employed, including dyes having absorption in the visible range described in JP-A 3-251840 on pg. 30, AI-1–AI-11, and JP-A 6-3770; infra-red absorbing dyes described in JP-A 1-280750 on pg. 2, in the left lower column, Formulas (I), (II) and (III). These dyes do not adversely affect photographic characteristics of a silver halide emulsion and there is no stain due to residual dyes. Specific examples of preferable compounds include Exemplified Compounds (1)–(45) described in above JP-A on pg. 3 in the lower left column to pg. 5 in the lower left column. For the purpose of improving sharpness, the dye is preferably added in an amount that gives a reflection density at 680 nm of 0.7 to 3.0 before processing, and more preferably 0.8 to 3.0.

Fluorescent brightening agents are also preferably incorporated into the photographic material to improve whiteness. Examples of preferred compounds include those represented by Formula II described in JP-A 2-232652.

In cases when the silver halide photographic material of this invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler respectively. The silver halide emulsion contains one or more kinds of sensitizing dyes, singly or in combination thereof.

As couplers employed in silver halide photographic materials of this invention, employable is any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by Formulas (C-I) and (C-II) described in JP-A 4-114154 on pg. 5, in the lower left column. Exemplary compounds described therein (from pg. 5, in the lower right column to pg. 6, lower left column) are CC-1–CC-9.

Examples of preferred magenta couplers include those which are represented by Formulas (M-I) and (M-II) described in JP-A 4-114154 on pg. 4, in the upper right column. Exemplary compounds described therein (from pg. 4, lower left column to pg. 5, in the upper right column) are MC-1–MC-11. Of these magenta couplers, ore preferable couplers are ones represented by Formula (M-I) described in foregoing Patent, on pg. 4, in the upper right column; and couplers in which $R_M$ in Formula (M-I) is a tertiary alkyl group, are specifically preferred. Further, couplers MC-8–MC-11 are superior in color reproduction of blue to violet and red, and in description of details.

Examples of preferred yellow couplers include those which are represented by Formula (Y-I) described in JP-A 4-114154 on pg. 3, in the upper right column. Exemplary compounds described therein (on pg. 3, in the lower left column) are YC-1–YC-9. Of these, couplers in which $R_{Y1}$ in Formula (Y-I) is an alkoxy group, are specifically preferred, or couplers represented by Formula [I] described in JP-A 6-67388 are preferable due to capability of reproducing a desirable yellow tone. Specifically preferred examples thereof include YC-8–YC-9 described in JP-A 4-114154 on pg. 4, in the lower left column and Compound Nos. (1)–(47) described in JP-A 6-67388 on pp. 13–14. Still more preferred examples include compounds represented by Formula [Y-1] described in JP-A 4-81847 on pg. 1 and pp. 11–17.

When an oil-in-water type emulsifying dispersion method is employed for adding couplers and other organic compounds employed in the photographic material of this invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be employed. After dispersion or during dispersion, a process to remove the low boiling solvent may be provided.

Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5–7.0 are also preferred. These high boiling solvents may be employed in combination.

Instead of or in combination with the high boiling solvent, employed is a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant employed for adjusting surface tension when dispersing or coating photographic composition, the preferable compounds are those containing a hydrophobic group having 8–30 carbon atoms and a sulfonic acid group or its salts in the molecule. Exemplary examples thereof include A-1-A-11 described in JP-A 64-26854. In addition, surfactants, in which a fluorine atom is substituted to an alkyl group, are also preferably employed. The dispersion is conventionally added to a coating composition containing a silver halide emulsion. The elapsed time from dispersion until addition to the coating composition and the time from addition to the coating composition until coating are preferably short. They are respectively preferable within 10 hours, more preferably within 3 hours and still more preferably within 20 minutes.

To each of the above-mentioned couplers, to prevent color fading of the formed dye image due to light, heat and humidity, an anti-fading agent may preferably be added singly or in combination. Specifically preferable compounds for the magenta dyes are phenyl ether type compounds represented by Formulas I and II in JP-A 2-66541, phenol type compounds represented by Formula IIIB described in JP-A 3-174150, amine type compounds represented by Formula A described in JP-A 64-90445 and metallic complexes represented by Formulas XII, XIII, XIV and XV described in JP-A 62-182741. Preferable compounds specifically for the yellow dyes and cyan dyes are compounds represented by Formula I' described in JP-A 1-196049 and compounds represented by Formula II described in JP-A 5-11417.

Compound (d-11) described in JP-A. 4-114154 on pg. 9, in the lower left column and Compound (A'-1) described in the same on pg. 10, in the lower left column are also employed for allowing the absorption wavelengths of the dye to shift. Further, other than these compounds, employed may also be the compounds capable of releasing a fluorescent dye described in U.S. Pat. No. 4,774,187.

In the photosensitive material, it is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A 4-133056, and compounds II-1–II-14 described in the above-mentioned specification pp. 13–14 and compound-1 described on pg. 17.

In the photographic material of this invention, it is preferable that static fogging is prevented and light-durability of the dye image is improved by adding a UV absorber. The preferable UV absorbent is benzotriazoles. The specifically preferable compounds are those represented by Formula III-3 in JP-A 1-250944, those represented by Formula III described in JP-A 64-66646, UV-1L–UV27L described in JP-A 63-187240, those represented by Formula I described in JP-A 4-1633 and those represented by Formulas (I) and (II) described in JP-A 5-165144.

Advantageously employed in the photographic materials used in this invention is gelatin as a binder. Further, appropriately employed may be other hydrophilic colloidal materials, such as gelatin derivatives, graft polymers of gelatin with other polymers, proteins other than gelatin, saccharide derivatives, cellulose derivatives and synthetic hydrophilic polymeric materials.

In the photosensitive material of this invention, the total gelatin volume in the constitution layers is preferably at least 3 g/m$^2$ and at most 6 g/m$^2$, but more preferably at least 3 g/m$^2$ and at most 5 g/m$^2$. Further, to satisfy progression of development, bleach-fixing capability and residual color even in ultra-rapid processing, the total thickness of the constitution layers is preferably 3–7.5 μm, but more preferably 3–6.5 μm. In the evaluation method of dry thickness, the thickness is determined by observation of thickness changes before and after peeling of the dried layer, or a cross section of the layers employing a high magnification optical microscope or an electron microscope. In this invention, to achieve a good balance between progression of development and an increased drying rate, the swelling thickness is preferably 8–19 μm, but more preferably 9–18 μm. The swelling thickness is determined by soaking the dried photosensitive material in 35° C. water and measuring the thickness employing a dotting method after the material sufficiently achieves aquilibrium. The silver coverage in this invention is preferably 0.3–0.6 g/m$^2$, but more preferably 0.3–0.5 g/m$^2$.

As a hardener of these binders, a vinylsulfone type hardening agent, a chlorotriazine type hardening agent, or an activated form of carboxyl group type hardening agent may preferably be employed, singly or in combination. Also, the compounds described in JP-A Nos. 61-249054 and 61-245153 are preferably employed. Further, an antiseptic component or antimold additive described in JP-A 3-157646 is preferably incorporated into a hydrophilic colloid layer to prevent propagation of bacteria and mold which adversely affect photographic characteristics and storage stability of images. A lubricant or a matting agent described in JP-A Nos. 6-118543 and 2-73250 is also preferably incorporated to improve surface physical properties of raw or processed photographic materials.

A variety of supports are employed in the photographic material used in this invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports, a paper support coated, on both sides, with water-proof resin layer.

As the water-proof resins, preferably employed are polyethylene, ethylene terephthalate and a copolymer thereof.

AS a white pigment employable in the support, inorganic and/or organic white pigments may be employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide.

The amount of the white pigments to be added to the water-proof resin layer on the support surface is preferably not less than 13% by weight, and more preferably not less than 15% by weight to improve sharpness.

The dispersion degree of a white pigment in the water-proof resin layer of paper support can be measured based on the procedures described in JP-A 2-28640. In this case, the dispersion degree, which is represented by a coefficient of variation, is preferably not more than 0.20, and more preferably not more than 0.15.

Supports having a center face roughness (SRa) of 0.15 μm or less (preferably, 0.12 μm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness.

The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention.

In coating of the photographic material, a thickening agent may be employed to enhance coatability of a coating composition. As a coating method, useful are extrusion coating and curtain coating, in which two or more layers are simultaneously coated.

In the case of a silver halide color photographic photosensitive material (hereinafter referred to simply as a photosensitive material), it is preferable that a difference ΔLog E (being: Log Ed−Log Ea) between an exposure amount (Log Ed) giving the maximum point γ (γmd) to the color image obtained through photographic processing after exposure with exposure time of $10^{-6}$ sec. per one pixel and an exposure amount (Log Ea) giving the maximum point γ (γma) to the respective color image obtained through photographic processing after exposure with exposure time of 0.5 sec. per one pixel is not more than 0.15.

Δ Log E mentioned in this invention shows that a difference (being a Δ Log E) of positions of exposure amount for the maximum point γ in the case where respective characteristic curves are superposed each other at the point of density 0.8 after giving exposures of $10^{-6}$ sec. and 0.5 sec. to respective dye-forming layers and conducting photographic processing, is not more than 0.15.

"Point γ" mentioned in this invention is defined by $$\text{Point } \gamma = dD/d \log E \quad (D \text{ represents density and } E \text{ represents an exposure amount})$$

as described on page 502 of the fourth edition of "The Theory of the Photographic Process" compiled by T. H. James, and it shows a differential value at an optional point on the characteristic curve (being a D−Log E curve) composed of the axis of ordinates representing density D and the axis of abscissas representing exposure amount, and the maximum point γ shows a point where the point γ is maximum.

The inventors of the invention found that Δ Log E in the case of superposition of characteristic curves at a point of density 0.8 is peculiarly important for forming a character image and a scene image beautifully, and found that images wherein reproducibility for character quality and for scene image is excellent can be obtained irrespective of exposure time of $10^{-6}$ sec. and 0.5 sec., when the Δ Log E is 0.15 or less, and that images wherein characters have no bleeding fringes can be obtained when ΔLog E is not more than 0.1, and especially preferable value is 0.07 or less.

In the silver halide color photographic photosensitive material of the invention, it is preferable that an effective gradation area (VE) of a color image obtained through color photographic processing after exposure with exposure time of $10^{-10}$ sec.–$10^{-3}$ sec. per one pixel is 0.77 or more and 0.96 or less on each image forming layer, and difference Δ between VE value on the image forming layer where VE is maximum and VE value on the image forming layer where VE is minimum is 0 or more and 0.10 or less.

When handling image information by digitalizing it, a general method is one wherein an original image is divided into small square forms, and density information of each square form is digitized to be handled. In the invention, a minimum unit in the case of handling an original image into square forms is made to be one pixel. Therefore, exposure time for one pixel is considered to be the time wherein the intensity of the light beam or the irradiation time is controlled based on digital data for one pixel.

The effective gradation area (VE) in the invention is defined to be an exposure amount area where a value of the point γ in the case of gray scale output is 1.0 or more. After intensive studies, the inventors found out that an influence on print image quality is great in the exposure area, and, in particular, an influence on bleeding fringes of character images and for easy appearance of scanning exposure streaks is great when processing time from exposure to development is changed.

In the invention, the effective gradation area (VE) of each color image forming layer is in a range of 0.77–0.96 preferably, and a range of 0.82–0.96 is more preferable, and a range of 0.84–0.96 is further preferable.

Further, difference ΔVE between VE value of a color image forming layer where VE is maximum and VE value of a color image forming layer where VE is minimum is in a range of 0–0.10 preferably, a range of 0–0.08 is more preferable, and a range of 0–0.06 is further preferable. When a value of ΔVE is small, balance for yellow, magenta and cyan images is maintained to be relatively excellent, thus, color bleeding on the contour of a character and generation of exposure scanning streaks on solid images are presumed to be reduced.

In the invention, it is possible to obtain an effect representing an object of the invention by satisfying required conditions prescribed in the invention under the exposure conditions wherein exposure time per one pixel is in a range of $10^{-10}$ sec.–$10^{-3}$ sec., and the following evaluation methods can be used preferably for clarifying the effect of the invention.

Namely, by using a laser scanning exposure apparatus that has been adjusted so that raster superposition of a light beam may be within a range of 5–30%, a photosensitive material is exposed to a patch which is 1 cm square while changing an exposure amount, in succession, and color developing for 45 sec. at 37±0.5° C. is conducted by using the following color developing solution (CDC-1) (incidentally, after color developing, ordinary bleach-fix and washing or stabilization process are carried out). Then, reflection density on the gray patch portion of the sample thus obtained is measured, then, a characteristic curve composed of the axis of abscissas representing an exposure amount (Log E) and the axis of ordinates representing reflection density is prepared, and a differential value of density for the exposure amount for each step can be calculated to obtain the point γ. Incidentally, in the invention, a period of time from an end of exposure to the start of developing is one hour.

(Color developing solution (CDC - 1))

| | |
|---|---|
| Pure water | 800 ml |
| Triethylene diamine | 2 g |
| Diethylene glycol | 10 g |
| Sodium bromide | 0.02 g |
| Sodium chloride | 4.5 g |
| Sodium sulfite | 0.25 g |
| N-ethyl-(β methanesulfon amide ethyl)-3-methyl-4-aminoaniline sulfate | 4.0 g |
| N,N-diethyl hydroxyl amine | 5.6 g |
| Triethanol amine | 10.0 g |
| Diethylenetriamine | |
| Dietylenetriaminepentaacetic acid.sodium salt | 2 g |
| Potassium carbonate | 30 g |

Water is added to make the total amount to be 1 liter, and pH is adjusted by potassium sulfate or potassium hydroxide to 10.1.

In the silver halide color photographic photosensitive material of the invention, it is preferable to form an image after exposure with exposure time of $10^{-6}$ sec. per one pixel, based on digital information, and when handling image information by digitizing it, a general method is one wherein an original image is divided into small square forms, and density information of each square form is digitized to be handled. This original image is handled by dividing into square forms, and a minimum unit of digitized exposure information is one pixel. Further, the exposure time for one pixel can be considered to be the time wherein the intensity of the light beam or the irradiation time is controlled based on digital data for one pixel. The exposure time for one pixel in the invention is preferably in a range of $10^{-3}$ sec.–$10^{-10}$ sec. and an effect of the invention is obtained by satisfying the required conditions of the invention under some exposure conditions within the range of exposure time.

In the invention, it is preferable that one color image is formed by an independent single exposure. An image forming by an independent single exposure mentioned in the invention means an exposure method wherein plural exposures are not given simultaneously for forming one color image, in other words, and it is an exposure method wherein plural light fluxes each giving an exposure of data of one pixel to a silver halide color photographic photosensitive material do not exist simultaneously.

A scanning exposure by means of a light beam used preferably for the invention is carried out generally by combination of a line exposure by means of a light beam (raster exposure: main scanning) and a relative movement of a photosensitive material in the direction perpendicular to that of the line exposure (sub-scanning). For example, a method of scanning used commonly includes a method (drum method) wherein a cylindrical drum on which a photosensitive material is fixed on an outer or inner circumferential surface of the drum is rotated while irradiating a light beam for the main scanning, and a light source is moved in the direction perpendicular to the direction of rotation of the drum for sub-scanning, and a method (polygon method) wherein a rotating polygon mirror is irradiated by a light beam for scanning (main scanning) by a reflected beam that is in parallel with a rotary plane of the polygon mirror, and a photosensitive material is conveyed in the direction perpendicular to the rotary plane of the polygon. In the drum method, the main scanning speed can be adjusted by adjusting a diameter of the drum and a rotating speed of the drum. In the polygon method, the main scanning speed can be adjusted by adjusting a size, the number of faces and a rotating speed of the polygon, and a sub-scanning speed can be adjusted by adjusting a speed of conveyance of a photosensitive material.

Overlapping of rasters for light beam can be controlled properly by adjusting timing for the aforesaid main scanning speed and sub-scanning speed. When an exposure head wherein light sources are arranged in a form of array is used, overlapping of rasters for light beam can be controlled by adjusting a distance between respective light sources properly.

As light sources usable in this invention, employed are those known in the art, including a light emission diode (LED), a gas laser, a semiconductor laser (LD), a combination of an LD or solid laser using LD as an exciting light source, and secondary harmonic generator element (so-called an SHG element), organic or inorganic EL elements, and commonly known vacuum fluorescent display tube. There are also preferably employed a combination of a halogen lamp and a PLZT element, DMD element or shutter element such as liquid crystal and a combination of a color filter.

With respect to the means to satisfy each required condition prescribed above, it is possible to attain by using a method to control properly the characteristics of photosensitive silver halide contained in photosensitive materials, for example, and a method to control properly types and an amount of addition for various photographic additives such as photosensitive silver halide and couplers to be coated, or inhibitors, independently or in combination.

In the invention, it is preferable to apply developing agents to photosensitive materials which are not contained in a photosensitive material, and to apply, in particular, to photosensitive materials used for forming an image to be appreciated directly. For example, there are given a color photographic paper, a color reversal paper, photosensitive materials for forming positive images, photosensitive materials for display and photosensitive materials for color proof. It is especially preferable to apply to a photosensitive material having a reflection support.

In the processing method for a silver halide color photographic photosensitive material of the invention, the silver halide color photographic photosensitive material which has been given exposure passes through a color processing process (color developer), then, a bleaching process (bleaching solution), a fixing process (fixing bath) or a bleach-fix process (bleach-fixing solution) and a stabilizing process (stabilizing solution), to be dried. Further, the silver halide color photographic photosensitive material can be subjected to photographic processing continuously, while replenishing color developer for replenishing, a bleaching solution for replenishing, a fixing bath for replenishing, or a bleach-fixing solution for replenishing and stabilizing solution for replenishing.

The preferable examples of the color developing agents employable in this invention include primary aromatic color developing agents known in the art, and specisically p-phenylenediamine derivatives. Representative examples are shown below, but this invention is not limited thereto.

1) N,N-diethyl-p-phenylendiamine,
2) 4-amino-3-methyl-N,N-diethylaniline,
3) 4-amino-N-2-amino-(β-hydroxyethyl)-N-methylaniline,
4) 4-amino-N-ethyl-N-(β-hydroxyethyl)-aniline,
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methanesulfoneamidoethyl)aniline
9) 4-amino-N,N-diethyl-3-(β-hydroxyethyl)aniline
10) 4-amino-3-methyl-N-ethyl-N-(β-methoxyethyl)aniline 2-methyl-4-(N-ethyl-N-(β-hydroxyethyl)amino)aniline,
11) 4-amino-3-methyl-N-(β-ethoxyethyl)-N-ethylaniline
12) 4-amino-3-methyl-N-(3-carbamoylpropyl)-N-n-propylaniline
13) 4-amino-N-(4-carbamoylbutyl)-N-n-propyl-3-methylaniline
14) N-(4-amino-3-methylphenyl)-3-hydroxypyrrolidine
15) N-(4-amino-3-methylphenyl)-3-(hydroxymethyl)hydroxypyrrolidine
16) N-(4-amino-3-methylphenyl)-3-pyrrolidinecarboxamine Among the above p-phenylenediamine derivatives, specifically preferable are exemplified compounds 5), 6), 7), 8) and 12), and of these, compounds 5) and 8) are preferred. Further, these p-phenylenediamine derivatives may be in the form of salt, such as a sulfate, a hydrochloride, a sulfite salt, a salt of naphthalenedisulfonic acid, or a salt of p-toluenesulfonic acid, or a free base type (also referred to as free body). The amount of the above primary aromatic color developing agents in the tank solution is preferably 2–200 mmol per L of developing solution, more preferably 6–100 mmol, and still more preferably 10–40 mmol.

In the color developing solution of this invention, it is preferable to contain a preserving agent to reduce a loss of the color developing agent by oxidization. Typical preserving agents include hydroxylamine derivatives. The hydroxylamine derivatives employable in this invention include hydroxylamine derivatives described, for example, in JP-A Nos. 1-97953, 1-186939, 1-186940, and 1-187557, in addition to hydroxylamine salts, such as hydroxylamine sulfate, and hydroxylamine hydrochloride. However, preferred are hydroxylamine derivatives represented by following Formula (A).

Formula (A)

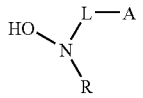

In above Formula (A), L is an alkylene group which may be substituted, A is a carboxyl group, a sulfo group, a phosphono group, a phosphine group, a hydroxyl group, an amino group which may be substituted with an alkyl group, ammonio group which may be substituted with an alkyl group, a carbamoyl group which may be substituted with an alkyl group, a sulfamoyl group which may be substituted with an alkyl group, an alkylsulfonyl group, a hydrogen atom, an alkoxyl group, or —O—(B—O)$_n$—R', R and R' are each a hydrogen atom, an alkyl group which may be substituted, B is an alkylene group which may be substituted, and n is an integer of 1–4.

In above Formula (A), L is preferably a straight or branched alkylene group of 1–10 carbon atoms which group may be substituted, and more preferably 1–5 carbon atoms. Specifically, listed as preferable examples are groups of methylene, ethylene, trimethylene, and propylene. As a substituted group, listed are a carboxyl group, a sulfo group, a fosfono group, a phosphine group, a hydroxyl group, and an ammonio group which may be substituted with an alkyl group, a carboxyl group, and more preferable examples are a carboxyl group, a sulfo group, a phosphine group and a hydroxyl group. A is a carboxyl group, a sulfo group, a phosphono group, a phosphine group, a hydroxyl group; or an amino group, an ammonio group, a carbamoyl group, and a sulfamoyl group, each of which may be substituted with an alkyl group; and preferable examples are a carboxyl group, a sulfo group, a hydroxyl group, and an carbamoyl group which may be substituted with an alkyl group. Preferable examples of -L-A- include a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group, and specifically preferable examples include a carboxymethyl group, a carboxyethyl group, a sulfoethyl group, a sulfopropyl group, a phosphonomethyl group and a phosphonoethyl group. R is preferably a hydrogen atom, or a straight or branched alkyl group of 1–10 carbon atoms which group may be substituted, and specifically, preferably is 1–5 carbon atoms. The subsituent groups incude a carboxyl group, a sulfo group, a phosphono group, a phosphinic acid group, a hydroxyl group; or an amino group, an ammonio group, a carbamoyl group, a sulfamoyl group, an alkoxyyl group, —O—(B—O)$_n$—R', each group of which may be substituted with an alkyl group. Herein, B and R' are the same as those described in foregoing A. The substituent groups may be more than two. Preferable examples of R include a hydrogen atom, a carboxymethyl group, a carboxyethyl group, a carboxypropyl group, a sulfoethyl group, a sulfopropyl group, a sulfobutyl group, a sulfonometyl group, a phosphonoethyl group, and a hydroxuethyl group, and specifically preferable examples include a hydrogen atom, a carboxymethyl group, a carboxyethyl group, a sulfoethyl group, a sulfopropyl group, a phosphonomethyl group, and a phosphonoethyl group. L and R may connect to form a ring.

Typical examples of compounds represented by Formula (A) are shown below, but this invention is not limited to these examples.

(A-1)

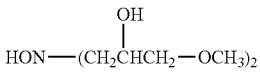

(A-2)

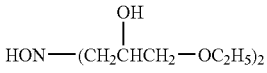

(A-3)

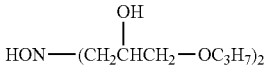

(A-4)

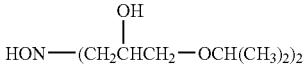

(A-5)

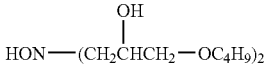

(A-6)

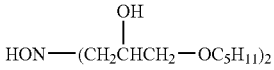

(A-7)

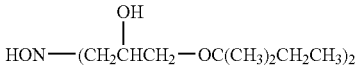

-continued (A-8)

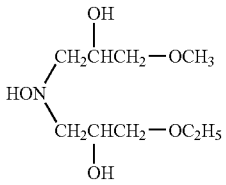

(A-9)

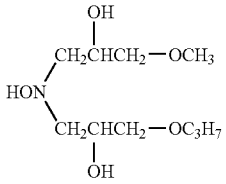

(A-10)

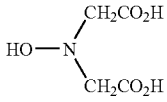

(A-11)

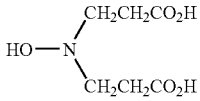

(A-12)

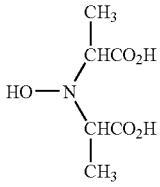

(A-13)

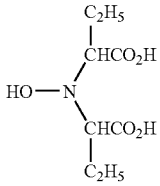

(A-14)

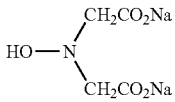

(A-15)

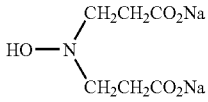

(A-16)

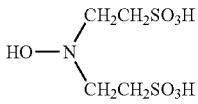

(A-17)

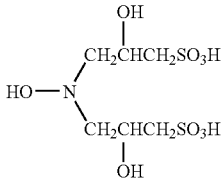

-continued (A-18)

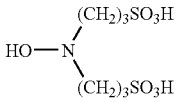

(A-19)

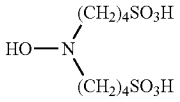

(A-20)

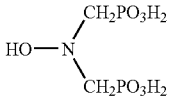

(A-21)

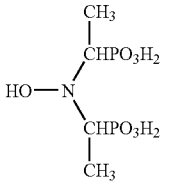

(A-22)

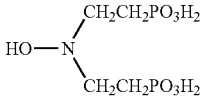

(A-23)

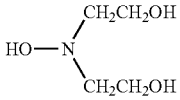

(A-24)

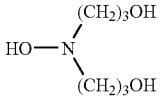

(A-25)

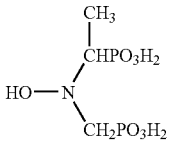

(A-26)

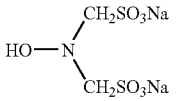

(A-27)

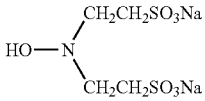

(A-28)

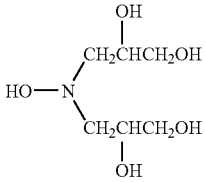

-continued (A-29)

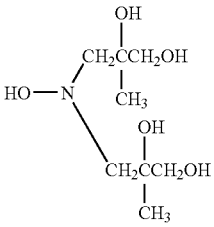

(A-30)

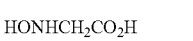

(A-31)

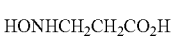

(A-32)

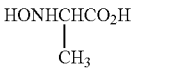

(A-33)

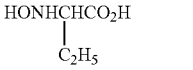

(A-34)

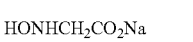

(A-35)

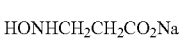

(A-36)

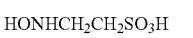

(A-37)

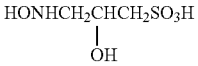

(A-38)

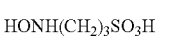

(A-39)

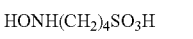

(A-40)

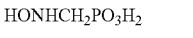

(A-41)

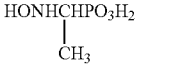

(A-42)

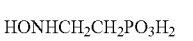

(A-43)

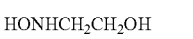

(A-44)

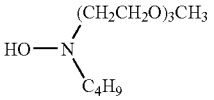

(A-45)

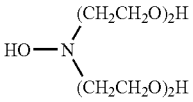

Further, it is also preferable to use sulfite as a preserver, and its concentration is preferably 0.005–1.0 mol/L in color developer for a color negative film, and a range of 0–0.1 mol/L is preferable in color developer for a color photographic paper. As sulfite used that can be used in the invention, there are given, for example, sodium sulfite, potassium sulfite and ammonium sulfite.

There is nothing restricting a use of preservers shown below in the color developer, in addition to the preservers of this invention explained above. Hydroxamic acids, hydrazides, phenols, α-hydroxyketones, α-aminoketones, saccarides, monoamines, diamines, polyamines, quaternary ammonium salts, nitroxyradicals, alcohols, oximes, diamide compounds and condensed-ring amines can be listed. These are disclosed in official reports or specifications including JP-A Nos. 63-4235, 63-30845, 63-21647, 63-44655, 63-53551, 63-43140, 63-56654, 63-58346, 63-43138, 63-146041, 63-44657, and 63-44656, and U.S. Pat. Nos. 3,615,503 and 2,494,903, and JP-A 52-143020 and JP-B 4830496.

In addition to these, various types of metals described in JP-A Nos. 57-44148 and 57-53749, salicylic acids described in JP-A 59-180588, alkanol amines described in JP-A 54-3532 such as triethanol amine and triisopropanol amine and aromatic polyhydroxy compounds described in U.S. Pat. No. 3,746,544 can be contained in case of need.

A color developer used in this invention is preferably in the range of 9.0–13.5 in terms of a pH value, and the range of 9.5–12.0 is further preferable, and alkaline agents, buffer agents and acids, if necessary, can be contained.

When adjusting a color photographic processing solution, it is preferable to use buffer agents shown below, from the viewpoint of keeping the aforesaid pH. The buffer agents which can be used include carbonates, phosphates, borates, tetraborates, hydroxybenzoic acide salts, glycyl salts, N,N-dimethyl glycine salts, leucine salts, nolleusine salts, guanine salts, 3,4-dihydroxyphenylalanine salts, alanine salts, aminobutylic acid salts, 2-amino-2-methyl-1,3-propanediol salts, valine salts, proline salts, trishydroxyaminomethane salts, and lysine salts. In particular, carbonates, phosphates, tetraborates and hydroxybenzoic acide salts are excellent in terms of buffering capability in the high pH area where pH is 10 or higher, and they are preferable buffering agents from the viewpoint that they do not have a bad influence (photographic fog or the like) on a photographic ability surface even when they are added to a color developer, and they are inexpensive.

As an exemplified compound of the aforesaid buffering agent, there may be given sodium carbonate, potassium carbonate, sodium bicarbonate, potassium bicarbonate, trisodium phosphate, sodium diphosphate, potassium diphosphate, sodium borate, potassium borate, sodium tetraborate (being borax), potassium tetraborate, o-hydroxybenzoic acid sodium (being sodium salicylate), o-hydroxybenzoic acid potassium, 5-sulfo-2-hydroxybenzoic acid sodium (being 5-sodium sulfosalicylate) and 5-sulfo-2-hydroxybenzoic acid potassium (being 5-potassium sulfosalicylate). However, this invention is not limited to these compounds.

These buffering agents in the range of 0.01–2 mol per one liter of color developer are preferable, but more preferably in the range of 0.1–0.5 mol.

Precipitation preventing agents for calcium and magnesium and various chelating agents which also serve as stability improving agents, for example, can be added to the color developer used in the invention, as other components. For example, there are given nitrilotriacetic acid, diethylinetriaminepentaacetic acid, ethylenediamine tetraacetic acid, N,N,N-trimethylene phosphonic acid, ethylenediamine-N,N,N',N'-tetramethylene sulfonic acide, trans-cyclohexane diaminetetraacetic acid, 1,2-diaminopropane tetraacetic acid, glycoletherdiamine tetraacetic acid, ethylenediamineoltho hydroxyphenylacetic acid, (SS)-ethylenediamine disaccinic acid, N-(2-carboxylatoethyl)-L-aspartic acid, β-aranine diacetic acid, 2-phosphono butane-1,2,4-tricarboxylic acid, 1-hydroxyethylidene-1,1-diphosphonic acid, N,N'-bis (2-hydroxybenzyl) ethylenediamine-N,N'-diacetic acid, 1,2-hydroxybenzene-4,6-disulfonic acid. These chelating agents may also be used in combination of two or more types, if necessary. An amount of these chelating agents has only to be an amount which is sufficient to sequester metal ions in color photographic processing. For example, the chelating agent is added so that its amount may become about 0.1–10 g per one liter of developer.

Optional development accelerator can also be added to the color developer used in the invention, as occasion demands. Development accelerators which can be added in case of need include neoether-based compound disclosed in official reports or specifications such as JP-B Nos. 37-16088, 37-5987, 38-7826, 44-12380, 45-9019 and U.S. Pat. No. 3,813,247, p-phenylenediamine-based compounds disclosed in JP-A Nos. 52-49829 and 50-15554, quaternary ammonium salt disclosed in JP-A 50-137726, JP-B 44-30074, and JP-A Nos. 56-156826 and 52-43429, amine-based compound disclosed in respective official reports or specifications such as U.S. Pat. Nos. 2,494,903, 3,128,182, 4,230,796 and 3,253,919, JP-B 41-11431, U.S. Pat. Nos. 2,482,546, 2,596,926 and 3,582,346, polyalkylene oxide disclosed in respective official reports or specifications such as JP-B Nos. 37-16088, 42-25201, U.S. Pat. No. 3,128,183, JP-B Nos. 41-11431 and 42-23883 and U.S. Pat. No. 3,532,501, 1-phenyl-3-pyrazolidons or imidazoles. Concentrations of the aforesaid development accelerators which are in the range of 0.001–0.2-mol per liter of color developer are preferable, but the range of 0.01–0.05 mol is more preferable.

In addition to a halogen ion, optional antifogging agents can be added to the color developer as occasion demands. For example, nitrogen-containing heterocyclic compounds such as benzotriazole, 6-nitrobenzimidazole, 5-nitroisoindazole, 5-methylbenztriazole, 5-netrobenztriazole, 5-chlorobenztriazole, 2-thiazolyl-benzimidazol, 2-thiazolylmethyl-benzimidazole, indazole, hydroxyazaindolizine and adenine can be given as an organic antifogging agent.

An optical brightening agent can further be used for the color developer used in this invention, if necessary. Bis (triazinylamino) stilbene sulfonic acid compounds are preferable as an optional antifogging agent. As bis (triazinylamino) stilbene sulfonic acid compound, it is possible to use diaminostilbene type brightening agent which is commonly known or is available on the market. As known bis (triazinylamino) stilbene sulfonic acid compound, compounds described in JP-A Nos. 6-329936, 7-140625 and 10-140849, for example, are preferable. Compounds on the market are described on pages 165–168 of the ninth edition of "Dyeing Note", Shikisensha Co. Ltd., for example, and Blankophor BSU liq. and Hakkol BRK among them are preferable.

Further, as another bis (triazinylamino) stilbene sulfonic acid compound, compounds I-114 I-48 described in paragraph numbers (0038)–(0049) in JP-A 2001-281823 and compounds II-1–II-16 described in paragraph numbers (0050)–(0052) in JP-A 2001-281823 can also be given. As an amount of the optical brightening agent mentioned above, a range of 0.1 milli-mol–0.1 mol per one liter of color developer is preferable.

When a bromine ion is contained in a photographic processing solution for a color photographic paper, $1.0\times10^{-3}$ mol/liter or less is preferable. Though it is preferable that chlorine is contained in a photographic processing solution for a color photographic paper at a rate of $3.5\times10^{-2}$–$1.5\times10^{-1}$ mol/liter, it is sometimes unnecessary to add it to a replenisher because it is discharged into a developing solution as a by-product in ordinary developing.

With respect to a processing temperature for color developing that can be applied in a processing method in the invention, a range of 30–55° C. is preferable when a silver halide color photographic photosensitive material is a color photographic paper, and more preferable is 35–55° C., while, further preferable is 38–45° C. A color developing time of 5–90 sec. is preferable, and that of 15–60 sec. is more preferable. Though a replenishing amount which is small is preferable, an appropriate amount is 15–600 ml per 1 $m^2$ of photosensitive material, and an amount of 15–120 ml is preferable, while, that of 30–60 ml is especially preferable. Incidentally, a color developing time mentioned in the invention means a period of time from the moment when the photosensitive material enters a color developing solution to the moment when the photosensitive material enters the following processing step (e.g., bleach-fixer). When processing in an automatic processor, the color developing time is the total time including the time during which the photosensitive material is dipped in a color developing solution (so-called wet time) and the time during which the photosensitive material is conveyed through the outside of the solution toward the following processing step after leaving the color developing solution (so-called crossover time). The crossover time that is 10 sec. or less is preferable, and 5 sec. or less is more preferable.

In the invention, as a beaching agent to be used in a bleaching solution or in a beach-fixer, any beaching agent can be used, and especially, organic complex salt of iron (III) (for example, aminopoly carboxylic acid such as ethylenediaminetetra acetic acid, diethylenetriaminepenta acetic acid, nitrilotriacetic acid, cyclohexanediamine tetraacetic acid and ethylenediaminedisuccinic acid, and complex salt such as aminopoly phosphonic acid, phosphonocarboxylic acid and organic phosphonic acid) or an organic acid such as citric acid, tartaric acid and malic acid, a persulfate and hydrogen peroxide are preferable.

Of these, an iron (III) complex salt of ethylenediaminetetraacetic acid, diethylenstriaminepentaacetic acid, cyclohexanediamine tetraacetic acid, 1,3-diaminopropane tetraacetic acid, ethylenediaminedisuccinic acid and methylimino diacetic acid is preferable because its bleaching power is high. These ferric ion complex salts may be used in a form of a complex, or ferric salt, for example, ferric sulfate, ferric chloride, ferric nitrate, ferric sulfate ammonium or ferric phosphate may be used together with chelating agents such as aminopolycarbonic acid, aminopolyphosphonic acid and phosphono carbonic acid to form ferric ion complex salt in the solution. Further, chelating agents may be used to exceed an amount needed for forming a ferric ion complex salt. Among iron complexes, aminopolycarbonic acid iron complex is preferable and an amount of addition thereof is preferably 0.01–1.0 mol/liter, but more preferable is 0.05–0.50 mol/liter.

Various compounds may be used as a beach accelerator for a beaching solution or a beach-fixer. For example, compounds having a mercapto group or disulfide linkage, thiourea-based compounds or halides of iodine ion or bromine ion, all described in Research Disclosure 17129 (published in July, 1978) are excellent in bleaching power and are preferable.

Besides, rehalogenation agents such as a bromide (e.g., potassium bromide), a chloride (e.g., potassium chloride) or an iodide (e.g., ammonium iodide) can be contained in a bleaching solution or in a beach-fixer. In the case of need, one or more types of inorganic acid or organic acid having pH buffering power such borax, sodium metaborate, acetic acid, sodium acetate, sodium carbonate, potassium carbonate, citric acid, sodium citrate, tartaric acid, succinic acid, maleic acid and glycolic acid, and a corrosion inhibitor such as alkali metal, ammonium salt, or ammonium nitrate and guanidine can be added.

Fixing agents used in a fixing solution or in a beach-fixer are known fixing agents, namely, water soluble silver halide dissolving agents such as a thiosulfate like sodium thiosulfate and ammonium thiosulfate, a thiocyanate such as sodium thiocyanate and ammonium thiocyanate, thioether compounds such as ethylenebisglycolic acid, 3,6-dithia-1 and 8-octanediole, and thiourea, and these can be used independently or in combination of two kinds or more. In the invention, a use of thiosulfuric acid ammonium thiosulfate salt is preferable. An amount of fixing agents per one liter is preferably 0.1–5.0 mol, and more preferable is a range of 0.3–2.0 mol. An area of pH of the beach-fixer or of the fixing solution is preferably 3–10, and a range of 5–9 is especially preferable.

It is further possible to cause a beaching solution, a fixing solution and a beach-fixer to contain other various types of optical brightening agents, defoaming agents, or surface active agents and an organic solvent such as polyvinylpyrrolidone or methanol.

To a bleaching solution, a fixing solution and a bleach-fixer, there are added generally sulfites such as, for example, sodium sulfate, potassium sulfate, ammonium sulfate, potassium bisulfite, sodium bisulfite, sodium metabisulfite, potassium metabisulfite and ammonium metabisulfite, as preserving agents, and in addition, ascorbic acid and calbonyl adduct bisulfite or carbonyl compounds may also be added.

Further, buffering agents, optical brightening agents, chelating agents, defoaming agents and anti-mold agents may be added when necessary. Further, ammonium cation concentration in each of a bleaching solution, a fixing solution and a bleach-fixer is preferably 50 mol % or less for the total cation, from the viewpoint of workability, but it is preferably 50 mol % or more for the total cation, from the viewpoint of processability.

Further, it is preferable that the time required for the beach-fixing process capable of being applied to the processing method of a silver halide color photographic photosensitive material of the invention is 90 sec. or less, and 45 sec. or less is more preferable. The time required for the beach-fixing process mentioned here means a period of time from the moment when a photosensitive material is dipped in the first tank to the moment when the photosensitive material leaves the last tank when a plurality of tanks are used in the process, while, it means the time to the moment when a photosensitive material is dipped in a following rinsing or stabilizing solution, when a single tank is used in the process, and the crossover time between them is to be included. The crossover time of 10 sec. or less is preferable, and more preferable is 5 sec. or less. The temperature of a bleach-fixer that is 20–70° C. is preferable, and desirable temperature is 25–50° C. An amount of replenishing bleach-fixer that is 200 ml/$m^2$ or less is preferable, and more preferable is 20–100 ml/$m^2$.

An amount of replenishing of bleaching solution that is 200 ml/$m^2$ or less is preferable, and more preferable is 50–200 ml/$m^2$. It is further preferable that the total processing time for bleaching process is 15–90 sec. The time required for the bleaching process mentioned here means a period of time from the moment when a photosensitive material is dipped in the first tank to the moment when the photosensitive material leaves the last tank when a plurality of tanks are used in the process, while, it means the time to the moment when a photosensitive material is dipped in a following rinsing or stabilizing solution, when a single tank is used in the process, and the crossover time between them is to be included. The crossover time of 10 sec. or less is preferable, and more preferable is 5 sec. or less. The processing temperature that is 25–50° C. is preferable. An amount of replenishing fixing solution that is 600 ml/$m^2$ or less is preferable, and more preferable is 20–500 ml/$m^2$. Further, it is preferable that the total processing time for fixing process is 15–90 sec. The time required for the fixing process mentioned here means a period of time from the moment when a photosensitive material is dipped in the first tank to the moment when the photosensitive material leaves the last tank when a plurality of tanks are used in the process, while, it means the time to the moment when a photosensitive material is dipped in a following rinsing or stabilizing solution, when a single tank is used in the process, and the crossover time between them is to be included. The crossover time of 10 sec. or less is preferable, and more preferable is 5 sec. or less. The processing temperature that is 25–50° C. is preferable.

Next, a rinsing process or a stabilizing process and a processing solution used in the aforesaid process will be explained.

A rinsing solution or a stabilizing solution used in the stabilizing process can contain properly the components which are usually contained in a stabilizing solution such as chelating agents (such as ethylenediaminetetraacetic acid, diethylenetriaminepentaacetic acid, 1-hydroxyethylidene-1, 1-diphosphonic acid), buffering agents (such as potassium carbonate, a borate, acetate and phosphate), anti-mold agents, p-chloro-m-cresol, benzoisothiazoline-3-on), optical brightening agents (triazinylstylbene type compound), antioxidants (ascorbate), and water-soluble metal salts (zinc salt, magnesium salt).

In the rinsing solution or the stabilizing solution, arylsulfinic acid such as p-toluenesulphinic acid and m-carboxy benzenesulfinic acid may be contained, from the viewpoint of solution preservability, and it is preferable to cause sulfite, bisulfite or metabisulfite to be contained. Any substance may be contained independently of organic one and inorganic one if the substance emits sulfite ion, and a preferable one is an inorganic salt. As a preferable specific compound, there are given sodium sulfite, potassium sulfite, ammonium sulfite, ammonium bisulfite, potassium bisulfite, sodium bisulfite, sodium metabisulfite, potassium sodium metabisulfite and ammonium metabisulfite. It is preferable to add an amount of these salts bringing at least $1\times10^{-3}$ mol/L or more in the stabilizing solution, and more preferable is to add so that $5\times10^{-3}$ mol/L–$5\times10^{-2}$ mol/L may be brought.

Preferable pH for the stabilizing process is in a range of 4–10, and further preferable is 5–8.

A temperature of the stabilizing process can be established variously depending on purposes of a use and characteristics of a silver halide color photographic photosensitive material to be processed, and its preferable range is generally 15–45° C., and more preferable is 20–40° C. Though a period of time can be established optionally, a shorter period of time is preferable from the viewpoint of a reduction of processing time. Though a preferable period of time is 5 sec.–1 min. and 45 sec., and more preferable is 10 sec.–1 min., when a silver halide color photographic photosensitive material is a color photographic paper, it is preferable that the time required for the stabilizing process is 8–26 sec., while, when a silver halide color photographic photosensitive material is a color negative film, it is preferable that the time required for the stabilizing process is 10–40 sec.

A smaller amount of replenishment is preferable from a viewpoint of running cost, a reduction of an amount of a discharge and handling characteristics.

A specific preferable amount of replenishment is one that is 0.5–50 times an amount of carry-in from the preceding bath per a unit area of a silver halide color photographic photosensitive material, and more preferable is 3–40 times. Or, an amount of one liter or less per 1 $m^2$ of a silver halide color photographic photosensitive material, and more preferable is 500 ml or less. Further, it is possible to replenish either continuously or intermittently.

In the processing method relating to the invention, the structure of the stabilizing process employing a stabilizing solution may either be composed of a single tank or be composed of two or more tanks, and a preferable one is a system of countercurrent flow with multiple stage that is composed of two or more tanks.

The system of countercurrent flow with multiple stages is a system wherein a stabilizing solution flows, for stabilizing, along a conveyance path for a silver halide color photographic material from a downstream side to an upstream side in the conveyance direction for a photosensitive material while overflowing to each divided stabilizing tank in multiple stages, in the stabilizing tank that is divided into plural sections.

As an image processing apparatus used for processing of a photosensitive material of this invention, it may be of either a roller transport type to convey a photosensitive material that is held between rollers arranged in a processing tank, or of an endless belt system to convey a photosensitive material by fixing it on a belt, and a system wherein each processing tank is formed to be in a slit form and a photosensitive material is conveyed while a processing solution is supplied to the processing tank, a spray system wherein a processing solution is made to be in a spray form, a web system by means of contact with a carrier holding a processing solution and a system by means of a viscous processing solution may also be used. When processing a large number of photosensitive materials, it is normal to conduct running processing by using an automatic processor. In this case, a smaller amount of replenishment of a replenisher is more preferable, and most preferable processing form from a viewpoint of environmental fitness is to add processing agents in a tablet form, as a replenishing method, and the method disclosed by Journal of Technical Disclosure 94-16935 is most preferable.

In a silver halide color photographic photosensitive material of the invention, when forming images thereon by giving exposure through a negative film on which an area of one image area is 3–7 $cm^2$, a level of improvement of image quality by a photosensitive material of the invention is especially high, which is preferable. The negative film mentioned above may also be one having an image recording capability.

EXAMPLE

This invention will be described specifically as follows, referring to examples to which, however, this invention is not limited.

Example 1

Preparation of Silver Halide Emulsion

The following method was used for preparing a silver halide emulsion.

Preparation of Silver Halide Emulsion (B-1)

(A1 solution) and (B1 solution) shown below were added simultaneously through a double-jet precipitation method by controlling to pAg of 7.3 and pH of 3.0 by spending 13 minutes, while stirring hard 1.5 liters of 2% aqueous solution of amphoterically deionized ossein gelatin (having a calcium content of 10 ppm) maintained at 40° C., by using a mixing and stirring machine described in JP-A 62-160128, after which following (A2 solution) and (B2 solution) were added simultaneously by controlling to pAg of 8.0 and pH of 5.5 by spending 90 minutes. After that, following (A3 solution) and (B3 solution) were added simultaneously by controlling to pAg of 8.0 and pH of 5.5 by spending 15 minutes. In this case, pAg was controlled by the method described in JP-A 59-45437, and pH was controlled by using sulfuric acid or sodium hydroxide.

(A1 Solution)

| | |
|---|---|
| Sodium chloride | 3.43 g |
| Potassium bromide | 0.021 g |
| Water | to make 200 ml |

(A2 Solution)

| | |
|---|---|
| Sodium chloride | 72.0 g |
| $K_2[IrCl_6]$ | $1.8 \times 10^{-8}$ mol/mol AgX |
| $K_2[IrBr_6]$ | $3.0 \times 10^{-9}$ mol/mol AgX |
| $K_4[Fe(CN)_6]$ | $3.0 \times 10^{-6}$ mol/mol A |
| Potassium bromide | 0.44 g |
| Water | to make 420 ml |

(A3 Solution)

| | |
|---|---|
| Sodium chloride | 30.7 g |
| Potassium bromide | 0.63 g |
| Water | to make 180 ml |

(B1 Solution)

| | |
|---|---|
| Silver nitrate | 10 g |
| Water | to make 200 ml |

(B2 Solution)

| | |
|---|---|
| Silver nitrate | 210 g |
| Water | to make 420 ml |

(B3 Solution)

| | |
|---|---|
| Silver nitrate | 90 g |
| Water | to make 180 ml |

After completion of addition, 15% aqueous solution containing 30 g of chemically modified gelatin (at modification rate of 95%) obtained by phenyl-carbamoylating an amino group by using a method described in JP-A 5-72658 was added for desalting, and then, is mixed with gelatin solution to prepare Silver Halide Emulsion (B-1) having an average grain diameter of 0.58 μm.

Preparation of Silver Halide Emulsion (B-2)

Silver Halide Emulsion (B-2) was prepared in the same manner as in the preparation of Silver Halide Emulsion (B-1), except that (A2 solution) was replaced with the following (A2a solution).

(A2a Solution)

| | |
|---|---|
| Sodium chloride | 72.0 g |
| $K_2[IrCl_6]$ | $1.0 \times 10^{-8}$ mol/mol AgX |
| $K_2[IrBr_6]$ | $1.5 \times 10^{-9}$ mol/mol AgX |
| $K_2[IrCl_5(thia)]$ | $5.0 \times 10^{-8}$ mol/mol AgX |
| $K_2[IrCl_5(H_2O)]$ | $1.5 \times 10^{-7}$ mol/mol AgX |
| $K_4[Fe(CN)_6]$ | $3.0 \times 10^{-6}$ mol/mol AgX |
| Potassium bromide | 0.44 g |
| Water | to make 420 ml |

Preparation of Silver Halide Emulsion (B-3)

Silver Halide Emulsion (B-3) was prepared in the same manner as in the preparation of Silver Halide Emulsion (B-1), except that (A2 solution) was replaced by the following (A2b solution), and addition of (B2 solution) and (A2b solution) was stopped when 70% of addition of (B2 solution) was completed, then, (E1 solution) was added from the nozzle provided in the vicinity of an addition nozzle for (A2c solution), and then, addition of (B2 solution) and (A2b solution) was started again.

(A2b Solution)

| | |
|---|---|
| Sodium chloride | 72.0 g |
| $K_2[IrCl_6]$ | $1.0 \times 10^{-8}$ mol/mol AgX |
| $K_2[IrBr_6]$ | $1.0 \times 10^{-9}$ mol/mol AgX |
| $K_4[Fe(CN)_6]$ | $3.5 \times 10^{-6}$ mol/mol AgX |
| Potassium bromide | 0.44 g |
| Water | to make 420 ml |

(E1 Solution)

| | |
|---|---|
| $K_2[IrCl_5\ (H_2O)]$ | $4.0 \times 10^{-7}$ mol/mol AgX |
| Water | to make 30 ml |

Preparation of Silver Halide Emulsion (B-4)

Silver Halide Emulsion (B-4) was prepared in the same manner as Silver Halide Emulsion (B-1), except that (A2 solution) was replaced with following (A2c solution), and addition of (B2 solution) and (A2c solution) was stopped when 70% of addition of (B2 solution) was completed, then, (E2 solution) was added from the nozzle provided in the vicinity of an addition nozzle for (A2c solution), and then, addition of (B2 solution) and (A2c solution) was started again.

(A2c Solution)

| | |
|---|---|
| Sodium chloride | 72.0 g |
| $K_2[IrCl_6])$ | $5.0 \times 10^{-9}$ mol/mol AgX |
| $K_2[IrBr_6]$ | $1.0 \times 10^{-9}$ mol/mol AgX |
| $K_4[Fe(CN)_6]$ | $3.5 \times 10^{-6}$ mol/mol AgX |
| Potassium bromide | 0.44 g |
| Water | to make 420 ml |

(E2 Solution)

| | |
|---|---|
| $K_2[IrCl_5(H_2O)]$ | $4.5 \times 10^{-7}$ mol/mol AgX |
| $K_2[IrCl_5(thia)]$ | $1.5 \times 10^{-7}$ mol/mol AgX |
| Water | to make 30 ml |

Preparation of Silver Halide Emulsion (B-5)

Silver Halide Emulsion (B-5) was prepared in the same manner as Silver Halide Emulsion (B-1), except that (A2 solution) and (A3 solution) were replaced respectively with following (A2d solution) and (A3a solution), and addition of (B2 solution) and (A2d solution) was stopped when 70% of addition of (B2 solution) was completed, then, (E3 solution) was added from the nozzle provided in the vicinity of an addition nozzle for (A2d solution), and then, addition of (B2 solution) and (A2d solution) was started again.

(A2d Solution)

| | |
|---|---|
| Sodium chloride | 72.0 g |
| $K_2[IrCl_6]$ | $2.0 \times 10^{-9}$ mol/mol AgX |
| $K_2[IrBr_6]$ | $1.0 \times 10^{-9}$ mol/mol AgX |
| $K_4[Fe(CN)_6]$ | $4.0 \times 10^{-6}$ mol/mol AgX |
| Exemplified compound S-2-5 | $2.6 \times 10^{-5}$ mol/mol AgX |
| Potassium bromide | 0.44 g |
| Water | to make 420 ml |

(A3a Solution)

| | |
|---|---|
| Sodium chloride | 30.7 g |
| Potassium bromide | 0.63 g |
| Exemplified compound S-2-5 | $2.4 \times 10^{-6}$ mol/mol AgX |
| Water | to make 180 ml |

(E3 Solution)

| | |
|---|---|
| $K_2[IrCl_5(H_2O)]$ | $1.1 \times 10^{-6}$ mol/mol AgX |
| $K_2[IrCl_5(thia)]$ | $1.0 \times 10^{-7}$ mol/mol AgX |
| Water | to make 40 ml |

Preparation of Silver Halide Emulsion (B-6)

Silver Halide Emulsion (B-6) was prepared in the same manner as Silver Halide Emulsion (B-5), except that following (C1 solution) was added from the nozzle provided in the vicinity of the adding nozzle for (A2d solution) at the moment when 20% of (B3 solution) was added.

(C1 Solution)

| | |
|---|---|
| Potassium bromide | 4.34 g |
| Water | to make 364 ml |

Preparation of Silver Halide Emulsion (B-7)

Silver Halide Emulsion (B-7) was prepared in the same manner as Silver Halide Emulsion (B-6), except that following (D1 solution) was added from the nozzle provided in the vicinity of the adding nozzle for (A2d solution) at the moment when 70% of (B3 solution) was added.

(D1 Solution)

| | |
|---|---|
| Potassium iodide | 0.15 g |
| Water | to make 36 ml |

Preparation of Silver Halide Emulsion (B-8)

Silver Halide Emulsion (B-8) was prepared in the same manner as Silver Halide Emulsion (B-7), except that addition of (B3 solution) and (A3a solution) was stopped when 95% of addition of (B3 solution) was completed, then, (F1 solution) was added from the nozzle provided in the vicinity of an adding nozzle for (A3a solution), and then, addition of (B3 solution) and (A3a solution) was started again.

(F1 Solution)

| | |
|---|---|
| $K_2[IrCl_5(H_2O)]$ | $4.0 \times 10^{-8}$ mol/mol AgX |
| Water | to make 20 ml |

Preparation of Silver Halide Emulsion (B-9)

Silver Halide Emulsion (B-9) was prepared in the same manner as Silver Halide Emulsion (B-7), except that addition of (B3 solution) and (A3a solution) was stopped when 95% of addition of (B3 solution) was completed, then, (F2 solution) was added from the nozzle provided in the vicinity of an adding nozzle for (A3a solution), and then, addition of (B3 solution) and (A3a solution) was started again.

(F2 Solution)

| | |
|---|---|
| $K_2[IrCl_5(H_2O)]$ | $1.0 \times 10^{-7}$ mol/mol AgX |
| Water | to make 20 ml |

Preparation of Silver Halide Emulsions (BB-1)–(BB-9)

Silver Halide Emulsions (BB-1)–(BB-9) each having an average grain diameter of 0.48 μm were prepared in the same manner as in the preparation of Silver Halide Emulsions (B-1)–(B-9), except that each amount for $K_2[IrCl_6]$, $K_2[IrBr_6]$, $K_2[IrCl_5(thia)]$, $K_2[IrCl_5(H_2O)]$ and $K_4[Fe(CN)_6]$ respectively in (A2 solution), (A2a solution), (A2b solution), (A2c solution), (A2d solution), (E1 solution), (E2 solution), (E3 solution), (F1 solution) and (F2 solution) was changed to be an amount that is 1.8 times the original amount, and time for adding each of (A1 solution), (A2 solution), (A2a solution), (A2b solution), (A2c solution), (A2d solution), (A3 solution), (A3a solution), (B1 solution), (B2 solution) and (B3 solution) was changed properly.

Preparation of Silver Halide Emulsions (G-1)–(G-9)

Silver Halide Emulsions (G-1)–(G-9) each having an average grain diameter of 0.50 μm were prepared in the same manner as Silver Halide Emulsions (B-1)–(B-9), except that each amount for $K_2[IrCl_6]$, $K_2[IrBr_6]$, $K_2[IrCl_5(thia)]$, $K_2[IrCl_5(H_2O)]$ and $K_4[Fe(CN)_6]$ respectively in (A2 solution), (A2a solution), (A2b solution), (A2c solution), (A2d solution), (E1 solution), (E2 solution), (E3 solution), (F1 solution) and (F2 solution) was changed to be an amount that is 1.7 times the original amount, and time for adding each of (A1 solution), (A2 solution), (A2a solution), (A2b solution), (A2c solution), (A2d solution), (A3 solution), (A3a solution), (B1 solution), (B2 solution) and (B3 solution) was changed properly.

Preparation of Silver Halide Emulsions (GG-1)–(GG-9)

Silver Halide Emulsions (GG-1)–(GG-9) each having an average grain diameter of 0.42 μm were prepared in the same manner as Silver Halide Emulsions (B-1)–(B-9), except that each amount for $K_2$ ([$IrCl_6$]), $K_2$[$IrBr_6$], $K_2$[$IrCl_5$(thia)], $K_2$[$IrCl_5(H_2O)$] and $K_4$[$Fe(CN)_6$] respectively in (A2 solution), (A2a solution), (A2b solution), (A2c solution), (A2d solution), (E1 solution), (E2 solution), (E3 solution), (F1 solution) and (F2 solution) was changed to be an amount that is 2.7 times the original amount, and time for adding each of (A1 solution), (A2 solution), (A2a solution), (A2b solution), (A2c solution), (A2d solution), (A3 solution), (A3a solution), (B1 solution), (B2 solution) and (B3 solution) was changed properly.

(Preparation of Silver Halide Emulsions (R-1)–(R-9))

Silver halide emulsions (R-1)–(R-9) each having an average grain diameter of 0.45 μm were prepared in the same manner as in the preparation of silver halide emulsions (B-1)–(B-9), except that each amount for $K_2$ ($IrCl_6$), $K_2$ ($IrBr_6$), $K_2$($IrCl_5$(thia)), $K_2$($IrCl_5(H_2O)$) and $K_4$($Fe(CN)_6$) respectively in (A2 solution), (A2a solution), (A2b solution), (A2c solution), (A2d solution), (E1 solution), (E2 solution), (E3 solution), (F1 solution) and (F2 solution) was changed to be an amount that is 2.2 times the original amount, and time for adding each of (A1 solution), (A2 solution), (A2a solution), (A2b solution), (A2c solution), (A2d solution), (A3 solution), (A3a solution), (B1 solution), (B2 solution) and (B3 solution) was changed properly.

Preparation of Silver Halide Emulsions (RR-1)–(RR-9)

Silver Halide Emulsions (RR-1)–(RR-9) each having an average grain diameter of 0.38 μm were prepared in the same manner as Silver Halide Emulsions (B-1)–(B-9), except that each amount for $K_2$[$IrCl_6$], $K_2$[$IrBr_6$], $K_2$[$IrCl_5$(thia)], $K_2$[$IrCl_5(H_2O)$] and $K_4$[$Fe(CN)_6$] respectively in (A2 solution), (A2a solution), (A2b solution), (A2c solution), (A2d solution), (E1 solution), (E2 solution), (E3 solution), (F1 solution) and (F2 solution) was changed to be an amount that is 3.6 times the original amount, and time for adding each of (A1 solution), (A2 solution), (A2a solution), (A2b solution), (A2c solution), (A2d solution), (A3 solution), (A3a solution), (B1 solution), (B2 solution) and (B3 solution) was changed properly.

In Silver Halide Emulsions (B-1)–(B-9), (BB-1)—(BB-9), (G-1)–(G-9), (GG-1)–(GG-9), (R-1)–(R-9) and (RR-1)–(RR-9) prepared in the aforesaid manner, 99% or more of them in terms of the number of silver halide particles were occupied by cubic silver halide particles. Other characteristics are shown in Tables 1 and 2, and respective characteristic values described in Tables 1 and 2 were obtained through the measurement described above.

Incidentally, details of respective abbreviations described in Tables 1 and 2 are as follows.

*1: Coefficient of variation of particle size

*2: Between-particle coefficient of variation of silver bromide content

*3: Between-particle coefficient of variation of silver iodide content

A: Content (mol) of Ir complex on particle surface

B: Average content (mol) of Ir complex on particle subsurface

C: Content (mol) of Ir complex in maximum point where content of Ir complex becomes maximum in a particle Characteristic 1: A particle has therein a layer-formed AgBr localized layer.

Characteristic 2: A particle has therein a layer-formed AgBr localized layer and a layer-formed silver-iodide-containing layer.

TABLE 1

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| B-1 | 0.58 | 0.05 | 99.50 | 0.50 | 0 | 27 | — | 0.83 | 0.90 | 0.92 | |
| B-2 | 0.58 | 0.05 | 99.50 | 0.50 | 0 | 27 | — | 0.67 | 0.77 | 0.87 | |
| B-3 | 0.58 | 0.05 | 99.50 | 0.50 | 0 | 27 | — | 0.56 | 0.68 | 0.82 | |
| B-4 | 0.58 | 0.05 | 99.50 | 0.50 | 0 | 27 | — | 0.43 | 0.47 | 0.91 | |
| B-5 | 0.58 | 0.05 | 99.50 | 0.50 | 0 | 27 | — | 0.22 | 0.20 | 1.10 | |
| B-6 | 0.58 | 0.05 | 97.50 | 2.50 | 0 | 15 | — | 0.20 | 0.18 | 1.11 | Character 1 |
| B-7 | 0.58 | 0.05 | 97.45 | 2.50 | 0.05 | 15 | 16 | 0.21 | 0.18 | 1.17 | Character 2 |
| B-8 | 0.58 | 0.05 | 97.45 | 2.50 | 0.05 | 15 | 16 | 0.14 | 0.20 | 0.70 | Character 2 |
| B-9 | 0.58 | 0.05 | 97.45 | 2.50 | 0.05 | 15 | 16 | 0.04 | 0.22 | 0.18 | Character 2 |
| BB-1 | 0.48 | 0.06 | 99.50 | 0.50 | 0 | 29 | — | 0.85 | 0.92 | 0.92 | |
| BB-2 | 0.48 | 0.06 | 99.50 | 0.50 | 0 | 29 | — | 0.66 | 0.80 | 0.83 | |
| BB-3 | 0.48 | 0.06 | 99.50 | 0.50 | 0 | 29 | — | 0.56 | 0.68 | 0.82 | |
| BB-4 | 0.48 | 0.06 | 99.50 | 0.50 | 0 | 29 | — | 0.44 | 0.48 | 0.92 | |
| BB-5 | 0.48 | 0.06 | 99.50 | 0.50 | 0 | 29 | — | 0.24 | 0.23 | 1.04 | |
| BB-6 | 0.48 | 0.06 | 97.50 | 2.50 | 0 | 15 | — | 0.21 | 0.20 | 1.05 | Character 1 |
| BB-7 | 0.48 | 0.06 | 97.45 | 2.50 | 0.05 | 15 | 14 | 0.21 | 0.19 | 1.11 | Character 2 |
| BB-8 | 0.48 | 0.06 | 97.45 | 2.50 | 0.05 | 15 | 14 | 0.15 | 0.21 | 0.71 | Character 2 |
| BB-9 | 0.48 | 0.06 | 97.45 | 2.50 | 0.05 | 15 | 14 | 0.04 | 0.22 | 0.18 | Character 2 |
| G-1 | 0.50 | 0.06 | 99.50 | 0.50 | 0 | 26 | — | 0.83 | 0.91 | 0.91 | |
| G-2 | 0.50 | 0.06 | 99.50 | 0.50 | 0 | 26 | — | 0.68 | 0.76 | 0.89 | |
| G-3 | 0.50 | 0.06 | 99.50 | 0.50 | 0 | 26 | — | 0.57 | 0.65 | 0.88 | |
| G-4 | 0.50 | 0.06 | 99.50 | 0.50 | 0 | 26 | — | 0.45 | 0.45 | 1.00 | |
| G-5 | 0.50 | 0.06 | 99.50 | 0.50 | 0 | 26 | — | 0.23 | 0.23 | 1.00 | |
| G-6 | 0.50 | 0.06 | 97.50 | 2.50 | 0 | 14 | — | 0.20 | 0.20 | 1.00 | Character 1 |
| G-7 | 0.50 | 0.06 | 97.45 | 2.50 | 0.05 | 14 | 16 | 0.21 | 0.21 | 1.00 | Character 2 |
| G-8 | 0.50 | 0.06 | 97.45 | 2.50 | 0.05 | 14 | 16 | 0.14 | 0.23 | 0.61 | Character 2 |
| G-9 | 0.50 | 0.06 | 97.45 | 2.50 | 0.05 | 14 | 16 | 0.04 | 0.24 | 0.17 | Character 2 |

TABLE 2

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| GG-1 | 0.42 | 0.06 | 99.50 | 0.50 | 0 | 28 | — | 0.86 | 0.95 | 0.91 | |
| GG-2 | 0.42 | 0.06 | 99.50 | 0.50 | 0 | 28 | — | 0.69 | 0.79 | 0.87 | |
| GG-3 | 0.42 | 0.06 | 99.50 | 0.50 | 0 | 28 | — | 0.54 | 0.67 | 0.81 | |
| GG-4 | 0.42 | 0.06 | 99.50 | 0.50 | 0 | 28 | — | 0.45 | 0.44 | 1.02 | |
| GG-5 | 0.42 | 0.06 | 99.50 | 0.50 | 0 | 28 | — | 0.24 | 0.27 | 0.89 | |
| GG-6 | 0.42 | 0.06 | 97.50 | 2.50 | 0 | 14 | — | 0.23 | 0.24 | 0.96 | Character 1 |
| GG-7 | 0.42 | 0.06 | 97.45 | 2.50 | 0.05 | 14 | 14 | 0.21 | 0.24 | 0.88 | Character 2 |
| GG-8 | 0.42 | 0.06 | 97.45 | 2.50 | 0.05 | 14 | 14 | 0.13 | 0.26 | 0.50 | Character 2 |
| GG-9 | 0.42 | 0.06 | 97.45 | 2.50 | 0.05 | 14 | 14 | 0.04 | 0.27 | 0.15 | Character 2 |
| R-1 | 0.45 | 0.06 | 99.50 | 0.50 | 0 | 26 | — | 0.83 | 0.91 | 0.91 | |
| R-2 | 0.45 | 0.06 | 99.50 | 0.50 | 0 | 26 | — | 0.70 | 0.75 | 0.93 | |
| R-3 | 0.45 | 0.06 | 99.50 | 0.50 | 0 | 26 | — | 0.55 | 0.63 | 0.87 | |
| R-4 | 0.45 | 0.06 | 99.50 | 0.50 | 0 | 26 | — | 0.42 | 0.42 | 1.00 | |
| R-5 | 0.45 | 0.06 | 99.50 | 0.50 | 0 | 26 | — | 0.23 | 0.23 | 1.00 | |
| R-6 | 0.45 | 0.06 | 97.50 | 2.50 | 0 | 15 | — | 0.20 | 0.21 | 0.95 | Character 1 |
| R-7 | 0.45 | 0.06 | 97.45 | 2.50 | 0.05 | 15 | 16 | 0.20 | 0.21 | 0.95 | Character 2 |
| R-8 | 0.45 | 0.06 | 97.45 | 2.50 | 0.05 | 15 | 16 | 0.14 | 0.22 | 0.64 | Character 2 |
| R-9 | 0.45 | 0.06 | 97.45 | 2.50 | 0.05 | 15 | 16 | 0.03 | 0.24 | 0.13 | Character 2 |
| RR-1 | 0.38 | 0.07 | 99.50 | 0.50 | 0 | 28 | — | 0.87 | 0.96 | 0.91 | |
| RR-2 | 0.38 | 0.07 | 99.50 | 0.50 | 0 | 28 | — | 0.68 | 0.81 | 0.84 | |
| RR-3 | 0.38 | 0.07 | 99.50 | 0.50 | 0 | 28 | — | 0.56 | 0.65 | 0.86 | |
| RR-4 | 0.38 | 0.07 | 99.50 | 0.50 | 0 | 28 | — | 0.45 | 0.46 | 0.98 | |
| RR-5 | 0.38 | 0.07 | 99.50 | 0.50 | 0 | 28 | — | 0.24 | 0.28 | 0.86 | |
| RR-6 | 0.38 | 0.07 | 97.50 | 2.50 | 0 | 14 | — | 0.23 | 0.23 | 1.00 | Character 1 |
| RR-7 | 0.38 | 0.07 | 97.45 | 2.50 | 0.05 | 14 | 15 | 0.22 | 0.22 | 1.00 | Character 2 |
| RR-8 | 0.38 | 0.07 | 97.45 | 2.50 | 0.05 | 14 | 15 | 0.12 | 0.25 | 0.48 | Character 2 |
| RR-9 | 0.38 | 0.07 | 97.45 | 2.50 | 0.05 | 14 | 15 | 0.03 | 0.27 | 0.11 | Character 2 |

Preparation of Photosensitive Silver Halide Emulsion.

Preparation of Blue-sensitive Silver Halide Emulsions (B-1a)–(B-9a)

Under the conditions of 60° C., pH5.8 and pAg7.5, the following sensitizing dyes BS-1 and BS-2 were added to Silver Halide Emulsions (B-1)–(B-9), and then, sodium thiosulfate and chloroauric acid were added in succession, to conduct spectral sensitization and chemical sensitization for Silver Halide Emulsions (B-1)–(B-9). When ripening was performed optimally after adding chemical sensitizers, exemplified compounds S-2-5, S-2-2 and S-2-3 were added to terminate the ripening, whereby, Blue-sensitive Silver Halide Emulsions (B-1a)–(B-9a) were obtained.

| | |
|---|---|
| Sodium thiosulfate | $7.6 \times 10^{-6}$ mol/mol AgX |
| Chloroauric acid | $2.2 \times 10^{-5}$ mol/mol AgX |
| Exemplified compound S-2-5 | $2.0 \times 10^{-4}$ mol/mol AgX |
| Exemplified compound S-2-2 | $2.0 \times 10^{-4}$ mol/mo AgX |
| Exemplified compound S-2-3 | $2.0 \times 10^{-4}$ mol/mol AgX |
| Sensitizing dye: BS-1 | $6.1 \times 10^{-4}$ mol/mol AgX |
| Sensitizing dye: BS-2 | $1.5 \times 10^{-4}$ mol/mol AgX |

Preparation of Blue-sensitive Silver Halide Emulsion (B-9b)

Blue-sensitive Silver Halide Emulsion (B-9b) was obtained in the same manner as in the preparation of Blue-sensitive Silver Halide Emulsion (B-9a), except that $1.0\times10^{-6}$ mol/mol AgX of exemplified compound 1-21 was added after adding sensitizing dyes BS-1 and BS-2 and before adding sodium thiosulfate.

Preparation of Blue-sensitive Silver Halide Emulsion (B-9c)

Blue-sensitive Silver Halide Emulsion (B-9c) was obtained in the same manner as Blue-sensitive Silver Halide Emulsion (B-9b), except that an amount of addition of sodium thiosulfate was changed to $4.6\times10^{-6}$ mol/mol AgX, and after adding sodium thiosulfate, chloroauric acid was added after adding $3.0\times10^{-6}$ mol/mol AgX of trifurylphosphine selenide. Preparation of Blue-sensitive Silver Halide Emulsions (BB-1a)–(BB-9a), (BB-9b) and (BB-9c)

Blue-sensitive Silver Halide Emulsions (BB-1a)–(BB-9a), (BB-9b) and (BB-9c) were obtained in the same manner as Blue-sensitive Silver Halide Emulsions (B-1a)–(B-9a), (B-9b) and (B-9c), except that silver halide emulsions (B-1)–(B-9) were replaced successively with the aforesaid silver halide emulsions (BB-1)–(BB-9), and an amount of addition for each of sodium thiosulfate, trifurylphosphine selenide, chloroauric acid, sensitizing dye (BS-1) and sensitizing dye (BS-2) was changed so that an amount of addition per surface area may become the same, considering changes in the surface area of a silver halide particle caused by a change of an average grain diameter of a silver halide particle from 0.58 μm to 0.48 μm.

Preparation of Green-sensitive Silver Halide Emulsions (G-1a)–(G-9a)

Under the conditions of 60° C., pH5.8 and pAg7.5, the following sensitizing dye (GS-1) was added to the silver halide emulsions (G-1)–(G-9) prepared, and then, sodium thiosulfate and chloroauric acid were added in succession, to conduct spectral sensitization and chemical sensitization. When ripening was finished after adding chemical sensitizers, exemplified compound S-2-5 was added to stop the ripening, whereby, green sensitive silver halide emulsions (G-1a)–(G-9a) were obtained.

| | |
|---|---|
| Sensitizing dye: GS-1 | $5.8 \times 10^{-4}$ mol/mol AgX |
| Sodium thiosulfate | $6.1 \times 10^{-6}$ mol/mol AgX |

-continued

| | |
|---|---|
| Chloroauric acid | $1.7 \times 10^{-5}$ mol/mol AgX |
| Exemplified compound S-2-5 | $1.5 \times 10^{-4}$ mol/mol AgX |

Preparation of Green-sensitive Silver Halide Emulsion (G-9b)

Green sensitive Silver Halide Emulsion (G-9b) was obtained in the same manner as Green-sensitive Silver Halide Emulsion (G-9a), except that $1.1\times10^{-6}$ mol/mol AgX of exemplified compound 1-21 was added after adding sensitizing dye (GS-1) and before adding sodium thiosulfate.

Preparation of Green-sensitive Silver Halide Emulsion (G-9c)

Green-sensitive Silver Halide Emulsion (G-9c) was obtained in the same manner as Green-sensitive Silver Halide Emulsion (G-9b), except that an amount of addition of sodium thiosulfate was changed to $3.7\times10^{-6}$ mol/mol AgX, and chloroauric acid was added after $3.4\times10^{-6}$ mol/mol AgX of trifurylphosphine selenide was added after adding sodium thiosulfate.

Preparation of Green-sensitive Silver Halide Emulsion (GG-1a)–(GG-9a), (GG-9b) and (GG-9c)

Green-sensitive Silver Halide Emulsions (GG-1a)–(GG-9a), (GG-9b) and (GG-9c) were obtained in the same manner as Green-sensitive Silver Halide Emulsions (G-1a)–(G-9a), (G-9b) and (G-9c), except that Silver Halide Emulsions (G-1)–(G-9) were replaced successively with the aforesaid Silver Halide Emulsions (GG-1)–(GG-9), and an amount of addition for each of sodium thiosulfate, trifurylphosphine selenide, chloroauric acid, sensitizing dye (GS-1) and sensitizing dye (GS-1) was changed so that an amount of addition per surface area may become the same, considering changes in the surface area of a silver halide particle caused by a change of an average grain diameter of a silver halide particle from 0.5 μm to 0.42 μm.

Preparation of Red-sensitive Silver Halide Emulsions (R-1a)–(R-9a)

Under the conditions of 60° C., pH5.0 and pAg7.1, the following sensitizing dyes (RS-1) and (RS-2) were added to the Silver Halide Emulsions (R-1)–(R-9) prepared, and then, sodium thiosulfate and chloroauric acid were added in succession, to conduct spectral sensitization and chemical sensitization. When ripening was finished after adding chemical sensitizers, exemplified compound S-2-5 was added to stop the ripening, whereby, Red-sensitive Silver Halide Emulsions (R-1a)–(R-9a) were obtained.

| | |
|---|---|
| Sodium thiosulfate | $1.0 \times 10^{-5}$ mol/mol AgX |
| Chloroauric acid | $1.5 \times 10^{-5}$ mol/mol AgX |
| Exemplified compound S-2-5 | $1.2 \times 10^{-4}$ mol/mol AgX |
| Sensitizing dye: RS-1 | $1.0 \times 10^{-4}$ mol/mol AgX |
| Sensitizing dye: RS-2 | $1.0 \times 10^{-4}$ mol/mol AgX |

Preparation of Red-sensitive Silver Halide Emulsion (R-9b)

Red-sensitive Silver Halide Emulsion (R-9b) was obtained in the same manner as in the preparation of Red-sensitive Silver Halide Emulsion (R-9a), except that $1.2\times10^{-6}$ mol/mol AgX of exemplified compound 1-21 was added after adding sensitizing dyes (RS-1) and (RS-2) and before adding sodium thiosulfate.

Preparation of Red-sensitive Silver Halide Emulsion (R-9c)

Red-sensitive Silver Halide Emulsion (R-9c) was obtained in the same manner as Red-sensitive Silver Halide Emulsion (R-9b), except that an amount of addition of sodium thiosulfate was changed to $6.0\times10^{-6}$ mol/mol AgX, and chloroauric acid was added after $4.0\times10^{-6}$ mol/mol AgX of trifurylphosphine selenide was added after adding sodium thiosulfate.

Preparation of Red-sensitive Silver Halide Emulsion (RR-1a)–(RR-9a), (RR-9b) and (RR-9c)

Red-sensitive Silver Halide Emulsions (RR-1a)–(RR-9a), (RR-9b) and (RR-9c) were obtained in the same manner as Red-sensitive Silver Halide Emulsions (R-1a)–(R-9a), (R-9b) and (R-9c), except that Silver Halide Emulsions (R-1)–(R-9) were replaced successively with the aforesaid Silver Halide Emulsions (RR-1)–(RR-9), and an amount of addition for each of sodium thiosulfate, trifurylphosphine selenide, chloroauric acid, sensitizing dye (RS-1) and sensitizing dye (RS-2) was changed so that an amount of addition per surface area may become the same, considering changes in the surface area of a silver halide particle caused by a change of an average grain diameter of a silver halide particle from 0.45 μm to 0.38 μm.

Incidentally, in the preparation of each Red-sensitive Silver Halide Emulsion, $2.0\times10^{-3}$ mol/mol AgX of SS-1 was added when the preparation was finished.

BS-1

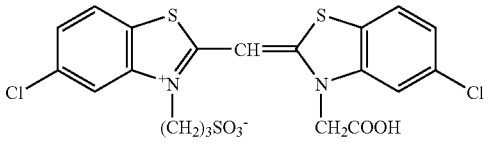

BS-2

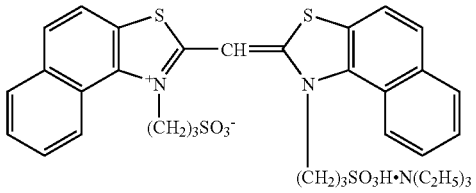

GS-1

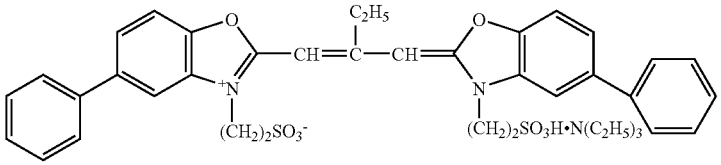

-continued

RS-1

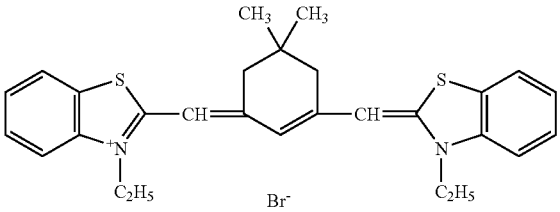

RS-1

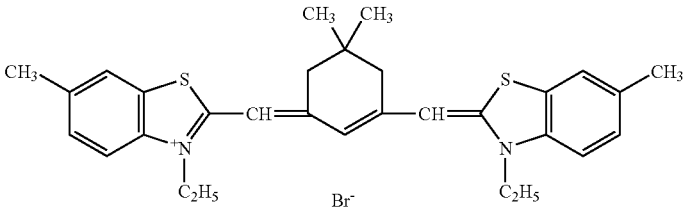

SS-1

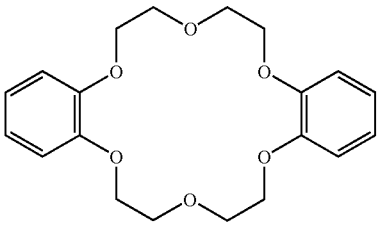

Preparation of Silver Halide Color Photosensitive Material

Preparation of Sample 101

High density molten polyethylene containing surface-treated anatase titanium oxide at the content of 15% by mass was laminated on the photosensitive-layer-coated surface of paper pulp with basis weight of 180 g/m$^2$, and on the reverse side thereof, a reflection support laminated with high density polyethylene was processed in terms of corona discharge, and gelatin base-coated layer was provided, and further, respective photographic structural layers having structures described in Tables 3 and 4 were coated, thus, Sample 101 representing a silver halide color photographic photosensitive material was prepared.

A coating solution was prepared in the following manner.

Incidentally, details of the Silver halide emulsion used for each photosensitive layer are as follows.

Blue-sensitive Silver Halide Emulsion of the first layer (being a blue-sensitive layer): Blue-sensitive Silver Halide Emulsion (B-1a)):Blue-sensitive Silver Halide Emulsion (BB-1a)=88:12

Green-sensitive Silver Halide Emulsion of the third layer (being a green-sensitive layer): Green-sensitive Silver Halide Emulsion (G-1a):Green-sensitive Silver Halide Emulsion (GG-1a)=5:95

Red-sensitive Silver Halide Emulsion of the fifth layer (being a red-sensitive layer): Red-sensitive Silver Halide Emulsion (R-1a):Red-sensitive Silver Halide Emulsion (RR-1a)=33:67

In the preparation of Sample 101, additives 1 and hardening agents (H-1) and (H-2) were added. Further, for adjustment of a coupler dispersion for each layer, surface active agent (SU-2) was added, and surface active agents (SU-1) and (SU-3) were added as coating aid for adjusting surface tension. Further, anti-mold agents (F-1) were added to each layer so that the total amount may become 0.04 g/m$^2$.

Incidentally, Silver Halide Emulsion described in Table are shown with values converted into silver.

Details of each additive used for the preparation of Sample 101 are as follows.

Sol-1: tricresyl phosphate

Matting agent 1: $SiO_2$ (at an average grain diameter of 3.0 μm)

TABLE 3

| Layer | Components | Added amount (g/m$^2$) |
|---|---|---|
| Seventh layer (protective layer) | Gelatin | 0.7 |
| | Antistaining agent (HQ-1) | 0.003 |
| | Antistaining agent (HQ-2) | 0.02 |
| | High-boiling-point solvent (Sol-1) | 0.01 |
| | Colloidal silica | 0.06 |
| | Matting agent 1 | 0.003 |
| Sixth layer (UV absorbing layer) | Gelatin | 0.47 |
| | UV absorbing agent (UV-1) | 0.04 |
| | UV absorbing agent (UV-2) | 0.16 |
| | Antistaining agent (HQ-2) | 0.02 |
| | High-boiling-point solvent (Sol-2) | 0.02 |
| | Blue tint agent (WB-1) | 0.0001 |
| | Blue tint agent (WB-2) | 0.001 |
| | Image stabilizing agent (Cpd-1) | 0.006 |
| | Polyvinyl pyrrolidone | 0.01 |
| Fifth layer (red sensitive layer) | Gelatin | 1.03 |
| | Red sensitive silver halide emulsion (R-1a) | 0.05 |
| | Red sensitive silver halide emulsion (RR-1a) | 0.10 |
| | Cyan coupler (C-1) | 0.20 |
| | Cyan coupler (C-2) | 0.05 |
| | Antistaining agent (HQ-1) | 0.003 |
| | Image stabilizing agent (Cpd-2) | 0.05 |
| | Image stabilizing agent (Cpd-3) | 0.01 |
| | High-boiling-point solvent (Sol-1) | 0.17 |
| Fourth layer (UV absorbing | Gelatin | 1.05 |
| | UV absorbing agent (UV-1) | 0.09 |
| | UV absorbing agent (UV-2) | 0.35 |
| | Antistaining agent (HQ-2) | 0.05 |

TABLE 3-continued

| Layer | Components | Added amount ($g/m^2$) |
|---|---|---|
| layer) | High-boiling-point solvent (Sol-2) | 0.06 |
| | Blue tint agent (WB-1) | 0.0001 |
| | Blue tint agent (WB-2) | 0.001 |
| | Image stabilizing agent (Cpd-1) | 0.013 |

TABLE 4

| Layer | Components | Added amount ($g/m^2$) |
|---|---|---|
| Third layer (green sensitive layer) | Gelatin | 1.28 |
| | Green sensitive silver halide emulsion (G-1a) | 0.006 |
| | Green sensitive silver halide emulsion (GG-1a) | 0.11 |
| | Magenta coupler (M-1) | 0.13 |
| | Image stabilizing agent (Cpd-4) | 0.18 |
| | UV absorbing agent (UV-2) | 0.07 |
| | High-boiling-point solvent (Sol-2) | 0.16 |
| Second layer (intermediate layer) | Gelatin | 1.02 |
| | Antistaining agent (HQ-1) | 0.02 |
| | Antistaining agent (HQ-2) | 0.11 |
| | High-boiling-point solvent (Sol-1) | 0.05 |
| | Optical brightening agent (W-1) | 0.07 |
| | Polyvinyl pyrrolidone | 0.07 |
| First layer (blue sensitive layer) | Gelatin | 1.03 |
| | Blue sensitive silver halide emulsion (B-1a) | 0.15 |
| | Blue sensitive silver halide emulsion (BB-1a) | 0.02 |
| | Yellow sensitive silver halide emulsion (Y-1) | 0.20 |
| | Image stabilizing agent (Cpd-1) | 0.05 |
| | Image stabilizing agent (Cpd-2) | 0.003 |
| | Image stabilizing agent (Cpd-5) | 0.05 |
| | High-boiling-point solvent (Sol-1) | 0.01 |
| | High-boiling-point solvent (Sol-2) | 0.17 |

Y-1

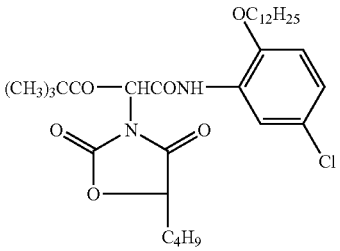

M-1

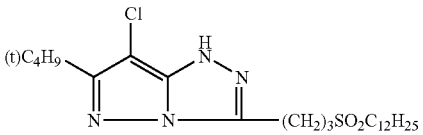

C-1

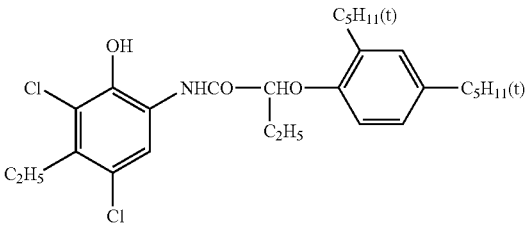

TABLE 4-continued
C-2
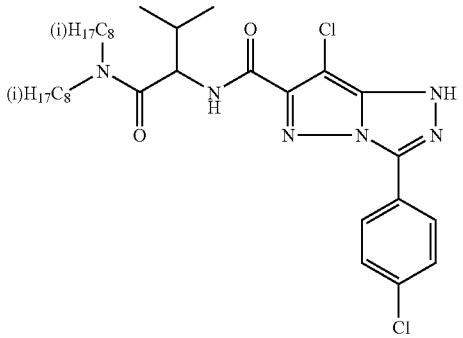
HQ-1
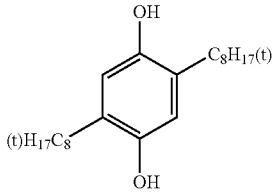
HQ-2
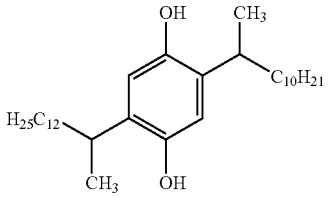
Sol-2
$H_{17}C_8HC{=}CH(CH_2)_8OH$
UV-1
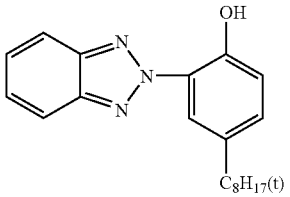
UV-2
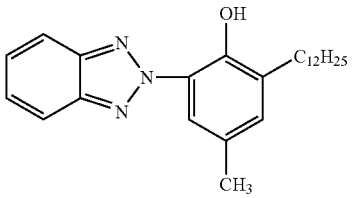
Cpd-1
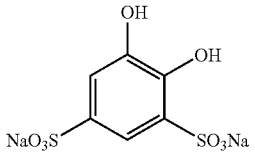

TABLE 4-continued
Cpd-2
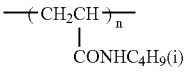
Cpd-3
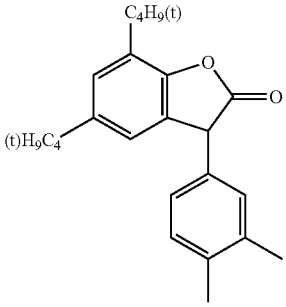
Cpd-4
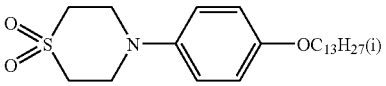
Cpd-5
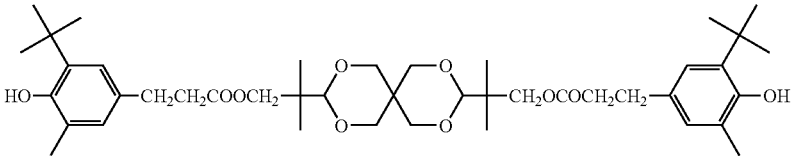
W-1
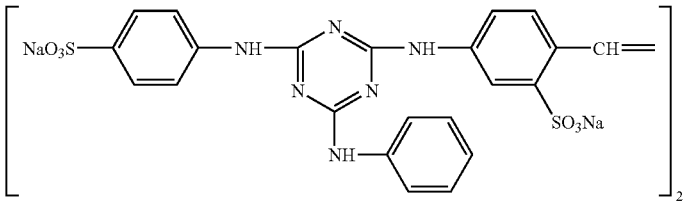
WB-1
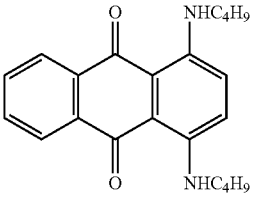
WB-2
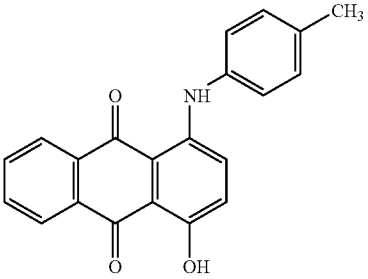

TABLE 4-continued
Al-1
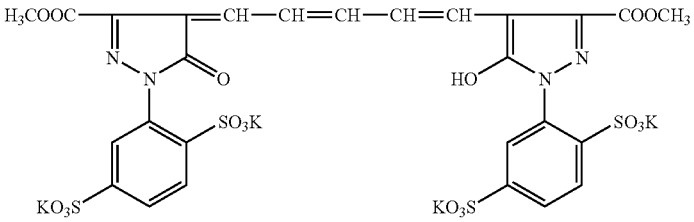
Al-2
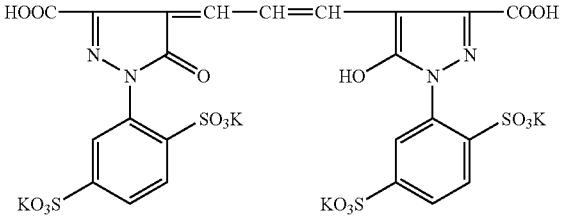
Al-3
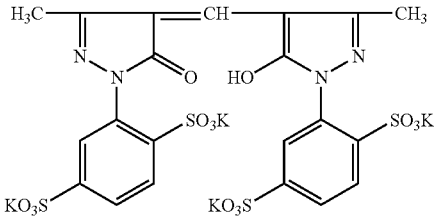
F-1
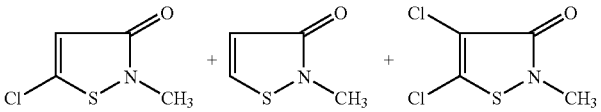
(50%) (46%) (4%) mol ratio
Mixture of mol ratio of (50:46:4)
SU-1
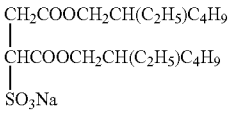
SU-2
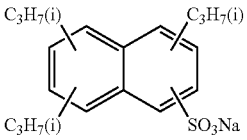
SU-3
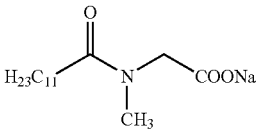
Additive 1
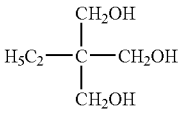

TABLE 4-continued

H-1

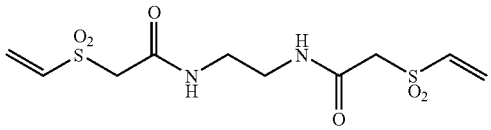

H-2

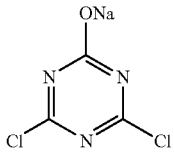

Preparation of Samples 102–111

Samples 102–111 were obtained in the same manner as aforesaid Sample 101, except that each of the blue-sensitive silver halide emulsion of the first layer (being a blue-sensitive layer), the green-sensitive silver halide emulsion of the third layer (being a green-sensitive layer) and the red-sensitive silver halide emulsion of the fifth layer (being a red-sensitive layer) was changed to a combination of silver halide emulsions described in Table 5. Incidentally, the mixing ratio of silver halide emulsions for each layer was made to be the same as that of Sample 101.

Evaluation of Each Characteristic

Respective samples representing the silver halide color photographic photosensitive materials were evaluated as follows.

Evaluation of Latent Image Stability

Two sets of aforesaid Samples 101–111 were prepared, and the samples included in one set of them were subjected to exposure under the following exposure condition S, then, after 15 sec., they were subjected to following photographic processing 1. Concerning each step of the gray-step image obtained in the manner above, each reflection density was measured by the use of densitometer PDA-65 (manufactured by Konica Minolta Photo Imaging, Inc.) to prepare a characteristic curve composed of the axis of abscissas representing an exposure amount (Log E) and the axis of ordinates representing reflection density (D), then, an exposure amount needed to obtain the density representing the sum including minimum density in each exposure condition plus 1.0 was obtained concerning yellow image density of the first layer (blue sensitive layer), and a reciprocal number of this exposure amount was defined as sensitivity 1. Concerning the other one set, the samples included in the other one set were subjected to exposure under the following exposure conditions, then, after one hour, they were subjected to following photographic processing 1 to obtain sensitivity 2 in the same manner as in the foregoing, and absolute value ΔS1 of a difference between sensitivity 2 and sensitivity 1 (|sensitivity 2−sensitivity 1|) was obtained. ΔS1 of each sample was evaluated with a relative value wherein ΔS1 of Sample 101 was 100, and a result thereof was made to be a standard, in which, the smaller ΔS1 is, the more excellent the latent image stability is.

Exposure Condition S: High Illuminance Exposure

A sensitometer for xenon flash high illuminance exposure with $10^{-6}$ sec. exposure (type SX-20, manufactured by Yamashita Denso Corp.) was used to give wedge-exposure to each sample.

Photographic processing 1

| Processing | Temperature | Time | Replenishing rate |
|---|---|---|---|
| Color Development | 38.0 ± 0.3° C. | 45 sec. | 80 ml/m$^2$ |
| Bleach-fixing | 35.0 ± 0.5° C. | 45 sec. | 120 ml/m$^2$ |
| Stabilizing | 30–34° C. | 60 sec. | 150 ml/m$^2$ |
| Drying | 60–80° C. | 30 sec. | |

| | Solution in tank | Replenisher |
|---|---|---|
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β methanesulfonamide ethyl)-3-methyl-4-amino aniline suflate | 6.0 g | 10.0 g |
| N,N-diethylhydroxylamine | 6.8 g | 6.0 g |
| Triethanol | 10.0 g | 10.0 g |
| Diethylenetriamineheteroacetic acid sodium salt | 2.0 g | 2.0 g |
| Optical brightening agent (4,4-diaminostilbenedisulfonic acid derivative) | 2.0 g | 2.5 g |
| Potassium carbonate | 30 g | 30 g |

Water was added to bring the total amount to be 1 liter, then, pH of a solution in the tank was adjusted to 10.10 and that of replenisher was adjusted to 10.60.

Bleach-fixer Tank Solution and Replenisher

| | |
|---|---|
| Diethylenetriamineheteroacetic acidferric ammonium dihydrate | 65 g |
| Diethylenetriamine pentaacetic acid | 3 g |
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |

Water was added to bring the total amount to be 1 liter, and pH was adjusted to 5.0 by potassium carbonate or glacial acetic acid.

Stabilizer Tank Solution and Replenisher

| | |
|---|---|
| 0-phenyl phenol | 1.0 g |
| 5-chloro-2-methyl-4-isothiazoline-3-on | 0.02 g |

-continued

| | |
|---|---|
| 2-methyl-4-isothiazoline-3-on | 0.02 g |
| Diethylene glycol | 1.0 g |
| Optical brightening agent (Tnopal SFP) | 2.0 g |
| 1-hydroxyethylidyne-1,1-diphosphonic acid | 1.8 g |
| Bismuth chloride (being a 45% aqueous solution) | 0.65 g |
| Magnesium sulfate heptahydrate | 0.2 g |
| PVP (being polyvinyl pyrolidone) | 1.0 g |
| Aqueous ammonia (ammonium hydroxide 25% aqueous solution) | 2.5 g |
| Nitrilotriacetic acid-trisodium salt | 1.5 g |

Water was added to make the total amount to be 1 liter, and pH was adjusted to 7.5 by sulfuric acid or aqueous ammonia.

Evaluation of Process Stability

Measurement of Sensitivity Difference

Samples 101–111 mentioned above were subjected to wedge-exposure under the aforesaid conditions S (high illuminance exposure), and then, they were subjected to the photographic processing 1, and sensitivity A of the first layer (being a blue-sensitive layer) was obtained in the same manner as in the foregoing. Then, sensitivity B of the first layer (blue sensitive layer) was obtained for each sample, in the same manner except that the photographic processing 1 was changed to photographic processing 2.

| | Photographic processing 2 Processing step | | |
|---|---|---|---|
| Processing step | Processing temp. | Time | Replenisher amount |
| Color development | 42.0 ± 0.3° C. | 20 sec. | 80 ml/m$^2$ |
| Bleach-fix | 40.0 ± 0.5° C. | 20 sec. | 120 ml/m$^2$ |
| Stabilization | 30–34° C. | 20 sec. | 150 ml/m$^2$ |
| Drying | 60–80° C. | 30 sec. | |

Incidentally, processing solutions used in respective processes in the photographic processing 2 were made to be the same in terms of composition as those used in the aforesaid photographic processing 1.

There was obtained relative sensitivity of each sample wherein sensitivity A of Sample 101 obtained by photographic processing 1 was 100, and thereby, relative sensitivity difference ΔS2 between relative sensitivity A in photographic processing 1 and relative sensitivity B in photographic processing 2 was obtained, thus, ΔS2 of each sample was evaluated by the relative value wherein ΔS2 of Sample 101 was 100. When this ΔS2 is smaller, it means that the processing stability in the case of rapid processing is excellent.

Evaluation of Resistance to Radioactive Rays

Two sets of the aforesaid Samples 101–111 were prepared respectively, and the samples included in one set of them were subjected to natural radiation processing (irradiating radiation corresponding to 300 mR emitted from a radiation source of Cs137) immediately after the preparation of the samples, and the samples included in the other one set were not subjected to the natural radiation processing to be the standard samples, and they were subjected to the photographic processing 1 after being given exposure respectively under the exposure condition S.

Then, for each sample which has been subjected to photographic processing, minimum yellow reflection density (yellow fog density) was measured by the use of sensitometer PDA-65 (manufactured by Konica Minolta Photo Imaging, Inc.), and a fog density rise rate (Dmin2/Dmin1) of yellow fogging density (Dmin2) of the sample subjected to natural radiation processing to yellow fogging density (Dmin1) of the standard sample was obtained, whereby, a relative value of each sample wherein the density rise rate of Sample 101 was 100. When the numerical value thereof is smaller, it means that the resistance to radioactive rays is excellent.

Table 5 shows the results obtained from the foregoing.

TABLE 5

| | Photosensitive silver halide constitution | | | | | | |
|---|---|---|---|---|---|---|---|
| Sample No. | First layer (blue-sensitive layer) | Third layer (green-sensitive layer) | Fifth layer (red-sensitive layer | Latent image stability ΔS1 | Processing stability ΔS2 | Resistance to radioactive rays Fogging density increasing rate | Remarks |
| 101 | B-1a/BB-1a | G-1a/GG-1a | R-1a/RR-1a | 100 | 100 | 100 | Comp. |
| 102 | B-2a/BB-2a | G-2a/GG-2a | R-2a/RR-2a | 97 | 97 | 95 | Comp. |
| 103 | B-3a/BB-3a | G-3a/GG-3a | R-3a/RR-3a | 68 | 87 | 83 | Comp. |
| 104 | B-4a/BB-4a | G-4a/GG-4a | R-4a/RR-4a | 57 | 82 | 80 | Comp. |
| 105 | B-5a/BB-5a | G-5a/GG-5a | R-5a/RR-5a | 50 | 80 | 80 | Comp. |
| 106 | B-6a/BB-6a | G-6a/GG-6a | R-6a/RR-6a | 45 | 75 | 78 | Comp. |
| 107 | B-7a/BB-7a | G-7a/GG-7a | R-7a/RR-7a | 38 | 72 | 77 | Comp. |
| 108 | B-8a/BB-8a | G-8a/GG-8a | R-8a/RR-8a | 35 | 69 | 74 | Inv. |
| 109 | B-9a/BB-9a | G-9a/GG-9a | R-9a/RR-9a | 32 | 66 | 73 | Inv. |
| 110 | B-9b/BB-9b | G-9b/GG-9b | R-9b/RR-9b | 28 | 66 | 71 | Inv. |
| 111 | B-9c/BB-9c | G-9c/GG-9c | R-9c/RR-9c | 25 | 66 | 70 | Inv. |

Comp.: Comparative example
Inv.: This invention

TABLE 6

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| B-11 | 0.50 | 0.05 | 99.30 | 0.70 | 0 | 27 | — | 0.80 | 0.93 | 0.86 | |
| B-12 | 0.50 | 0.05 | 99.30 | 0.70 | 0 | 27 | — | 0.48 | 0.81 | 0.59 | |
| B-13 | 0.50 | 0.05 | 99.30 | 0.70 | 0 | 27 | — | 0.18 | 0.82 | 0.22 | |
| B-14 | 0.50 | 0.05 | 99.30 | 0.70 | 0 | 27 | — | 0.08 | 0.76 | 0.098 | |
| B-15 | 0.50 | 0.05 | 99.30 | 0.70 | 0 | 27 | — | 0.03 | 0.45 | 0.067 | |
| B-16 | 0.50 | 0.05 | 97.30 | 2.70 | 0 | 15 | — | 0.03 | 0.43 | 0.070 | Character 1 |
| B-17 | 0.50 | 0.05 | 97.25 | 2.70 | 0.05 | 15 | 14 | 0.03 | 0.43 | 0.070 | Character 2 |
| B-18 | 0.50 | 0.05 | 97.25 | 2.70 | 0.05 | 15 | 14 | 0.04 | 0.47 | 0.085 | Character 2 |
| B-19 | 0.50 | 0.05 | 97.25 | 2.70 | 0.05 | 15 | 14 | 0.04 | 0.28 | 0.14 | Character 2 |
| BB-11 | 0.44 | 0.06 | 99.30 | 0.70 | 0 | 26 | — | 0.82 | 0.90 | 0.91 | |
| BB-12 | 0.44 | 0.06 | 99.30 | 0.70 | 0 | 26 | — | 0.53 | 0.79 | 0.67 | |
| BB-13 | 0.44 | 0.06 | 99.30 | 0.70 | 0 | 26 | — | 0.17 | 0.80 | 0.21 | |
| BB-14 | 0.44 | 0.06 | 99.30 | 0.70 | 0 | 26 | — | 0.07 | 0.76 | 0.092 | |
| BB-15 | 0.44 | 0.06 | 99.30 | 0.70 | 0 | 26 | — | 0.03 | 0.44 | 0.068 | |
| BB-16 | 0.44 | 0.06 | 97.30 | 2.70 | 0 | 14 | — | 0.03 | 0.41 | 0.073 | Character 1 |
| BB-17 | 0.44 | 0.06 | 97.25 | 2.70 | 0.05 | 14 | 14 | 0.03 | 0.42 | 0.071 | Character 2 |
| BB-18 | 0.44 | 0.06 | 97.25 | 2.70 | 0.05 | 14 | 14 | 0.04 | 0.43 | 0.093 | Character 2 |
| BB-19 | 0.44 | 0.06 | 97.25 | 2.70 | 0.05 | 14 | 14 | 0.04 | 0.28 | 0.14 | Character 2 |
| G-11 | 0.42 | 0.07 | 99.30 | 0.70 | 0 | 26 | — | 0.78 | 0.91 | 0.86 | |
| G-12 | 0.42 | 0.07 | 99.30 | 0.70 | 0 | 26 | — | 0.47 | 0.83 | 0.57 | |
| G-13 | 0.42 | 0.07 | 99.30 | 0.70 | 0 | 26 | — | 0.17 | 0.82 | 0.21 | |
| G-14 | 0.42 | 0.07 | 99.30 | 0.70 | 0 | 26 | — | 0.06 | 0.74 | 0.081 | |
| G-15 | 0.42 | 0.07 | 99.30 | 0.70 | 0 | 26 | — | 0.02 | 0.46 | 0.043 | |
| G-16 | 0.42 | 0.07 | 97.30 | 2.70 | 0 | 14 | — | 0.02 | 0.42 | 0.048 | Character 1 |
| G-17 | 0.42 | 0.07 | 97.25 | 2.70 | 0.05 | 14 | 16 | 0.02 | 0.43 | 0.047 | Character 2 |
| G-18 | 0.42 | 0.07 | 97.25 | 2.70 | 0.05 | 14 | 16 | 0.03 | 0.43 | 0.070 | Character 2 |
| G-19 | 0.42 | 0.07 | 97.25 | 2.70 | 0.05 | 14 | 16 | 0.03 | 0.25 | 0.12 | Character 2 |

As is apparent from the results described in Table 5, the sample employing a silver halide emulsion of this invention showed smaller fluctuations of sensitivity even when a period of time from exposure to photographic processing was changed, and it was excellent in latent image stability, as well as in processing stability under rapid processing condition (sensitivity fluctuation) and in resistance to radioactive rays, compared with the sample using a comparative silver halide emulsion.

Further, as a result of the evaluation conducted for a green sensitive layer (magenta image) and a red image (cyan image) equally in accordance with the aforementioned manner, it was possible to confirm the same effect as that of the blue sensitive layer described in Table 5.

Example 2

Preparation of Silver Halide Emulsions

Preparation of Silver Halide Emulsion (B-11)

(A11 solution) and (B11 solution) shown below were added simultaneously through a double-jet precipitation method by controlling to pAg of 7.3 and pH of 3.0 by spending 10 minutes, while stirring hard 1.5 liters of 2% aqueous solution of amphoterically deionized ossein gelatin (at a calcium content of 10 ppm) maintained at 40° C., by using a mixing and stirring machine described in JP-A 62-160128. Then, the following (A12 solution) and (B12 solution) were added simultaneously by controlling at pAg of 8.0 and pH of 5.5 by spending 90 minutes. After that, the following (A13 solution) and (B13 solution) were added simultaneously by controlling at pAg of 8.0 and pH of 5.5 by spending 15 minutes. In this case, pAg was controlled by the method described in JP-A 59-45437, and pH was controlled by using sulfuric acid or sodium hydroxide.

(A11 Solution)

| | |
|---|---|
| Sodium chloride | 3.43 g |
| Potassium bromide | 0.021 g |
| Water added to make | 200 ml |

(A12 Solution)

| | |
|---|---|
| Sodium chloride | 71.9 g |
| $K_2[IrCl_6]$ | $2.5 \times 10^{-8}$ mol/mol AgX |
| $K_2[IrBr_6]$ | $1.2 \times 10^{-8}$ mol/mol AgX |
| $K_4[Ru(CN)_6]$ | $4.5 \times 10^{-5}$ mol/mol AgX |
| Potassium bromide | 0.67 g |
| Water | to make 420 ml |

(A13 Solution)

| | |
|---|---|
| Sodium chloride | 30.6 g |
| Potassium bromide | 0.83 g |
| Water | to make 180 ml |

(B11 Solution)

| | |
|---|---|
| Silver nitrate | 10 g |
| Water | to make 200 ml |

(B12 Solution)

| | |
|---|---|
| Silver nitrate | 210 g |
| Water | to make 420 ml |

(B13 Solution)

| | |
|---|---|
| Silver nitrate | 90 g |
| Water | to make 180 ml |

After completion of addition, 15% aqueous solution containing 30 g of chemically modified gelatin (at a modification rate of 95%) wherein an amino group was phenylcarbamoylated by using a method described in JP-A 5-72658 was added for desalting, and then, is mixed with gelatin solution to prepare Silver Halide Emulsion (B-11) having an average grain diameter of 0.50 μm.

Preparation of Silver Halide Emulsion (B-12)

Silver Halide Emulsion (B-12) was prepared in the same manner as in the preparation of Silver Halide Emulsion (B-11), except that (A12 solution) was replaced with the following (A12a solution).

(A12a Solution)

| | |
|---|---|
| Sodium chloride | 71.9 g |
| $K_2[IrCl_6]$ | $1.5 \times 10^{-8}$ mol/mol AgX |
| $K_2[IrBr_6]$ | $2.3 \times 10^{-9}$ mol/mol AgX |
| $K_2[IrCl_5(thia)]$ | $1.0 \times 10^{-7}$ mol/mol AgX |
| $K_2[IrCl_5(H_2O)]$ | $2.0 \times 10^{-7}$ mol/mol AgX |
| $K_4[Ru(CN)_6]$ | $4.5 \times 10^{-6}$ mol/mol AgX |
| Potassium bromide | 0.67 g |
| Water | to make 420 ml |

Preparation of Silver Halide Emulsion (B-13)

Silver Halide Emulsion (B-13) was prepared in the same manner as Silver Halide Emulsion (B-12), except that addition of (B13 solution) and (A13 solution) was interrupted at the point of time of adding 95% of (B13 solution), then, the following (F11 solution) was added from an adding nozzle provided to be close to an adding nozzle for (A13 solution), and addition of (B13 solution) and (A13 solution) was started again.

(F11 Solution)

| | |
|---|---|
| $K_2[IrCl_5(H_2O)]$ | $6.0 \times 10^{-8}$ mol/mol AgX |
| Water | to make 20 ml |

Preparation of Silver Halide Emulsion (B-14)

Silver Halide Emulsion (B-14) was prepared in the same manner as Silver Halide Emulsion (B-12), except that addition of (B13 solution) and (A13 solution) was interrupted at the point of time of adding 95% of (B13 solution), then, the following (F12 solution) was added from an adding nozzle provided to be close to an adding nozzle for (A13 solution), and addition of (B13 solution) and (A13 solution) was started again.

(F12 Solution)

| | |
|---|---|
| $K_2[IrCl_5(H_2O)]$ | $1.6 \times 10^{-7}$ mol/mol AgX |
| Water | to make 20 ml |

Preparation of Silver Halide Emulsion (B-15)

Silver Halide Emulsion (B-15) was prepared in the same manner Silver Halide Emulsion (B-14), except that the following (A12b solution) and (A13a solution) were used in place respectively of (A12a solution) and (A13 solution).

(A12b Solution)

| | |
|---|---|
| Sodium chloride | 71.9 g |
| $K_2[IrCl_6]$ | $1.2 \times 10^{-9}$ mol/mol AgX |
| $K_2[IrBr_6]$ | $1.0 \times 10^{-9}$ mol/mol AgX |
| $K_2[IrCl_5(H_2O)]$ | $8.5 \times 10^{-7}$ mol/mol AgX |
| $K_4[Ru(CN)_6]$ | $5.0 \times 10^{-6}$ mol/mol AgX |
| Exemplified compound S-2-5 | $3.0 \times 10^{-5}$ mol/mol AgX |
| Potassium bromide | 0.67 g |
| Water | to make 420 ml |

(A13a Solution)

| | |
|---|---|
| Sodium chloride | 30.6 g |
| Potassium bromide | 0.83 g |
| Exemplified compound S-2-5 | $2.7 \times 10^{-6}$ mol/mol AgX |
| Water | to make 180 ml |

Preparation of Silver Halide Emulsion (B-16)

Silver Halide Emulsion (B-16) was prepared in the same manner as Silver Halide Emulsion (B-15), except that the following (C11 solution) was added from an adding nozzle provided to be close to an adding nozzle for (A13a solution), at the point of time of adding 10% of (B13 solution).

(C11 Solution)

| | |
|---|---|
| Potassium bromide | 4.34 g |
| Water | to make 364 ml |

Preparation of Silver Halide Emulsion (B-17)

Silver Halide Emulsion (B-17) was prepared in the same manner as Silver Halide Emulsion (B-16), except that the following (D11 solution) was added from an adding nozzle provided to be close to an adding nozzle for (A13a solution), at the point of time of adding 60% of (B13 solution).

(D11 Solution)

| | |
|---|---|
| Potassium iodide | 0.15 g |
| Water | to make 36 ml |

Preparation of Silver Halide Emulsion (B-18)

Silver Halide Emulsion (B-18) was prepared in the same manner Silver Halide Emulsion (B-17), except that (A12c solution) was used in place of (A12b solution), and addition of (B12 solution) and (A12c solution) was interrupted at the point of time of adding 70% of (B12 solution), then, the following (E11 solution) was added from an adding nozzle provided to be close to an adding nozzle for (A12c solution), and addition of (B12 solution) and (A12c solution) was started again.

(A12c Solution)

| | |
|---|---|
| Sodium chloride | 71.9 g |
| $K_2[IrCl_6]$ | $1.2 \times 10^{-9}$ mol/mol AgX |
| $K_2[IrBr_6]$ | $1.0 \times 10^{-9}$ mol/mol AgX |
| $K_4[Ru(CN)_6]$ | $5.0 \times 10^{-6}$ mol/mol AgX |
| Exemplified compound S-2-5 | $3.0 \times 10^{-5}$ mol/mol AgX |
| Potassium bromide | 0.67 g |
| Water | to make 420 ml |

(E11 Solution)

| | |
|---|---|
| $K_2[IrCl_5(H_2O)]$ | $7.8 \times 10^{-7}$ mol/mol AgX |
| $K_2[IrCl_5(thia)]$ | $1.0 \times 10^{-7}$ mol/mol AgX |
| Water | to make 30 ml |

Preparation of Silver Halide Emulsion (B-19)

Silver Halide Emulsion (B-19) was prepared in the same manner as Silver Halide Emulsion (B-19), except that the following (E12 solution) was used in place of (E11 solution).

(E12 Solution)

| | |
|---|---|
| $K_2[IrCl_5(H_2O)]$ | $1.8 \times 10^{-6}$ mol/mol AgX |
| Water | to make 30 ml |

Preparation of Silver Halide Emulsions (BB-11)–(BB-19)

Silver Halide Emulsions (BB-11)–(BB-19) each having an average grain diameter of 0.44 μm were prepared in the same manner as in the preparation of the Silver Halide Emulsions (B-11)–(B-19), except that an amount of each of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A12 solution), (A12a solution), (A12b solution), (A12c solution), (E11 solution), (E12 solution), (F11 solution) and (F12 solution) was changed to be 1.5 times the original amount, and time of addition for each of (A11 solution), (A12 solution), (A12a solution), (A12b solution), (A12c solution), (A13 solution), (A13a solution), (B11 solution), (B12 solution) and (B13 solution) was changed properly.

Preparation of Silver Halide Emulsions (G-11)–(G-19)

Silver Halide Emulsions (G-11)–(G-19) each having an average grain diameter of 0.42 μm were prepared in the same manner as in the preparation of Silver Halide Emulsions (B-11)–(B-19), except that an amount of each of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A12 solution), (A12a solution), (A12b solution), (A12c solution), (E11 solution), (E12 solution), (F11 solution) and (F12 solution) was changed to be 1.7 times the original amount, and time of addition for each of (A11 solution), (A12 solution), (A12a solution), (A12b solution), (A12c solution), (A13 solution), (A13a solution), (B11 solution), (B12 solution) and (B13 solution) was changed properly.

Preparation of Silver Halide Emulsions (GG-11)–(GG-19)

Silver Halide Emulsions (GG-11)–(GG-19) each having an average grain diameter of 0.36 μm were prepared in the same manner as in the preparation of the Silver Halide Emulsions (B-11)–(B-19), except that an amount of each of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A12 solution), (A12a solution), (A12b solution), (A12c solution), (E11 solution), (E12 solution), (F11 solution) and (F12 solution) was changed to be 2.7 times the original amount, and time of addition for each of (A11 solution), (A12 solution), (A12a solution), (A12b solution), (A12c solution), (A13 solution), (A13a solution), (B11 solution), (B12 solution) and (B13 solution) was changed properly.

Preparation of Silver Halide Emulsions (R-11)–(R-19))

Silver Halide Emulsions (R-11)–(R-19) each having an average grain diameter of 0.40 μm were prepared in the same manner as in the preparation of Silver Halide Emulsions (B-11)–(B-19), except that an amount of each of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A12 solution), (A12a solution), (A12b solution), (A12c solution), (E11 solution), (E12 solution), (F11 solution) and (F12 solution) was changed to be 2.0 times the original amount, and time of addition for each of (A11 solution), (A12 solution), (A12a solution), (A12b solution), (A12c solution), (A13 solution), (A13a solution), (B11 solution), (B12 solution) and (B13 solution) was changed properly.

Preparation of Silver Halide Emulsions (RR-11)–(RR-19)

Silver Halide Emulsions (RR-11)–(RR-19) each having an average grain diameter of 0.33 μm were prepared in the same manner as Silver Halide Emulsions (B-11)–(B-19), except that an amount of each of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A12 solution), (A12a solution), (A12b solution), (A12c solution), (E11 solution), (E12 solution), (F11 solution) and (F12 solution) was changed to be 3.5 times the original amount, and time of addition for each of (A11 solution), (A12 solution), (A12a solution), (A12b solution), (A12c solution), (A13 solution), (A13a solution), (B11 solution), (B12 solution) and (B13 solution) was changed properly.

In each of Silver Halide Emulsions (B-11)–(B-19), (BB-11)–(BB-19), (G-11)–(G-19), (GG-11)–(GG-19), (R-11)–(R-19) and (RR-11)–(RR-19), a percentage of 99% or more in terms of the number of silver halide particles was occupied by cubic particles. Other characteristics are shown in Tables 6 and 7, and each value of the characteristic described in Tables 6 and 7 is based on measurement conducted in accordance with the method described above in the same way as in Example 1. Further, details of each abbreviation described in Tables 6 and 7 are the same in terms of meaning as those in Tables 1 and 2.

Preparation of Photosensitive Silver Halide Emulsion

Preparation of Blue-sensitive Silver Halide Emulsions (B-11a)–(B-19a)

Under the conditions of 65° C., pH5.8 and pAg7.5, sensitizing dyes BS-1 and BS-2 were added to the prepared Silver Halide Emulsions (B-11)–(B-19), and then, sodium thiosulfate and chloroauric acid were added in succession, to conduct spectral sensitization and chemical sensitization. When ripening was performed optimally after adding chemical sensitizers, exemplified compounds S-2-5, S-2-2 and S-2-3 were added successively to stop the ripening, whereby, Blue-sensitive Silver Halide Emulsions (B-11a)–(B-19a) were obtained.

| | |
|---|---|
| Sodium thiosulfate | $9.1 \times 10^{-6}$ mol/mol AgX |
| Chloroauric acid | $2.6 \times 10^{-5}$ mol/mol AgX |
| Exemplified compound S-2-5 | $2.0 \times 10^{-4}$ mol/mol AgX |
| Exemplified compound S-2-2 | $2.0 \times 10^{-4}$ mol/mol AgX |
| Exemplified compound S-2-3 | $2.0 \times 10^{-4}$ mol/mol AgX |
| Sensitizing dye: BS-1 | $7.3 \times 10^{-4}$ mol/mol AgX |
| Sensitizing dye: BS-2 | $1.8 \times 10^{-4}$ mol/mol AgX |

Preparation of Blue-sensitive Silver Halide Emulsion (B-19b)

Blue-sensitive Silver Halide Emulsion (B-19b) was obtained in the same manner as Blue-sensitive Silver Halide Emulsion (B-19a), except that $1.2\times10^{-6}$ mol/mol AgX of exemplified compound 1-21 was added after adding sensitizing dyes (BS-1) and (BS-2) and before adding sodium thiosulfate.

Preparation of Blue-sensitive Silver Halide Emulsion (B-19c)

Blue-sensitive Silver Halide Emulsion (B-19c) was obtained in the same manner as Blue-sensitive Silver Halide Emulsion (B-19b), except that an added amount of sodium thiosulfate was changed to $5.5\times10^{-6}$ mol/mol AgX, and chloroauric acid was added after $3.6\times10^{-6}$ mol/mol Ag of trifurylphosphine selenide was added after adding sodium thiosulfate.

Preparation of Blue-sensitive Silver Halide Emulsions (BB-11a)–(BB-19a), (BB-19b) and (BB-19c)

Blue-sensitive Silver Halide Emulsions (BB-11a)–(BB-19a), (BB-19b) and (BB-19c) were obtained in the same manner as Blue-sensitive Silver Halide Emulsions (B-11a)–(B-19a), (B-19b) and (B-19c), except that Silver Halide Emulsions (B-11)–(B-19) were replaced successively with the Silver Halide Emulsions (BB-11)–(BB-19), and added amounts of sodium thiosulfate, trifurylphosphine selenide, chloroauric acid, sensitizing dye (BS-1) and sensitizing dye (BS-2) were changed respectively so that an added amount per a surface area may become the same, considering changes in the surface area of the silver halide particle caused by a change of an average grain diameter of silver halide particles from 0.50 μm to 0.44 μm.

Preparation of Green-sensitive Silver Halide Emulsions (G-11a)–(G-19a)

Under the conditions of 65° C., pH5.8 and pAg7.5, sensitizing dyes GS-1 was added to the Silver Halide Emulsions (G-11)–(G-19), and then, sodium thiosulfate and chloroauric acid were added in succession, to conduct spectral sensitization and chemical sensitization. When ripening was completed after adding chemical sensitizers, exemplified compound. S-2-5 was added to stop the ripening, whereby, Green-sensitive Silver Halide Emulsions (G-11a)–(G-19a) were obtained.

| | |
|---|---|
| Sensitizing dye: GS-1 | $7.0 \times 10^{-4}$ mol/mol AgX |
| Sodium thiosulfate | $7.3 \times 10^{-6}$ mol/mol AgX |
| Chloroauric acid | $2.0 \times 10^{-5}$ mol/mol AgX |
| Exemplified compound S-2-5 | $1.5 \times 10^{-4}$ mol/mol AgX |

Preparation of Green-sensitive Silver Halide Emulsion (G-19b)

Green-sensitive Silver Halide Emulsion (G-19b) was obtained in the same manner as Green-sensitive Silver Halide Emulsion (G-19a), except that $1.3\times10^{-6}$ mol/mol AgX of exemplified compound 1-21 was added, and chloroauric acid was added after adding sensitizing dye (GS-1) and before adding sodium thiosulfate.

Preparation of Green-sensitive Silver Halide Emulsion (G-19c)

Green-sensitive Silver Halide Emulsion (G-19c) was obtained in the same manner as Green-sensitive Silver Halide Emulsion (G-19b), except that an added amount of sodium thiosulfate was changed to $4.4\times10^{-6}$ mol/mol AgX, and chloroauric acid was added after $2.6\times10^{-6}$ mol/mol AgX of trifurylphosphine selenide was added after adding sodium thiosulfate.

Preparation of Green-sensitive Silver Halide Emulsions (GG-11a)–(GG-19a), (GG-19b) and (GG-19c)

Green-sensitive Silver Halide Emulsions (GG-11a)–(GG-19a), (GG-19b) and (GG-19c) were obtained in the same way as in the preparation of green sensitive Silver Halide Emulsions (G-11a)–(G-19a), (G-19b) and (G-19c), except that Silver Halide Emulsions (G-11)–(G-18) were replaced successively with the Silver Halide Emulsions (GG-11)–(GG-19), and added amounts of sodium thiosulfate, trifurylphosphine selenide, chloroauric acid, sensitizing dye (GS-1) and sensitizing dye (BS-2) were changed respectively so that an added amount per a surface area may become the same, considering changes in the surface area of the silver halide particle caused by a change of an average grain diameter of silver halide particles from 0.42 μm to 0.36 μm.

Preparation of Red-sensitive Silver Halide Emulsions (R-11a)–(R-19a)

Under the conditions of 65° C., pH5.0 and pAg7.1, sensitizing dyes RS-1 and RS-2 were added to the prepared Silver Halide Emulsions (R-11)–(R-19), and then, sodium thiosulfate and chloroauric acid were added in succession, to conduct spectral sensitization and chemical sensitization. When ripening was completed after adding chemical sensitizers, exemplified compound S-2-5 was added to stop the ripening, whereby, Red-sensitive Silver Halide Emulsions (R-11a)–(R-19a) were obtained.

| | |
|---|---|
| Sodium thiosulfate | $1.1 \times 10^{-5}$ mol/mol AgX |
| Chloroauric acid | $1.7 \times 10^{-5}$ mol/mol AgX |
| Exemplified compound S-2-5 | $1.2 \times 10^{-4}$ mol/mol AgX |
| Sensitizing dye: RS-1 | $1.2 \times 10^{-4}$ mol/mol AgX |
| Sensitizing dye: RS-2 | $1.2 \times 10^{-4}$ mol/mol AgX |

Preparation of Red-sensitive Silver Halide Emulsion (R-19b)

Red-sensitive Silver Halide Emulsion (R-19b) was obtained in the same manner as Red-sensitive Silver Halide Emulsion (R-19a), except that $1.3\times10^{-6}$ mol/mol AgX of exemplified compound 1-21 was added after adding sensitizing dyes (RS-1) and (RS-2) and before adding sodium thiosulfate.

Preparation of Red-sensitive Silver Halide Emulsion (R-19c)

Red-sensitive Silver Halide Emulsion (R-19c) was obtained in the same manner as Red-sensitive Silver Halide Emulsion (R-19b), except that an added amount of sodium thiosulfate was changed to $6.5\times10^{-6}$ mol/mol AgX, and chloroauric acid was added after $4.5\times10^{-6}$ mol/mol AgX of trifurylphosphine selenide was added after adding sodium thiosulfate.

Preparation of Red-sensitive Silver Halide Emulsions (RR-11a)–(RR-19a), (RR-19b) and (RR-19c)

Red-sensitive Silver Halide Emulsions (RR-11a)–(RR-19a), (RR-19b) and (RR-19c) were obtained in the same manner as Red-sensitive Silver Halide Emulsions (R-11a)–(R-19a), (R-19b) and (R-19c), except that Silver Halide Emulsions (R-11)–(R-19) were replaced respectively with the Silver Halide Emulsions (RR-11)–(RR-19), and added amounts of sodium thiosulfate, trifurylphosphine selenide, chloroauric acid, sensitizing dye (RS-1) and sensitizing dye (RS-2) were changed respectively so that an added amount per a surface area may become the same, considering changes in the surface area of the silver halide particle caused by a change of an average grain diameter of silver halide particles from 0.40 μm to 0.33 μm.

Incidentally, in the preparation of each Red-sensitive Silver Halide Emulsion, $2.0\times10^{-3}$ mol/mol AgX of SS-1 was added when the preparation was finished.

Preparation of Silver Halide Photosensitive Material

Preparation of Sample 201–211

Samples 201–211 were prepared in the same manner as Sample 101 described in Example 1, except that each of Blue-sensitive Silver Halide Emulsion the first layer (being a blue-sensitive layer), Green-sensitive Silver Halide Emulsion on the third layer (being a green-sensitive layer), and Red-sensitive Silver Halide Emulsion on the fifth layer (being a red-sensitive layer) was changed to a combination of Silver Halide Emulsions described in Table 8.

TABLE 7

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| GG-11 | 0.36 | 0.07 | 99.30 | 0.70 | 0 | 28 | — | 0.77 | 0.88 | 0.88 | |
| GG-12 | 0.36 | 0.07 | 99.30 | 0.70 | 0 | 28 | — | 0.46 | 0.78 | 0.59 | |
| GG-13 | 0.36 | 0.07 | 99.30 | 0.70 | 0 | 28 | — | 0.17 | 0.78 | 0.22 | |
| GG-14 | 0.36 | 0.07 | 99.30 | 0.70 | 0 | 28 | — | 0.08 | 0.73 | 0.11 | |
| GG-15 | 0.36 | 0.07 | 99.30 | 0.70 | 0 | 28 | — | 0.03 | 0.41 | 0.073 | |
| GG-16 | 0.36 | 0.07 | 97.30 | 2.70 | 0 | 14 | — | 0.03 | 0.42 | 0.071 | Character 1 |
| GG-17 | 0.36 | 0.07 | 97.25 | 2.70 | 0.05 | 14 | 14 | 0.03 | 0.42 | 0.071 | Character 2 |
| GG-18 | 0.36 | 0.07 | 97.25 | 2.70 | 0.05 | 14 | 14 | 0.04 | 0.44 | 0.091 | Character 2 |
| GG-19 | 0.36 | 0.07 | 97.25 | 2.70 | 0.05 | 14 | 14 | 0.04 | 0.24 | 0.17 | Character 2 |
| R-11 | 0.40 | 0.07 | 99.30 | 0.70 | 0 | 26 | — | 0.75 | 0.90 | 0.83 | |
| R-12 | 0.40 | 0.07 | 99.30 | 0.70 | 0 | 26 | — | 0.48 | 0.79 | 0.61 | |
| R-13 | 0.40 | 0.07 | 99.30 | 0.70 | 0 | 26 | — | 0.19 | 0.81 | 0.23 | |
| R-14 | 0.40 | 0.07 | 99.30 | 0.70 | 0 | 26 | — | 0.07 | 0.72 | 0.097 | |
| R-15 | 0.40 | 0.07 | 99.30 | 0.70 | 0 | 26 | — | 0.02 | 0.40 | 0.050 | |
| R-16 | 0.40 | 0.07 | 97.30 | 2.70 | 0 | 15 | — | 0.02 | 0.41 | 0.049 | Character 1 |
| R-17 | 0.40 | 0.07 | 97.25 | 2.70 | 0.05 | 15 | 16 | 0.02 | 0.41 | 0.049 | Character 2 |
| R-18 | 0.40 | 0.07 | 97.25 | 2.70 | 0.05 | 15 | 16 | 0.03 | 0.40 | 0.075 | Character 2 |
| R-19 | 0.40 | 0.07 | 97.25 | 2.70 | 0.05 | 15 | 16 | 0.04 | 0.22 | 0.18 | Character 2 |
| RR-11 | 0.33 | 0.07 | 99.30 | 0.70 | 0 | 28 | — | 0.79 | 0.87 | 0.91 | |
| RR-12 | 0.33 | 0.07 | 99.30 | 0.70 | 0 | 28 | — | 0.45 | 0.76 | 0.59 | |
| RR-13 | 0.33 | 0.07 | 99.30 | 0.70 | 0 | 28 | — | 0.17 | 0.76 | 0.22 | |
| RR-14 | 0.33 | 0.07 | 99.30 | 0.70 | 0 | 28 | — | 0.06 | 0.73 | 0.082 | |
| RR-15 | 0.33 | 0.07 | 99.30 | 0.70 | 0 | 28 | — | 0.02 | 0.40 | 0.050 | |
| RR-16 | 0.33 | 0.07 | 97.30 | 2.70 | 0 | 14 | — | 0.02 | 0.42 | 0.048 | Character 1 |
| RR-17 | 0.33 | 0.07 | 97.25 | 2.70 | 0.05 | 14 | 15 | 0.02 | 0.42 | 0.048 | Character 2 |
| RR-18 | 0.33 | 0.07 | 97.25 | 2.70 | 0.05 | 14 | 15 | 0.03 | 0.41 | 0.073 | Character 2 |
| RR-19 | 0.33 | 0.07 | 97.25 | 2.70 | 0.05 | 14 | 15 | 0.03 | 0.20 | 0.15 | Character 2 |

Evaluation of Characteristics

Samples 201–211 prepared above were evaluated with respect to sensitivity, latent image stability, processing stability and resistance to radioactive rays of Blue-sensitive Layer in the same manner described in Example 1, the obtained results of which are shown in Table 8.

TABLE 8

| Sample No. | Photosensitive silver halide constitution First layer (blue-sensitive layer) | Third layer (green-sensitive layer) | Fifth layer (red-sensitive layer | Latent image stability ΔS1 | Processing stability ΔS2 | Resistance to radioactive rays Fogging density increasing rate | Remarks |
|---|---|---|---|---|---|---|---|
| 201 | B-11a/BB-11a | G-11a/GG-11a | R-11a/RR-11a | 100 | 100 | 100 | Comp. |
| 202 | B-12a/BB-12a | G-12a/GG-12a | R-12a/RR-12a | 97 | 99 | 96 | Comp. |

TABLE 8-continued

| Sample No. | Photosensitive silver halide constitution: First layer (blue-sensitive layer) | Third layer (green-sensitive layer) | Fifth layer (red-sensitive layer | Latent image stability ΔS1 | Processing stability ΔS2 | Resistance to radioactive rays Fogging density increasing rate | Remarks |
|---|---|---|---|---|---|---|---|
| 203 | B-13a/BB-13a | G-13a/GG-13a | R-13a/RR-13a | 76 | 86 | 85 | Inv. |
| 204 | B-14a/BB-14a | G-14a/GG-14a | R-14a/RR-14a | 65 | 82 | 81 | Inv. |
| 205 | B-15a/BB-15a | G-15a/GG-15a | R-15a/RR-15a | 52 | 78 | 78 | Inv. |
| 206 | B-16a/BB-16a | G-16a/GG-16a | R-16a/RR-16a | 44 | 75 | 78 | Inv. |
| 207 | B-17a/BB-17a | G-17a/GG-17a | R-17a/RR-17a | 37 | 74 | 75 | Inv. |
| 208 | B-18a/BB-18a | G-18a/GG-18a | R-18a/RR-18a | 35 | 68 | 74 | Inv. |
| 209 | B-19a/BB-19a | G-19a/GG-19a | R-19a/RR-19a | 30 | 68 | 72 | Inv. |
| 210 | B-19b/BB-19b | G-19b/GG-19b | R-19b/RR-19b | 28 | 66 | 71 | Inv. |
| 211 | B-19c/BB-19c | G-19c/GG-19c | R-19c/RR-19c | 25 | 66 | 69 | Inv. |

Comp.: Comparative example
Inv.: This invention

As is apparent from the results described in Table 8, it is understood that samples employing the Silver Halide Emulsion of the invention show a small width of sensitivity fluctuations even when a period of time from exposure to photographic processing is changed, and they are excellent in terms of latent image stability, process stability under the rapid processing condition (sensitivity fluctuations) and of resistance against radiation.

Further, as a result of the evaluation conducted for a green sensitive layer (magenta image) and a red image (cyan image) equally in accordance with the aforementioned way, it was possible to confirm the same effect as that of the blue sensitive layer described in Table 8.

Example 3

Preparation of a Silver Halide Emulsion

Preparation of Silver Halide Emulsion (B-21)

(A21 solution) and (B21 solution) shown below were added simultaneously through a double-jet precipitation method by controlling to pAg of 7.4 and pH of 3.0 by spending 7 minutes, while stirring hard 1.5 liters of 2% aqueous solution of amphoterically deionized ossein gelatin (calcium content 10 ppm) kept at 40° C., by using a mixing and stirring machine described in JP-A 62-160128. Then, the following (A22 solution) and (B22 solution) were added simultaneously by controlling to pAg of 8.0 and pH of 5.5 by spending 70 minutes. After that, the following (A23 solution) and (B23 solution) were added simultaneously by controlling to pAg of 8.0 and pH of 5.5 by spending 20 minutes. In this case, pAg was controlled by the method described in JP-A 59-45437, and pH was controlled by using sulfuric acid or sodium hydroxide.

(A21 Solution)

| | |
|---|---|
| Sodium chloride | 3.43 g |
| Potassium bromide | 0.021 g |
| Water | to make 200 ml |

(A22 Solution)

| | |
|---|---|
| Sodium chloride | 61.5 g |
| $K_2[IrCl_6]$ | $3.0 \times 10^{-8}$ mol/mol AgX |
| $K_2[IrBr_6]$ | $1.4 \times 10^{-8}$ mol/mol AgX |
| $K_2[Ru(CN)_6]$ | $5.4 \times 10^{-5}$ mol/mol AgX |
| Potassium bromide | 0.96 g |
| Water | to make 360 ml |

(A23 Solution)

| | |
|---|---|
| Sodium chloride | 40.7 g |
| Potassium bromide | 1.19 g |
| Water | to make 180 ml |

(B21 Solution)

| | |
|---|---|
| Silver nitrate | 10 g |
| Water | to make 200 ml |

(B22 Solution)

| | |
|---|---|
| Silver nitrate | 180 g |
| Water | to make 360 ml |

(B23 Solution)

| | |
|---|---|
| Silver nitrate | 120 g |
| Water | to make 240 ml |

After completion of addition, 15% aqueous solution containing 30 g of chemically modified gelatin (modification rate 95%) wherein an amino group was phenyl-carbamoylated by using a method described in JP-A 5-72658 was added for desalting, and then, is mixed with gelatin solution to prepare Silver Halide Emulsion (B-21) having an average grain diameter of 0.45 μm.

Preparation of Silver Halide Emulsion (B-22)

Silver Halide Emulsion (B-22) was prepared in the same manner as Silver Halide Emulsion (B-21), except that (A22 solution) was replaced with the following (A22a solution).

(A22a Solution)

| | |
|---|---|
| Sodium chloride | 61.5 g |
| $K_2[IrCl_6]$ | $1.8 \times 10^{-8}$ mol/mol AgX |
| $K_2[IrBr_6]$ | $2.8 \times 10^{-9}$ mol/mol AgX |
| $K_2[IrCl_5(thia)]$ | $1.6 \times 10^{-7}$ mol/mol AgX |
| $K_2[IrCl_5(H_2O)]$ | $2.0 \times 10^{-7}$ mol/mol AgX |
| $K_4[Ru(CN)_6]$ | $5.4 \times 10^{-6}$ mol/mol AgX |
| Potassium bromide | 0.96 g |
| Water | to make 360 ml |

Preparation of Silver Halide Emulsion (B-23)

Silver Halide Emulsion (B-23) was prepared in the same manner Silver Halide Emulsion (B-22), except that (A22a solution) was replaced by the following (A22b solution), and addition of (B23 solution) and (A23 solution) was stopped when 95% of addition of (B23 solution) was completed, then, (F22 solution) was added from the adding nozzle provided in the vicinity of an addition nozzle for (A23 solution), and then, addition of (B23 solution) and (A23 solution) was started again.

(A22b Solution)

| | |
|---|---|
| Sodium chloride | 61.5 g |
| $K_2[IrCl_6]$ | $1.6 \times 10^{-8}$ mol/mol AgX |
| $K_2[IrBr_6]$ | $2.5 \times 10^{-9}$ mol/mol AgX |
| $K_2[IrCl_5(thia)]$ | $3.2 \times 10^{-7}$ mol/mol AgX |
| $K_4[Ru(CN)_6]$ | $5.2 \times 10^{-6}$ mol/mol AgX |
| Potassium bromide | 0.96 g |
| Water | to make 360 ml |

(F21 Solution)

| | |
|---|---|
| $K_2[IrCl_5(H_2O)]$ | $5.0 \times 10^{-8}$ mol/mol AgX |
| Water | to make 20 ml |

Preparation of Silver Halide Emulsion (B-24)

Silver Halide Emulsion (B-24) was prepared in the same manner as Silver Halide Emulsion (B-22), except that (A22a solution) and (23 solution) were replaced by the following (A22c solution) and (23a solution) respectively, and addition of (B23 solution) and (A23a solution) was stopped when 95% of (B23 solution) was added, and then, addition of (B23 solution) and (A23a solution) was started again, after the following (F22 solution) was added from an adding nozzle provided near an adding nozzle for (A23a solution).

(A22c Solution)

| | |
|---|---|
| Sodium chloride | 61.5 g |
| $K_2[IrCl_6]$ | $1.6 \times 10^{-8}$ mol/mol AgX |
| $K_2[IrBr_6]$ | $2.5 \times 10^{-9}$ mol/mol AgX |
| $K_2[IrCl_5(thia)]$ | $3.2 \times 10^{-7}$ mol/mol AgX |
| $K_4[Ru(CN)_6]$ | $5.2 \times 10^{-6}$ mol/mol AgX |
| Potassium bromide | 0.96 g |
| Exemplified compound S-2-5 | $1.5 \times 10^{-5}$ mol/mol AgX |
| Water | to make 360 ml |

(A23a Solution)

| | |
|---|---|
| Sodium chloride | 40.7 g |
| Potassium bromide | 1.19 g |
| Exemplified compound S-2-5 | $1.8 \times 10^{-5}$ mol/mol AgX |
| Water | to make 180 ml |

(F22 Solution)

| | |
|---|---|
| $K_2[IrCl_5(H_2O)]$ | $1.8 \times 10^{-7}$ mol/mol AgX |
| Water | to make 20 ml |

Preparation of Silver Halide Emulsion (B-25)

Silver Halide Emulsion (B-25) was prepared in the same manner as Silver Halide Emulsion (B-24), except that the following (A22d solution) and (F23 solution) were used in place of (A22c solution) and (F22 solution) respectively.

(A22d Solution)

| | |
|---|---|
| Sodium chloride | 61.5 g |
| $K_2[IrCl_6]$ | $1.3 \times 10^{-8}$ mol/mol AgX |
| $K_2[IrBr_6]$ | $2.0 \times 10^{-9}$ mol/mol AgX |
| $K_2[IrCl_5(thia)]$ | $4.0 \times 10^{-7}$ mol/mol AgX |
| $K_4[Ru(CN)_6]$ | $5.6 \times 10^{-6}$ mol/mol AgX |
| Potassium bromide | 0.96 g |
| Exemplified compound S-2-5 | $1.5 \times 10^{-5}$ mol/mol AgX |
| Water | to make 360 ml |
| (F23 solution) | |
| $K_2[IrCl_5(H_2O)]$ | $2.3 \times 10^{-7}$ mol/mol AgX |
| Water | to make 20 ml |

Preparation of Silver Halide Emulsion (B-26)

Silver Halide Emulsion (B-26) was prepared in the same manner as Silver Halide Emulsion (B-24), except that the following (C21 solution) was added from an adding nozzle provided near an adding nozzle for (A23a solution) when 15% of (B13 solution) was added.

(C21 Solution)

| | |
|---|---|
| Potassium bromide | 4.34 g |
| Water | to make 364 ml |

Preparation of Silver Halide Emulsion (B-27)

Silver Halide Emulsion (B-27) was prepared in the same manner as Silver Halide Emulsion (B-25), except that the following (C21 solution) was added from an adding nozzle provided near an adding nozzle for (A23a solution) when 15% of (B13 solution) was added.

Preparation of Silver Halide Emulsion (B-28)

Silver Halide Emulsion (B-27) was prepared in the same manner as Silver Halide Emulsion (B-26), except that the following (D21 solution) was added from an adding nozzle provided near an adding nozzle for (A23a solution) when 60% of (B23 solution) was added.

(D21 Solution)

| | |
|---|---|
| Potassium iodide | 0.15 g |
| Water | to make 36 ml |

Preparation of Silver Halide Emulsion (B-29)

Silver Halide Emulsion (B-28) was prepared in the same manner as Silver Halide Emulsion (B-27), except that the foregoing (D21 solution) was added from an adding nozzle provided near an adding nozzle for (A23a solution) when 60% of (B23 solution) was added.

Preparation of Silver Halide Emulsions (BB-21)–(BB-29)

Silver Halide Emulsions (BB-21)–(BB-29) each having an average grain diameter of 0.40 μm were prepared in the same way as in the preparation of Silver Halide Emulsions (B-21)–(B-29), except that each of the amount of $K_2[IrCl_6]$, $K_2[IrBr_6]$, $K_2[IrCl_5(thia)]$, $K_2[IrCl_5(H_2O)]$ and $K_4[Ru(CN)_6]$ respectively in (A22 solution), (A22a solution), (A22b solution), (A22c solution), (A22d solution), (F21 solution), (F22 solution), (F23 solution) respectively, was increased by a factor of 1.3, and also each addition time of (A21 solution), (A22 solution), (A22a solution), (A22b solution), (A22c solution), (A22d solution), (A23 solution), (A23a solution), (B21 solution), (B22 solution) and (B2 solution) was appropriately changed, to obtain Silver Halide Emulsions (BB-21–BB29) exhibiting an average grain diameter of 0.40 μm.

Preparation of Silver Halide Emulsions (G-21)–(G-29)

Silver Halide Emulsions (G-21)–(G-29) were prepared in the same manner as foregoing Silver Halide Emulsions (B-21)–(B-29), except that each of the amounts of $K_2[IrCl_6]$, $K_2[IrBr_6]$, $K_2[IrCl_5(thia)]$, $K_2[IrCl_5(H_2O)]$ and $K_4[Ru(CN)_6]$ in (A22 Solution), (A22a Solution), (A22b Solution), (A22c Solution), (A22d Solution), (F21 Solution), (F22 Solution) and (F23 Solution), respectively, was increased by a factor of 1.8, and also each addition time of (A21 Solution), (A22 Solution), (A22a Solution), (A22b Solution), (A22c Solution), (A22d Solution), (A23 Solution), (A23a Solution), (B-21 Solution), (B22 Solution) and (B23 Solution) was appropriately changed, to obtain Silver Halide Emulsions (G-21)–(G-29) exhibiting an average grain diameter of 0.35 μm.

Preparation of Silver Halide Emulsions (GG-21)–(GG-29)

Silver Halide Emulsions (GG-21)–(GG-29) were prepared in the same manner as foregoing Silver Halide Emulsions (B-21)–(B-29), except that each of the amounts of $K_2[IrCl_6]$, $K_2[IrBr_6]$, $K_2[IrCl_5(thia)]$, $K_2[IrCl_5(H_2O)]$ and $K_4[Ru(CN)_6]$ in (A22 Solution), (A22a Solution), (A22b Solution), (A22c Solution), (A22d Solution), (F21 Solution), (F22 Solution) and (F23 Solution), respectively, was increased by a factor of 2.8, and also each addition time of (A21 Solution), (A22 Solution), (A22a Solution), (A22b Solution), (A22c Solution), (A22d Solution), (A23 Solution), (A23a Solution), (B-21 Solution), (B22 Solution) and (B23 Solution) was appropriately changed, to obtain Silver Halide Emulsions (GG-21)–(GG-29) exhibiting an average grain diameter of 0.30 μm.

Preparation of Silver Halide Emulsions (R-21)–(R-29)

Silver Halide Emulsions (R-21)–(R-29) were prepared in the same manner as foregoing Silver Halide Emulsions (B-21)–(B-29), except that each of the amounts of $K_2[IrCl_6]$, $K_2[IrBr_6]$, $K_2[IrCl_5(thia)]$, $K_2[IrCl_5(H_2O)]$ and $K_4[Ru(CN)_6]$ in (A22 Solution), (A22a Solution), (A22b Solution), (A22c Solution), (A22d Solution), (F21 Solution), (F22 Solution) and (F23 Solution), respectively, was increased by a factor of 2.7, and also each addition time of (A21 Solution), (A22 Solution), (A22a Solution), (A22b Solution), (A22c Solution), (A22d Solution), (A23 Solution), (A23a Solution), (B-21 Solution), (B22 Solution) and (B23 Solution) was appropriately changed, to obtain Silver Halide Emulsions (R-21)-(R-29) exhibiting an average grain diameter of 0.32 μm.

Preparation of Silver Halide Emulsions (RR-21)–(RR-29)

Silver Halide Emulsions (RR-21)–(RR-29) were prepared in the same manner as foregoing Silver Halide Emulsions (B-21)–(B-29), except that each of the amounts of $K2[IrCl_6]$, $K_2[IrBr_6]$, $K_2[IrCl_5(thia)]$, $K_2[IrCl_5(H_2O)]$ and $K_4[Ru(CN)_6]$ in (A22 Solution), (A22a Solution), (A22b Solution), (A22c Solution), (A22d Solution), (F21 Solution), (F22 Solution) and (F23 Solution), respectively, was increased by a factor of 2.7, and also each addition time of (A21 Solution), (A22 Solution), (A22a Solution), (A22b Solution), (A22c Solution), (A22d Solution), (A23 Solution), (A23a Solution), (B-21 Solution, (B22 Solution) and (B23 Solution) was appropriately changed, to obtain Silver Halide Emulsions (R-21)–(R-29) exhibiting and average grain diameter of 0.28 μm.

In Silver Halide Emulsions (B-21)–(B-29), (BB-21)–(BB-29), (G-21)–(G-29), (GG-21)–(GG-29), (R-21)–(R-29), and (RR-21)–(RR-29), prepared as above, at least 99% by number of the silver halide grains was accounted for by cubic silver halide grains. The other characteristics are shown in Tables 9 and 10, the characteristic values were determined based on the methods described above, being the same as in Example 1. Further, the composition abbreviations described in Tables 9 and 10 were the same as those in Tables 1 and 2.

TABLE 9

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| B-21 | 0.45 | 0.06 | 99.00 | 1.00 | 0 | 27 | — | 0.82 | 0.90 | 0.91 | |
| B-22 | 0.45 | 0.06 | 99.00 | 1.00 | 0 | 27 | — | 0.52 | 0.80 | 0.65 | |
| B-23 | 0.45 | 0.06 | 99.00 | 1.00 | 0 | 27 | — | 0.38 | 0.81 | 0.47 | |
| B-24 | 0.45 | 0.06 | 99.00 | 1.00 | 0 | 27 | — | 0.19 | 0.76 | 0.25 | |
| B-25 | 0.45 | 0.06 | 99.00 | 1.00 | 0 | 27 | — | 0.22 | 0.46 | 0.48 | |
| B-26 | 0.45 | 0.06 | 97.00 | 3.00 | 0 | 15 | — | 0.19 | 0.76 | 0.25 | Character 1 |
| B-27 | 0.45 | 0.06 | 97.00 | 3.00 | 0 | 15 | — | 0.22 | 0.46 | 0.48 | Character 2 |
| B-28 | 0.45 | 0.06 | 97.00 | 3.00 | 0 | 15 | — | 0.19 | 0.76 | 0.25 | Character 2 |
| B-29 | 0.45 | 0.06 | 96.95 | 3.00 | 0.05 | 15 | 15 | 0.22 | 0.46 | 0.48 | Character 2 |
| BB-21 | 0.40 | 0.06 | 99.00 | 1.00 | 0 | 26 | — | 0.80 | 0.90 | 0.89 | |
| BB-22 | 0.40 | 0.06 | 99.00 | 1.00 | 0 | 26 | — | 0.54 | 0.80 | 0.68 | |

TABLE 9-continued

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| BB-23 | 0.40 | 0.06 | 99.00 | 1.00 | 0 | 26 | — | 0.40 | 0.81 | 0.49 | |
| BB-24 | 0.40 | 0.06 | 99.00 | 1.00 | 0 | 26 | — | 0.19 | 0.76 | 0.25 | |
| BB-25 | 0.40 | 0.06 | 99.00 | 1.00 | 0 | 26 | — | 0.21 | 0.49 | 0.43 | |
| BB-26 | 0.40 | 0.06 | 97.00 | 3.00 | 0 | 15 | — | 0.19 | 0.77 | 0.25 | Character 1 |
| BB-27 | 0.40 | 0.06 | 97.00 | 3.00 | 0 | 15 | — | 0.22 | 0.45 | 0.49 | Character 2 |
| BB-28 | 0.40 | 0.06 | 97.00 | 3.00 | 0 | 15 | — | 0.18 | 0.75 | 0.24 | Character 2 |
| BB-29 | 0.40 | 0.06 | 96.95 | 3.00 | 0.05 | 15 | 15 | 0.22 | 0.45 | 0.49 | Character 2 |
| G-21 | 0.35 | 0.06 | 99.00 | 1.00 | 0 | 26 | — | 0.82 | 0.92 | 0.89 | |
| G-22 | 0.35 | 0.06 | 99.00 | 1.00 | 0 | 26 | — | 0.52 | 0.80 | 0.65 | |
| G-23 | 0.35 | 0.06 | 99.00 | 1.00 | 0 | 26 | — | 0.38 | 0.80 | 0.48 | |
| G-24 | 0.35 | 0.06 | 99.00 | 1.00 | 0 | 26 | — | 0.18 | 0.76 | 0.24 | |
| G-25 | 0.35 | 0.06 | 99.00 | 1.00 | 0 | 26 | — | 0.22 | 0.47 | 0.47 | |
| G-26 | 0.35 | 0.06 | 97.00 | 3.00 | 0 | 14 | — | 0.19 | 0.77 | 0.25 | Character 1 |
| G-27 | 0.35 | 0.06 | 97.00 | 3.00 | 0 | 14 | — | 0.23 | 0.48 | 0.48 | Character 2 |
| G-28 | 0.35 | 0.06 | 97.00 | 3.00 | 0 | 14 | — | 0.19 | 0.76 | 0.25 | Character 2 |
| G-29 | 0.35 | 0.06 | 96.95 | 3.00 | 0.05 | 14 | 16 | 0.21 | 0.46 | 0.46 | Character 2 |

TABLE 10

| Silver halide emulsion No. | Average grain diameter (μm) | *1 | Silver halide composition (mol %) Silver chloride | Silver bromide | Silver iodide | *2 | *3 | B/A | B/C | C/A | Characters |
|---|---|---|---|---|---|---|---|---|---|---|---|
| GG-21 | 0.30 | 0.07 | 99.00 | 1.00 | 0 | 28 | — | 0.81 | 0.93 | 0.87 | |
| GG-22 | 0.30 | 0.07 | 99.00 | 1.00 | 0 | 28 | — | 0.54 | 0.80 | 0.68 | |
| GG-23 | 0.30 | 0.07 | 99.00 | 1.00 | 0 | 28 | — | 0.38 | 0.80 | 0.48 | |
| GG-24 | 0.30 | 0.07 | 99.00 | 1.00 | 0 | 28 | — | 0.18 | 0.76 | 0.24 | |
| GG-25 | 0.30 | 0.07 | 99.00 | 1.00 | 0 | 28 | — | 0.23 | 0.47 | 0.49 | |
| GG-26 | 0.30 | 0.07 | 97.00 | 3.00 | 0 | 15 | — | 0.19 | 0.75 | 0.25 | Character 1 |
| GG-27 | 0.30 | 0.07 | 97.00 | 3.00 | 0 | 15 | — | 0.22 | 0.47 | 0.47 | Character 2 |
| GG-28 | 0.30 | 0.07 | 97.00 | 3.00 | 0 | 15 | — | 0.19 | 0.76 | 0.25 | Character 2 |
| GG-29 | 0.30 | 0.07 | 96.95 | 3.00 | 0.05 | 15 | 16 | 0.22 | 0.46 | 0.48 | Character 2 |
| R-21 | 0.32 | 0.07 | 99.00 | 1.00 | 0 | 26 | — | 0.84 | 0.90 | 0.93 | |
| R-22 | 0.32 | 0.07 | 99.00 | 1.00 | 0 | 26 | — | 0.52 | 0.82 | 0.63 | |
| R-23 | 0.32 | 0.07 | 99.00 | 1.00 | 0 | 26 | — | 0.38 | 0.81 | 0.47 | |
| R-24 | 0.32 | 0.07 | 99.00 | 1.00 | 0 | 26 | — | 0.19 | 0.76 | 0.25 | |
| R-25 | 0.32 | 0.07 | 99.00 | 1.00 | 0 | 26 | — | 0.21 | 0.46 | 0.46 | |
| R-26 | 0.32 | 0.07 | 97.00 | 3.00 | 0 | 15 | — | 0.19 | 0.76 | 0.25 | Character 1 |
| R-27 | 0.32 | 0.07 | 97.00 | 3.00 | 0 | 15 | — | 0.22 | 0.46 | 0.48 | Character 2 |
| R-28 | 0.32 | 0.07 | 97.00 | 3.00 | 0 | 15 | — | 0.19 | 0.76 | 0.25 | Character 2 |
| R-29 | 0.32 | 0.07 | 96.95 | 3.00 | 0.05 | 15 | 16 | 0.21 | 0.46 | 0.46 | Character 2 |
| RR-21 | 0.28 | 0.07 | 99.00 | 1.00 | 0 | 28 | — | 0.85 | 0.90 | 0.94 | |
| RR-22 | 0.28 | 0.07 | 99.00 | 1.00 | 0 | 28 | — | 0.55 | 0.80 | 0.69 | |
| RR-23 | 0.28 | 0.07 | 99.00 | 1.00 | 0 | 28 | — | 0.38 | 0.80 | 0.48 | |
| RR-24 | 0.28 | 0.07 | 99.00 | 1.00 | 0 | 28 | — | 0.19 | 0.76 | 0.25 | |
| RR-25 | 0.28 | 0.07 | 99.00 | 1.00 | 0 | 28 | — | 0.22 | 0.46 | 0.48 | |
| RR-26 | 0.28 | 0.07 | 97.00 | 3.00 | 0 | 15 | — | 0.19 | 0.76 | 0.25 | Character 1 |
| RR-27 | 0.28 | 0.07 | 97.00 | 3.00 | 0 | 15 | — | 0.21 | 0.46 | 0.46 | Character 2 |
| RR-28 | 0.28 | 0.07 | 97.00 | 3.00 | 0 | 15 | — | 0.18 | 0.76 | 0.24 | Character 2 |
| RR-29 | 0.28 | 0.07 | 96.95 | 3.00 | 0.05 | 15 | 16 | 0.22 | 0.46 | 0.48 | Character 2 |

Preparation of Photosensitive Silver Halide Emulsion

Preparation of Blue-sensitive Silver Halide Emulsions (B-21a)–(B-29a)

To Silver Halide Emulsions (B-21)–(B-29) prepared as above, added were sensitizing dyes BS-1 and BS-2 at 65° C., pH of 5.8, and pAg of 7.5, followed by sequential addition of sodium thiosulfate and chloroauric acid, to result in spectral sensitization and chemical sensitization. After addition of the chemical sensitizer and following adequate ripening, exemplified compounds S-2-5, S-2-2, and S-2-3 were sequentially added and ripening was stopped, to obtain Blue-sensitive Silver Halide Emulsions (B-21a)–(B-29a).

| | |
|---|---|
| Sodium thiosulfate | $9.1 \times 10^{-6}$ mol/mol AgX |
| Chloroauric acid | $2.6 \times 10^{-5}$ mol/mol AgX |
| Exemplified compound S-2-5 | $2.0 \times 10^{-4}$ mol/mol AgX |
| Exemplified compound S-2-2 | $2.0 \times 10^{-4}$ mol/mol AgX |
| Exemplified compound S-2-3 | $2.0 \times 10^{-4}$ mol/mol AgX |
| Sensitizing dye BS-1 | $8.0 \times 10^{-4}$ mol/mol AgX |
| Sensitizing dye BS-2 | $2.0 \times 10^{-4}$ mol/mol AgX |

Preparation of Blue-sensitive Silver Halide Emulsions (B-28b) and (B-29b)

Blue-sensitive Silver Halide Emulsions (B-28b) and (B-29b) were prepared in the same manner as above preparation of Blue-sensitive Silver Halide Emulsions (B-21a)–(B-29a), except that the added amount of sodium thiosulfate was changed to $5.5\times10^{-6}$ mol/mol AgX, after which $3.6\times10^{-6}$ mol/mol AgX of trifurylphosphine selenide was added, followed by chloroauric acid being added.

Preparation of Blue-sensitive Silver Halide Emulsions (B-28c) and (B-29c)

Blue-sensitive Silver Halide Emulsions (B-28c) and (B-29c) were prepared in the same manner as above preparation of Blue-sensitive Silver Halide Emulsions (B-28b) and (B-29c), except that the added amount of sodium thiosulfate was changed to $5.5\times10^{-6}$ mol/mol AgX, after which $3.6\times10^{-6}$ mol/mol AgX of trifurylphosphine selenide was added, followed by chloroauric acid being added.

Preparation of Blue-sensitive Silver Halide Emulsions (BB-21a)–(BB-29a), (BB-28b), (BB-28c), (BB-29b) and (BB-29c)

Blue-sensitive Silver Halide Emulsions (BB-21a)–(BB-29a), (BB-28b), (BB-28c), (BB-29b) and (BB-29c) were prepared in the same manner as preparation of Blue-sensitive Silver Halide Emulsions (B-21a)–(B-29a), (B-28b), (B-28c), (B-29b) and (B-29c), except that Silver Halide Emulsions (B-21)–(B-29) were respectively replaced with foregoing Silver Halide Emulsions (BB-21)–(BB-29), and the added amounts of sodium thiosulfate, trifurylphosphine selenide, chloroauric acid, sensitizing dyes BS-1 and BS-2 were each changed to be the same added amount as per surface area, considering the changes of surface area of the silver halide grains, caused by the change of the average grain diameters of silver halide grains from 0.45 μm–0.40 μm.

Preparation of Green-sensitive Silver Halide Emulsions (G-21a)–(G-29a)

To Silver Halide Emulsions (G-21)–(G-29) prepared as above, added was sensitizing dye GS-1 at 65° C., pH of 5.8, and pAg of 7.5, followed by sequential addition of sodium thiosulfate and chloroauric acid, resulting in spectral sensitization and chemical sensitization. After addition of chemical sensitizer and following adequate ripening, exemplified compound S-2-5 was added, and ripening was terminated, to obtain Green-sensitive Silver Halide Emulsions (G-21a)–(G-29a).

| | |
|---|---|
| Sensitizing dye GS-1 | $8.4\times10^{-4}$ mol/mol AgX |
| Sodium thiosulfate | $7.3\times10^{-6}$ mol/mol AgX |
| Chloroauric acid | $2.0\times10^{-5}$ mol/mol AgX |
| Exemplified compound S-2-5 | $1.5\times10^{-4}$ mol/mol AgX |

Preparation of Green-sensitive Silver Halide Emulsions (G-28b) and (G-29b)

Green-sensitive Silver Halide Emulsions (G-28b) and (G-29b) were prepared in the same manner as above preparation of Green-sensitive Silver Halide Emulsions (G-28a) and (G-29a), except that $1.3\times10^{-6}$ mol/mol AgX of Exemplified compound 1-21 was added after addition of sensitizing dye GS-1, but before addition of sodium thiosulfate.

Preparation of Green-sensitive Silver Halide Emulsions (G-28c) and (G-29b)

Green-sensitive Silver Halide Emulsions (G-28c) and (G-29c) were prepared in the same manner as above preparation of Green-sensitive Silver Halide Emulsions (G-28b) and (G-29b), except that the added amount of sodium thiosulfate was changed to $4.4\times10^{-6}$ mol/mol AgX, after which $2.6\times10^{-6}$ mol/mol AgX of trifurylphosphine selenide was added, followed by chloroauric acid being added.

Preparation of Green-sensitive Silver Halide Emulsions (GG-21a)–(GG-29a), (GG-28b), (GG-28c), (GG-29b) and (GG-29c)

Green-sensitive Silver Halide Emulsions (GG-21a)–(GG-29a), (GG-28b), (GG-28c), (GG-29b) and (GG-29c) were prepared in the same manner as preparation of Green-sensitive Silver Halide Emulsions (G-21a)–(G-29a), (G-28b), (G-28c), (G-29b) and (G-29c), except that Silver Halide Emulsions (G-21)–(G-29) were respectively replaced with foregoing Silver Halide Emulsions (GG-21)–(GG-29), and the added amounts of sodium thiosulfate, trifurylphosphine selenide, chloroauric acid, sensitizing dye GS-1 were each changed to be the same added amount per surface area, considering the changes of surface area of the silver halide grains, caused by the change of the average grain diameters of silver halide grains from 0.35 μm–0.30 μm.

Preparation of Red-sensitive Silver Halide Emulsions (R-21a)–(R-29a)

To Silver Halide Emulsions (R-21)–(R-29) prepared as above, added were sensitizing dyes RS-1 and RS-2 at 65° C., pH of 5.0, and pAg of 7.1, following sequential addition of sodium thiosulfate and chloroauric acid, resulting in spectral and chemical sensitization. After addition of chemical sensitizer and following adequate ripening, exemplified compound S-2-5 was added, and ripening was terminated, to obtain Red-sensitive Silver Halide Emulsions (R-21a)–(R-29a).

| | |
|---|---|
| Sodium thiosulfate | $1.1\times10^{-5}$ mol/mol AgX |
| Chloroauric acid | $1.7\times10^{-5}$ mol/mol AgX |
| Exemplified compound S-2-5 | $1.2\times10^{-4}$ mol/mol AgX |
| Sensitizing dye RS-1 | $1.5\times10^{-4}$ mol/mol AgX |
| Sensitizing dye RS-2 | $1.5\times10^{-4}$ mol/mol AgX |

Preparation of Red-sensitive Silver Halide Emulsions (R-28b) and (R-29b)

Red-sensitive Silver Halide Emulsions (R-28b) and (R-29b) were prepared in the same manner as above preparation of Red-sensitive Silver Halide Emulsions (R-28a) and (R-29a), except that the added amount of sodium thiosulfate was changed to $6.5\times10^{-6}$ mol/mol AgX, after which $4.5\times10^{-6}$ mol/mol AgX of trifurylphosphine selenide was added, followed by chloroauric acid being added.

Preparation of Red-sensitive Silver Halide Emulsions (R-28c) and (R-29c)

Red-sensitive Silver Halide Emulsions (R-28c) and (R-29c) were prepared in the same manner as above preparation of Red-sensitive Silver Halide Emulsions (R-28b) and (R-29b), except that the added amount of sodium thiosulfate was changed to $6.5\times10^{-6}$ mol/mol AgX, after which $4.5\times10^{-6}$ mol/mol AgX of trifurylphosphine selenide was added, followed by chloroauric acid being added.

Preparation of Red-sensitive Silver Halide Emulsions (RR-21a)–(RR-29a), (RR-28b), (RR-28c), (RR-29b) and (RR-29c)

Red-sensitive Silver Halide Emulsions (RR-21a)–(RR-29a), (RR-28b), (RR-28c), (RR-29b) and (RR-29c) were prepared in the same manner as preparation of Red-sensitive Silver Halide Emulsions (R-21a)–(R-29a), (R-28b), (R-28c), (R-29b) and (R-29c), except that Silver Halide Emulsions (R-21)–(R-29) were respectively replaced with foregoing Silver Halide Emulsions (RR-21)–(RR-29), and the added amounts of sodium thiosulfate, trifurylphosphine selenide, chloroauric acid, sensitizing dyes RS-1 and RS-2 were each changed to be the same added amount per surface area, considering the changes of surface area of the silver halide grains, caused by the decrease of the average grain diameters of silver halide grains from 0.32 μm to 0.28 μm.

Further, in preparation of each of the Red-sensitive Silver Halide Emulsions, $2.0\times10^{-2}$ mol/mol AgX of SS-1 was added at the end of the preparation stage.

Preparation of Silver Halide Color Photographic Material

Preparation of Samples 301–313

Samples 301–313 were prepared in the same manner as in preparation of Sample 101 of Example 1, except that the blue-sensitive silver halide emulsions of the first layer (being a blue-sensitive layer), the green-sensitive silver halide emulsions of the third layer (being a green-sensitive layer), and the red-sensitive silver halide emulsions of the fifth layer (being a red-sensitive layer) were changed to the combinations of the silver halide emulsions described in Table 11.

Evaluation of Specific Characteristics

Regarding Samples 301–313 prepared as above, sensitivity, latent image stability, processing stability and resistance to radioactive rays were evaluated in the same manner as described in Example 1, the results of which are shown in Table 11.

TABLE 11

| Sample No. | Photosensitive silver halide constitution: First layer (blue-sensitive layer) | Third layer (green-sensitive layer) | Fifth layer (red-sensitive layer | Latent image stability ΔS1 | Processing stability ΔS2 | Resistance to radioactive rays Fogging density increasing rate | Remarks |
|---|---|---|---|---|---|---|---|
| 301 | B-21a/BB-21a | G-21a/GG-21a | R-21a/RR-21a | 100 | 100 | 100 | Comp. |
| 302 | B-22a/BB-22a | G-22a/GG-22a | R-22a/RR-22a | 97 | 98 | 96 | Comp. |
| 303 | B-23a/BB-23a | G-23a/GG-23a | R-23a/RR-23a | 87 | 88 | 87 | Inv. |
| 304 | B-24a/BB-24a | G-24a/GG-24a | R-24a/RR-24a | 81 | 82 | 82 | Inv. |
| 305 | B-25a/BB-25a | G-25a/GG-25a | R-25a/RR-25a | 83 | 84 | 83 | Inv. |
| 306 | B-26a/BB-26a | G-26a/GG-26a | R-26a/RR-26a | 75 | 77 | 78 | Inv. |
| 307 | B-27a/BB-27a | G-27a/GG-27a | R-27a/RR-27a | 81 | 80 | 80 | Inv. |
| 308 | B-28a/BB-28a | G-28a/GG-28a | R-28a/RR-28a | 66 | 68 | 74 | Inv. |
| 309 | B-28b/BB-28b | G-28b/GG-28b | R-28b/RR-28b | 61 | 65 | 72 | Inv. |
| 310 | B-28c/BB-28c | G-28c/GG-28c | R-28c/RR-28c | 57 | 64 | 70 | Inv. |
| 311 | B-29a/BB-29a | G-29a/GG-29a | R-29a/RR-29a | 59 | 63 | 70 | Inv. |
| 312 | B-29b/BB-29b | G-29b/GG-29b | R-29b/RR-29b | 52 | 60 | 66 | Inv. |
| 313 | B-29c/BB-29c | G-29c/GG-29c | R-29c/RR-29c | 50 | 58 | 62 | Inv. |

Comp.: Comparative example
Inv.: This invention

As is apparent from the results described in Table 11, samples employing the silver halide emulsions of this invention is superior in latent image stability and exhibit relatively less volatility with changes over time from exposure to developing processing, and are also superior in processing stability in rapid processing conditions (being sensitivity fluctuation), and resistance to radioactive rays, compared to samples employing the comparative emulsions.

Further, based on the above methods, the green-images) sensitive layer (forming magenta images and the red-sensitive layer were evaluated in the same manner, resulting in confirmation of the targeted effects similar to the targeted effects described in Table 11 of the blue-sensitive layer.

What is claimed is:

1. A silver halide emulsion comprising silver halide grains and a binder, wherein an iridium complex is located at a surface, a subsurface, and an interior of the silver halide grain and satisfying Requirements (1) and (2):

$$0<B/A<0.2 \qquad \text{Requirement (1)}$$

$$0<B/C<0.7 \qquad \text{Requirement (2)}$$

wherein A (mol %) is an iridium content at a surface of the silver halide grains, B (mol %) is an average iridium content at a subsurface of the silver halide grains, and C (mol %) is an iridium content at a maximum point of the iridium content in an interior of the silver halide grains.

2. The silver halide emulsion of claim 1, further satisfying Requirement (1b):

$$0<B/A<0.1 \qquad \text{Requirement (1b).}$$

3. The silver halide emulsion of claim 1, further satisfying Requirement (1c):

$$0<B/A<0.05 \qquad \text{Requirement (1c.)}$$

4. The silver halide emulsion of claim 1, further satisfying Requirement (2b):

$$0<B/C<0.5 \qquad \text{Requirement (2b).}$$

5. The silver halide emulsion of claim 1, further satisfying Requirement (2c):

$$0<B/C<0.3 \qquad \text{Requirement (2c).}$$

6. The silver halide emulsion of claim 1 further satisfying Requirement (3):

$$0<C/A<0.5 \qquad \text{Requirement (3).}$$

7. A silver halide color photographic material comprising a support having thereon a yellow image forming layer, a magenta image forming layer, and a cyan image forming layer, each of the image forming layers comprising photosensitive silver halide grains and a binder, wherein at least one of the yellow image forming layer, the magenta image forming layer, and the cyan image forming layer contains the silver halide emulsion of claim 1.

8. A silver halide color photographic material comprising a support having thereon a yellow image forming layer, a magenta image forming layer, and a cyan image forming layer, each of the image forming layers comprising photosensitive silver halide grains and a binder, wherein at least one of the yellow image forming layer, the magenta image forming layer, and the cyan image forming layer contains the silver halide emulsion of claim 6.

9. The silver halide emulsion of claim 1, wherein a silver chloride content of the silver halide grains is at least 90 mol %, a silver bromide content is 0.1 to 10 mol %, and a silver iodide content is 0 to 2.0 mol %.

* * * * *